US005176989A

United States Patent [19]

Morigaki et al.

[11] Patent Number: 5,176,989

[45] Date of Patent: Jan. 5, 1993

[54] SILVER HALIDE COLOR PHOTOGRAPHIC MATERIAL

[75] Inventors: Masakazu Morigaki; Osamu Takahashi, both of Kanagawa, Japan

[73] Assignee: Fuji Photo Film Co., Ltd., Kanagawa, Japan

[21] Appl. No.: 759,982

[22] Filed: Mar. 20, 1991

Related U.S. Application Data

[63] Continuation of Ser. No. 242,005, Sep. 8, 1988, abandoned.

[30] Foreign Application Priority Data

Sep. 11, 1987 [JP] Japan ..... 62-228034

[51] Int. Cl.[5] ..... G03C 1/34; G03C 1/38; G03C 7/32; G03C 7/396

[52] U.S. Cl. ..... 430/505; 430/546; 430/551; 430/627

[58] Field of Search ..... 430/372, 551, 549, 545, 430/546, 609, 627, 505

[56] References Cited

U.S. PATENT DOCUMENTS

| | | | |
|---|---|---|---|
| 3,725,063 | 4/1973 | Wolfarth et al. | 430/236 |
| 3,772,014 | 11/1973 | Scullard | 430/372 |
| 3,912,513 | 10/1975 | Monbaliu et al. | 430/402 |
| 4,120,725 | 10/1978 | Nakazyo et al. | 430/545 |
| 4,204,867 | 5/1980 | Kaffner et al. | 430/380 |
| 4,358,533 | 11/1982 | Tokitou et al. | 430/546 |
| 4,464,463 | 8/1984 | Kojima et al. | 430/627 |
| 4,489,155 | 12/1984 | Sakanoue et al. | 430/551 |
| 4,513,080 | 4/1985 | Helling | 430/627 |
| 4,704,350 | 11/1987 | Morigaki et al. | 430/551 |
| 4,710,454 | 12/1987 | Zangen et al. | 430/546 |
| 4,770,987 | 9/1988 | Takahashi et al. | 430/551 |
| 4,857,449 | 8/1989 | Osawa et al. | 430/546 |
| 5,047,315 | 9/1991 | Morigaki et al. | 430/551 |

FOREIGN PATENT DOCUMENTS

| | | |
|---|---|---|
| 0255722 | 2/1988 | European Pat. Off. . |
| 0258662 | 3/1988 | European Pat. Off. . |

*Primary Examiner*—Lee C. Wright

*Attorney, Agent, or Firm*—Sughrue, Mion, Zinn, Macpeak & Seas

[57] ABSTRACT

A silver halide color photographic material comprising a support having thereon at least one silver halide emulsion layer containing an emulsified dispersion of at least one color image forming coupler and at least one organic synthetic polymer, the silver halide color photographic material further containing at least one compound capable of forming a chemical bond with an aromatic amine developing agent or an oxidation product thereof remaining after color development processing to form a chemically inactive and substantially colorless compound in a hydrophilic colloid layer on the support in the same side in which the silver halide emulsion layer is positioned. In the silver halide color photographic material light fading and dark fading are controlled with good balance to provide excellent image preservability.

23 Claims, No Drawings

SILVER HALIDE COLOR PHOTOGRAPHIC MATERIAL

This is a continuation of application Ser. No. 07/242,005, filed Sep. 8, 1988 now abandoned.

FIELD OF THE INVENTION

The present invention relates to a silver halide color photographic material, and more particularly relates to improvement in preservability of color photographs obtained by development processing of a color photographic light-sensitive material.

BACKGROUND OF THE INVENTION

In general, color images obtained by photographic processing of a silver halide color photographic material are composed of azomethine dyes or indoaniline dyes which are formed by a reaction between an oxidation product of an aromatic primary amine developing agent and a coupler. Color photographic images thus obtained are not necessarily stable to light or humidity and heat, and when they are exposed to light for a long period of time or preserved under conditions of high temperature and high humidity, color fading or discoloration of dye images occurs and the color images deteriorate.

Such deterioration of color image is a serious defect for recording materials. Therefore, in order to preserve semipermanently records formed from color photographic light-sensitive materials, it is desired that the three-color balance in fading of yellow, magenta and cyan dye images necessary to form color images maintain the initial color balance, as well as that such light fading and dark fading are reduced to the extent possible. However, the degree of light fading and dark fading of yellow, magenta and cyan dye images are different from each other and thus, the three-color balance in fading of yellow, magenta and cyan dye images is destroyed, resulting in disadvantageous degradation of image quality of dye images during preservation for a long period of time.

Although the degree of light fading and dark fading is naturally different depending on color couplers employed and other factors, in many cases dark fading occurs in the order of cyan dye images, yellow dye images and magenta dye images, and the degree of dark fading in cyan dye images is particularly large as compared with those in other dye images. On the other hand, light fading tends to occur in the order of cyan dye images, yellow dye images and magenta dye images, particularly in the case of a light source emitting a large amount of ultraviolet light.

Therefore, it is required to prevent light fading and dark fading of cyan dye images as much as possible in order to maintain the three color balance in fading of yellow, magenta and cyan dye images for a long period of time. For the purpose of preventing light fading and dark fading of dye images, various proposals have been made. For instance, many methods are known for obtaining fast dye images by modification of the coupler structure as described, for example, in U.S. Pat. Nos. 2,369,929, 2,772,162, 2,801,171, 2,895,826 and 3,767,412, JP-B-49-1572 (the term "JP-B" as used herein means an "examined Japanese patent publication"), JP-A-50-112038 (the term "JP-A" as used herein means an "unexamined published Japanese patent application"), JP-A-53-109630, JP-A-55-163537, JP-A-56-104333, JP-A-59-65844, JP-A-60-205447, JP-A-60-209735, and JP-A-61-39044. However, although these couplers have improved durability, only a small number of these couplers exhibit improvement in both light fastness and heat fastness, and the improvement is still insufficient, taking other photographic characteristics into consideration.

As another method for preventing fading due to light or heat, it is proposed to employ an ultraviolet light absorbing agent or a color fading preventing agent. There are known, for example, hydroquinones, hindered phenols, catechols, gallic acid esters, aminophenols, hindered amines, chromanols, hydroxy coumarans, indanes, ethers or esters formed by sililation, acylation or alkylation of the phenolic hydroxy groups of these compounds, and metal complexes as described in U.S. Pat. Nos. 3,935,016, 3,982,944 and 4,254,216, British Patent 2,066,975, U.S. Pat. Nos. 3,700,455, 4,360,589 and 3,457,079, JP-B-56-21144, U.S. Pat. Nos. 3,336,135, 4,268,593, 4,050,938, 4,241,155, 3,432,300, 3,574,627, 3,573,050, 4,155,765, 4,264,720, 3,764,337 and 4,174,220.

These compounds may have the effect of preventing color fading and discoloration of dye images, but since the effect is insufficient, and the use of these compounds changes the hue, forms fog, causes poor color formation, causes poor dispersibility, and causes fine crystals after coating silver halide emulsions, overall excellent effects for color photography have not yet been obtained by the use of these compounds.

Furthermore, most of these compounds do not improve the fastness of cyan or yellow images to light or heat, although they improve the light fastness of magenta images.

As the result of various investigations, it has been found that fastness of color images to light and heat can be remarkably improved by incorporating an organic synthetic polymer into a color photographic light-sensitive material. However, it is also found that, when the organic synthetic polymer is incorporated into a color photographic light-sensitive material as an additive, color stain occurs in the white background instead of fading of the color images during preservation after development processing, and the degree of color stain is higher than when the organic synthetic polymer is not employed. As the result of further extensive investigation, it is clear that such color stain is different from known yellow stain ("Y-stain") based on decomposition of couplers, and that the color stain is caused by components of processing solutions, particularly an aromatic primary amine compound as a developing agent and a compound derived therefrom, remaining in the photographic materials after development processing.

For the purpose of preventing the occurrence of such color stain, the use of certain amine compounds is described, for example, in U.S. Pat. Nos. 4,463,085 and 4,483,918, JP-A-59-218445 and JP-A-59-229557. However, these compounds are insufficient to achieve the above described purpose. In addition, many of these compounds remarkably reduce the improved fastness of color images which is attained by the addition of the organic synthetic polymer to photographic light-sensitive materials.

It is also known to employ a color fading preventing agent for the purpose of preventing yellow stain due to decomposition of couplers. However, these color fading preventing agents are almost ineffective to prevent the color stain associated with polymer additives although their effect on the prevention of yellow stain ("Y-stain") is recognized.

SUMMARY OF THE INVENTION

An object of the present invention is to provide a silver halide color photographic material which can form dye images in which light fading and dark fading are controlled in a good balance, which exhibits excellent image preservability particularly under conditions of high temperature and high humidity, and in which color stain during preservation of the color photographic material after processing is prevented.

Another object of the present invention is to provide a silver halide color photographic material which can form dye images having a good color balance in fading of yellow, magenta and cyan color images due to a controlled degree of fading, whereby excellent preservability is obtained when the color photographic material is stored for a long period of time, and in which color stain occurred during preservation of the color photographic material after processing is remarkably prevented.

A further object of the present invention is to provide a silver halide color photographic material which can form dye images having improved image preservability without adversely affecting various photographic properties.

A still further object of the present invention is to provide a silver halide color photographic material having excellent image preservability which contains a coupler emulsified dispersion which exhibits sufficiently high color forming properties even when processed with a color developing solution which does not substantially contain benzyl alcohol, and which has good stability.

A still further object of the present invention is to provide a silver halide color photographic material having improved dark fastness without degradation of light fastness of cyan dye images.

A still further object of the present invention is to provide a silver halide color photographic material in which the degradation of images and the occurrence of color stain caused by the aromatic amine color developing agent remaining therein, and other disadvantageous reactions, are prevented even when processed with a processing solution which provides a large amount of its components to the color photographic material, such as continuous processing; processing using a reduced amount of washing water or without a water washing step; processing with a color developing solution containing substantially no benzyl alcohol; or other processing solutions which impose a burden on color development.

Other objects of the present invention will become apparent from the following detailed description and examples.

As a result of various investigations, it has been invention can be accomplished with a silver halide color photographic material comprising a support having thereon at least one silver halide emulsion layer containing an emulsified dispersion of at least one color image forming coupler and at least one organic synthetic polymer, the silver halide color photographic material further containing at least one compound capable of forming a chemical bond with an aromatic amine developing agent or an oxidation product thereof remaining after color development processing to form a chemically inactive and substantially colorless compound in a hydrophilic colloid layer on the support in the same side in which the silver halide emulsion layer is positioned.

DETAILED DESCRIPTION OF THE INVENTION

The organic synthetic polymers which can be employed in the present invention are now described in detail.

The organic synthetic polymer which can be employed in the present invention may be any polymer as far as it is water-insoluble and organic solvent soluble, and is dissolved in water (at 25° C.) in a concentration of at most 1 wt %. More specifically it may be a homopolymer or copolymer composed of one or more monomers, a condensation polymer or an addition polymer. The typical example of the organic synthetic polymer which can be employed in the present invention involves those as described in WO 88/00723, pp. 13 to 30 in detail. Of these polymers those synthesized from a monomer having a dissociation group, partialarly having a substituent having pKa of at most 7 (for example, a carboxylic acid, a phosphoric acid, a sulfonic acid or an organic or inorganic salt thereof) are somewhat inferior to those which do not have such a substituent in view of an effect on improving fastness of color images. Therefore, in case of a polymer comprising a monomer having an acid group, the amount of the monomer having an acid group is preferably not more than 35% by mole. Of the polymer, those composed of a repeating unit having a linkage of

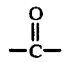

are preferred in view of color forming property and an effect on improving fastness of color images. Further, polymers having a glass transition point (Tg) of 50° C. or higher are more preferred, and polymers having Tg of 80° C. or higher are further more preferred. Polymers having a glass transition point of less than 50° C. surely produce an effect on improvement of image fastness under the accelerated deterioration condition of high temperature (above 80° C.). However, as the temperature approaches to room temperature, the effect is reduced and becomes as insubstantial as if no polymer is added.

The organic synthetic polymer is particularly preferably a homopolymer or copolymer of at least one monomer containing a

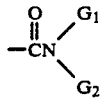

wherein $G_1$ and $G_2$ each represents hydrogen, a substituted or unsubstituted alkyl or aryl group.

The polymers which can be used in the present invention are explained in more detail with reference to specific examples thereof, but the present invention is not to be construed as being limited to these polymers.

(A) Vinyl polymers

Monomers for forming a vinyl polymer used in the present invention include an acrylic acid ester, a methacrylic acid ester, a vinyl ester, an acrylamide, a methacrylamide, an olefin, a styrene, a vinyl ether and other vinyl monomers.

Specific examples of acrylic acid esters include methyl acrylate, ethyl acrylate, n-propyl acrylate, isopropyl acrylate, n-butyl acrylate, isobutyl acrylate, sec-butyl acrylate, tert-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2 methoxyethyl acrylate, 3-methoxybutyl acrylate, 2-ethoxyethyl acrylate, 2-isopropoxyethyl acrylate, 2-butoxyethyl acrylate, 2-(2-methoxyethoxy)ethyl acrylate, 2-(2-butoxyethoxy)ethyl acrylate, ω-methoxypolyethylene glycol acrylate (addition molar number n=9), 1-bromo-2-methoxyethyl acrylate, and 1,1-dichloro-2-ethoxyethyl acrylate.

Specific examples of methacrylic acid esters include methyl methacrylate, ethyl methacrylate, n-propyl methacrylate, isopropyl methacrylate, n-butyl methacrylate, isobutyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, sulfopropyl methacrylate, N-ethyl-N-phenyl-aminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylene glycol monomethacrylate, dipropylene glycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-isopropoxyethyl methacrylate, 2-butoxyethyl methacrylate, 2-(2-methoxyethoxy) ethyl methacrylate, 2-(2-ethoxyethoxy)ethyl methacrylate, . 2-(2-butoxyethoxy)ethyl methacrylate, ω-methoxypolyethylene glycol methacrylate (addition molar number n=6), allyl methacrylate, and dimethylaminoethyl methacrylate methyl chloride salt.

Specific examples of vinyl esters include vinyl acetate, vinyl propionate, vinyl butyrate, vinyl iso-butyrate, vinyl caproate, vinyl chloroacetate, vinyl methoxyacetate, vinyl phenylacetate, vinyl benzoate, and vinyl salicylate.

Specific examples of acrylamides include acrylamide, methylacrylamide, ethylacrylamide, propylacrylamide, butylacrylamide, tert-butylacrylamide, cyclohexylacrylamide, benzylacrylamide, hydroxymethylacrylamide, methoxyethylacrylamide, dimethylaminoethylacrylamide, phenylacrylamide, dimethylacrylamide, diethylacrylamide, β-cyanoethylacrylamide, N-(2-acetoacetoxyethyl)acrylamide and diacetonacrylamide.

Specific examples of methacrylamides include methacrylamide, methylmethacrylamide, ethylmethacrylamide, propylmethacrylamide, butylmethacrylamide, tert-butylmethacrylamide, cyclohexylmethacrylamide, benzylmethacrylamide, hydroxymethylmethacrylamide, methoxyethylmethacrylamide, dimethylaminoethylmethacrylamide, phenylmethacrylamide, dimethylmethacrylamide, diethylmethacrylamide, β-cyanoethylmethacrylamide, and N-(2-acetoacetoxyethyl)-methacrylamide.

Specific examples of olefins include dicyclopentadiene, ethylene, propylene, 1-butene, 1-pentene, vinyl chloride, isoprene, chloro-prene, butadiene and 2,3-dimethylbutadiene.

Specific examples of styrenes include styrene, methylstyrene, dimethylstyrene, trimethylstyrene, ethyl styrene, isopropylstyrene, chloromethylstyrene, methoxystyrene, acetoxystyrene, chlorostyrene, dichlorostyrene, bromostyrene and vinyl benzoic acid methyl ester.

Specific examples of vinyl ethers include methyl vinyl ether, butyl vinyl ether, hexyl vinyl ether, methoxyethyl vinyl ether and dimethylaminoethyl vinyl ether.

Specific examples of other vinyl monomers include butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyl oxazolidone, N-vinyl pyrrolidone, acrylonitrile, methacrylonitrile, vinylidene Two or more kinds of monomers (for example, those as described above) can be employed together to prepare the polymers according to the present invention depending on various purposes (for example, improvement in solubility etc.). Further, for the purpose of adjusting color forming ability and solubility of the polymers, a monomer having an acid group as illustrated below can be employed as a comonomer, provided that the copolymer obtained is not water-soluble.

Specific examples of such monomers having an acid group include acrylic acid; methaclylic acid; itaconic acid; maleic acid; a monoalkyl itaconate, for example, monomethyl itaconate, monoethyl itaconate, monobutyl itaconate; a monoalkyl maleate, for example, monomethyl maleate, monoethyl maleate, monobutyl maleate; citraconic acid; styrene sulfonic acid; vinyl-benzylsulfonic acid; vinylsulfonic acid; an acryloyloxy-alkylsulfonic acid, for example, acryloyloxymethyl-sulfonic acid, acryloyloxyethylsulfonic acid, acryloyloxy-propylsulfonic acid; a methacryloyloxyalkylsulfonic acid, for example, methacryloyloxymethylsulfonic acid, methacryloyloxyethylsulfonic acid, methacryloyloxypropylsulfonic acid; an acrylamidoalkylsulfonic acid, for example, 2-acrylamido-2-methylethanesulfonic acid, 2-acrylamido-2-methylpropanesulfonic acid, 2-acrylamido-2-methylbutanesulfonic acid; and a methacrylamidoalkylsulfonic acid, for example, 2-methacrylamido-2-methylethanesulfonic acid, 2-methacrylamido-2-methylpropanesulfonic acid, or 2-methacrylamido-2-methylbutanesulfonic acid.

The acid may be in the form of a salt of an alkali metal, for example, sodium or potassium, or an ammonium ion.

When a hydrophilic monomer (which forms a hydrophilic homopolymer) selected from the vinyl monomers described above and other vinyl monomers used in the present invention, such as N-vinylpyrrolidone, etc., is employed as a comonomer, the ratio of the hydrophilic monomer contained in the copolymer is not strictly limited, provided that the copolymer is not rendered water-soluble. Usually, the ratio of the hydrophilic monomer is preferably not more than 40% by mole, more preferably not more than 20% by mole, and further more preferably not more than 10% by mole. Further, when a hydrophilic comonomer copolymerizable with the monomer of the present invention has an acid group, the ratio of the comonomer having an acid group contained in the copolymer is usually not more than 20% by mole, and preferably not more than 10% by mole. In the most preferred case the copolymer does not contain an acid group-containing monomer.

Preferred monomers for the polymer according to the present invention are methacrylate type monomers, acrylamide type monomers and methacrylamide type monomers. Particularly preferred monomers are acrylamide type monomers and methacrylamide type monomers.

(B) Polyester resins obtained by condensation of polyvalent alcohols and polybasic acids Useful polyvalent alcohols include a glycol having a structure of HO—$R_1$—OH (wherein $R_1$ represents a hydrocarbon chain having from 2 to about 12 carbon atoms, particularly an aliphatic hydrocarbon chain) and a polyalkylene glycol, and useful polybasic acids include those represented by the formula HOOC—$R_2$—COOH (wherein $R_2$ represents a single bond or a hydrocarbon chain having from 1 to about 12 carbon atoms).

Specific examples of the polyvalent alcohols include ethylene glycol, diethylene glycol, triethylene glycol, 1,2-propylene glycol, 1,3-propylene glycol, trimethylol propane, 1,4-butanediol, isobutylenediol, 1,5-pentanediol, neopentyl glycol, 1,6-hexanidiol, 1,7-heptanediol, 1,8-octanediol, 1,9-nonanediol, 1,10-decanediol, 1,11-undecanediol, 1,12-dodecanediol, 1,13-tridecanediol, 1,4-hexanediol, glycerol, diglycerol, triglycerol, 1-methyl-glycerol, erythritol, mannitol, and sorbitol.

Specific examples of polybasic acids include oxalic acid, succinic acid, glutaric acid, adipic acid, pimelic acid, cork acid, axelaic acid, sebacic acid, nonanedicarboxylic acid, decanedicarboxylic acid, undecanedicarboxylic acid, dodecanecarboxylic acid, fumaric acid, maleic acid, itaconic acid, citraconic acid, phthalic acid, isophthalate, terephthalate, tetrachlorophthalate, mesaconic acid, isopimelic acid, cyclopentadiene-maleic anhydride adduct, and rosin-maleic anhydride adduct.

(C) Other polymers

A polyester obtained by open ring condensation as shown below can be used in the present invention.

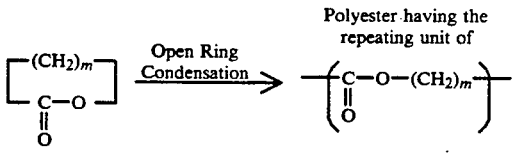

wherein m represents an integer from 4 to 7 and the —$CH_2$— chain may be a branched chain.

Suitable monomers for preparation of the polyester include β-propiolactone, ε-caprolactone, and dimethylpropiolactone.

Two or more kinds of the polymers according to the present invention disclosed above may optionally be used in combination.

The molecular weight and degree of polymerization of the polymer according to the present invention are not particularly limited with respect to the effect of the present invention. However, as the molecular weight becomes higher, some problems occur, e.g.: it takes much time to dissolve it in an auxiliary solvent; emulsification or dispersion becomes difficult due to the high viscosity of the solution; and coarse grains are formed, resulting in decreased color forming properties and coating properties. The example of the auxiliary solvent involves esters such as ethyl acetate, etc. and alcohols such as methanol, ethanol etc.

When a large amount of the auxiliary solvent is used to reduce the viscosity in order to avoid such difficulties, new problems in the process may occur.

From such a point of view, the viscosity of the polymer is preferably not more than 5,000 cps, more preferably not more than 2,000 cps when 30 g of the polymer is dissolved in 100 ml of an auxiliary solvent. Also, the molecular weight of the polymer useful in the present invention is preferably from $2\times10^3$ to $1\times10^6$, more preferably from $5\times10^3$ to $4\times10^5$ and further more preferably from $1\times10^4$ to $1.5\times10^5$.

The ratio of the polymer to an auxiliary solvent is different depending on a kind of the polymer used, and can be varied over a wide range depending on its solubility in the auxiliary solvent, its degree of polymerization, and the solubility of the coupler. Usually the auxiliary solvent is employed in an amount necessary to make the viscosity sufficiently low for easily dispersing a solution containing at least a coupler, a coupler solvent having a high boiling point and the polymer dissolved in the auxiliary solvent in water or an aqueous solution of a hydrophilic colloid. Since the viscosity of the solution increases with the degree of polymerization of the polymer, the ratio of the polymer to an auxiliary solvent cannot be determined uniformly independent of the kind of polymer. Usually, however, a ratio of polymer: solvent of about 1:1 to about 1:50 (by weight) is preferred. The ratio of the polymer according to the present invention to a coupler is preferably from 1:20 to 20:1, more preferably from 1:10 to 10:1 (by weight).

Specific examples of the polymers which can be used in the present invention are set forth below, but the present invention is not to be construed as being limited to these polymers.

| Examples | Polymers | Tg (°C.) |
|---|---|---|
| P-1 | Polyvinylacetate | 32 |
| P-2 | Polyvinylpropionate | 20 |
| P-3 | Polymethylmethacrylate | 105 |
| P-4 | Polyethylmethacrylate | 65 |
| P-5 | Polyethylacrylate | −24 |
| P-6 | Copolymer of vinylacetate-vinylalcohol (95:5) | (32) |
| P-7 | Poly(n-butylacrylate) | −54 |
| P-8 | Poly(n-butylmethacrylate) | 20 |
| P-9 | Poly(iso-butylmethacrylate) | 53 |
| P-10 | Poly(iso-propylmethacrylate) | 81 |
| P-11 | Poly(decylmethacrylate) | −70 |
| P-12 | Copolymer of n-butylacrylate-acrylamide (95:5) | (−54) |
| P-13 | Polymethylchloroacrylate | 140 |
| P-14 | 1,4-Butanediol-adipic acid polyester | −68 |
| P-15 | Ethyleneglycol sebacic acid polyester | — |
| P-16 | Polycaprolactone | — |
| P-17 | Poly(2-tert-butylphenyl acrylate) | 72 |
| P-18 | Poly(4-tert-butylphenyl acrylate) | 71 |
| P-19 | Copolymer of n-butylmethacrylate-N-vinyl-2-pyrrolidone (90:10) | (20) |
| P-20 | Copolymer of methylmethacrylate-vinyl chloride (70:30) | (105) |
| P-21 | Copolymer of methylmethacrylate-styrene (90:10) | (105) |
| P-22 | Copolymer of methylmethacrylate-ethylacrylate (50:50) | (105, −24) |
| P-23 | Copolymer of n-butylmethacrylate- | (20) |

-continued

| Examples | Polymers | Tg (°C.) |
|---|---|---|
| | methylmethacrylate-styrene (50:30:20) | |
| P-24 | Copolymer of vinylacetate-acrylamide (85:15) | (32) |
| P-25 | Copolymer of vinyl chloride-vinylacetate (65:35) | (81) |
| P-26 | Copolymer of methylmethacrylate-acrylonitrile (65:35) | (105) |
| P-27 | Copolymer of diacetoneacrylamide-methylmethacrylate (50:50) | (60, 105) |
| P-28 | Copolymer of vinylmethylketone-isobutylmethacrylate (55:45) | (–, 53) |
| P-29 | Copolymer of ethylmethacrylate-n-butylacrylate (70:30) | (65) |
| P-30 | Copolymer of diacetoneacrylamide-n-butylacrylate (60:40) | (60, –54) |
| P-31 | Copolymer of methylmethacrylate cyclohexylmethacrylate (50:50) | (105, 104) |
| P-32 | Copolymer of n-butylacrylate-styrenemethacrylate-diacetone-acrylamide (70:20:10) | (–54) |
| P-33 | Copolymer of N-tert-butylmethacryl amide-methylmethacrylate-acrylic acid (60:30:10) | (160, 105) |
| P-34 | Copolymer of methylmethacrylate-styrene-vinylsulfoneamide (70:20:10) | (105) |
| P-35 | Copolymer of methylmethacrylate-phenylvinylketone (70:30) | (105) |
| P-36 | Copolymer of n-butylacrylate-methylmethacrylate-n-butylmethacrylate (35:35:30) | (–54, 105) |
| P-37 | Copolymer of n-butylmethacrylate-pentylmethacrylate-N-vinyl-2-pyrrolidone (38:38:24) | (20, –5) |
| P-38 | Copolymer of methylmethacrylate-n-butylmethacrylate-isobutylmethacrylate-acrylic acid (37:29:25:9) | (105) |
| P-39 | Copolymer of n-butylmethacrylate-acrylic acid (95:5) | (20) |
| P-40 | Copolymer of methylmethacrylate-acrylic acid (95:5) | (105) |
| P-41 | Copolymer of benzylmethacrylate-acrylic acid (90:10) | (54) |
| P-42 | Copolymer of n-butylmethacrylate-methylmethacrylate-benzylmethacrylate-acrylic acid (35:35:25:5) | (20, 105) |
| P-43 | Copolymer of n-butylmethacrylate-methylmethacrylate-benzylmethacrylate (35:35:30) | (20) |
| P-44 | Poly(3-pentylacrylate) | (–6) |
| P-45 | Copolymer of cyclohexylmethacrylate-methylmethacrylate-n-propylmethacrylate (37:29:34) | (104) |
| P-46 | Poly(pentylmethacrylate) | –5 |
| P-47 | Copolymer of methylmethacrylate-n-butylmethacrylate (65:35) | (105, 20) |
| P-48 | Copolymer of vinylacetate-vinylpropionate (75:25) | (32) |
| P-49 | Copolymer of n-butylmethacrylate-sodium 3-acryloxybutane-1-sulfonate (97:3) | (20) |
| P-50 | Copolymer of n-butylmethacrylate-methylmethacrylate-acrylamide (35:35:30) | (20, 105) |
| P-51 | Copolymer of n-butylmethacrylate-methylmethacrylate-vinyl chloride (37:36:27) | (20, 105) |
| P-52 | Copolymer of n-butylmethacrylate-styrene (90:10) | (20) |
| P-53 | Copolymer of methylmethacrylate-N-vinyl-2-pyrrolidone | (105) |
| P-54 | Copolymer of n-butylmethacrylate-vinylchloride (90:10) | (20) |
| P-55 | Copolymer of n-butylmethacrylate-styrene (70:30) | (20) |
| P-56 | Poly(N-sec-butylacrylamide) | 117 |
| P-57 | Poly(N-tert-butylacrylamide) | 128 |
| P-58 | Copolymer of diacetoneacrylamide-methylmethacrylate (62:38) | (60, 105) |
| P-59 | Copolymer of poly(cyclohexylmethacrylate)-methylmethacrylate (60:40) | (104, 105) |
| P-60 | Copolymer of N-tert-butylacrylamide-methylmethacrylate (40:60) | (128, 105) |
| P-61 | Poly(N-n-butylacrylamide) | 46 |
| P-62 | Copolymer of poly(tert-butylmethacrylate)-N-tert-butylacrylamide (50:50) | (118, 128) |
| P-63 | Copolymer of tert-butylmethacrylate-methylmethacrylate (70:30) | (118) |
| P-64 | Poly(N-tert-butylmethacrylamide) | 160 |
| P-65 | Copolymer of N-tert-butylacrylamide-methylmethacrylate (60:40) | (128, 105) |
| P-66 | Copolymer of methylmethacrylate-acrylonitrile (70:30) | (105) |
| P-67 | Copolymer of methylmethacrylate-vinylmethylketone (28:72) | (105, –) |
| P-68 | Copolymer of methylmethacrylate-styrene (75:25) | (105) |
| P-69 | Copolymer of methylmethacrylate-hexylmethacrylate (70:30) | (105) |
| P-70 | Poly(benzylacrylate) | 6 |
| P-71 | Poly(4-biphenylacrylate) | 110 |
| P-72 | Poly(4-butoxycarbonylphenylacrylate) | 13 |
| P-73 | Poly(sec-butylacrylate) | –22 |
| P-74 | Poly(tert-butylacrylate) | 43 |
| P-75 | Poly[3-chloro-2,2-bis(chloromethyl)-propylacrylate] | 46 |
| P-76 | Poly(2-chlorophenylacrylate) | 53 |
| P-77 | Poly(4-chlorophenylacrylate) | 58 |
| P-78 | Poly(pentachlorophenylacrylate) | 147 |
| P-79 | Poly(4-cyanobenzylacrylate) | 44 |
| P-80 | Poly(cyanoethylacrylate) | 4 |
| P-81 | Poly(4-cyanophenylacrylate) | 90 |
| P-82 | Poly(4-cyano-3-thiabutylacrylate) | –24 |
| P-83 | Poly(cyclohexylacrylate) | 19 |
| P-84 | Poly(2-ethoxycarbonylphenylacrylate) | 30 |
| P-85 | Poly(3-ethoxycarbonylphenylacrylate) | 24 |
| P-86 | Poly(4-ethoxycarbonylphenylacrylate) | 37 |
| P-87 | Poly(2-ethoxyethylacrylate) | –50 |
| P-88 | Poly(3-ethoxypropylacrylate) | –55 |
| P-89 | Poly(1H,1H,5H-octafluoropentylacrylate) | –35 |
| P-90 | Poly(heptylacrylate) | –60 |
| P-91 | Poly(hexadecylacrylate) | 35 |
| P-92 | Poly(hexylacrylate) | –57 |
| P-93 | Poly(iso-butylacrylate) | –24 |
| P-94 | Poly(iso-propylacrylate) | –5 |
| P-95 | Poly(3-methoxybutylacrylate) | –56 |
| P-96 | Poly(2-methoxycarbonylphenylacrylate) | –46 |
| P-97 | Poly(3-methoxycarbonylphenylacrylate) | 38 |
| P-98 | Poly(4-methoxycarbonylphenylacrylate) | 67 |
| P-99 | Poly(2-methoxyethylacrylate) | –50 |
| P-100 | Poly(4-methoxyphenylacrylate) | 51 |
| P-101 | Poly(3-methoxypropylacrylate) | –75 |
| P-102 | Poly(3,5-dimethyladamanthylacrylate) | 106 |
| P-103 | Poly(3-dimethylaminophenylacrylate) | 47 |
| P-104 | Poly(tert-butylacrylate) | 86 |
| P-105 | Poly(2-methylbutylacrylate) | –32 |
| P-106 | Poly(3-methylbutylacrylate) | –45 |
| P-107 | Poly(1,3-dimethylbutylacrylate) | –15 |
| P-108 | Poly(2-methylpentylacrylate) | –38 |
| P-109 | Poly(2-naphthylacrylate) | 85 |
| P-110 | Poly(phenylacrylate) | 57 |
| P-111 | Poly(propylacrylate) | –37 |
| P-112 | Poly(m-tolylacrylate) | 25 |
| P-113 | Poly(o-tolylacrylate) | 52 |
| P-114 | Poly(p-tolylacrylate) | 43 |
| P-115 | Poly(N,N-dibutylacrylamide) | 60 |
| P-116 | Poly(iso-hexylacrylamide) | 71 |
| P-117 | Poly(iso-octylacrylamide) | 66 |
| P-118 | Poly(N-methyl-N-phenylacrylamide) | 180 |
| P-119 | Poly(adamanthylmethacrylate) | 141 |
| P-120 | Poly(benzylmethacrylate) | 54 |
| P-121 | Poly(2-bromoethylmethacrylate) | 52 |
| P-122 | Poly(2-N-tert-butylaminoethylmethacrylate) | 33 |
| P-123 | Poly(sec-butylmethacrylate) | 60 |
| P-124 | Poly(tert-butylmethacrylate) | 118 |
| P-125 | Poly(2-chloroethylmethacrylate) | 92 |
| P-126 | Poly(2-cyanoethylmethacrylate) | 91 |
| P-127 | Poly(2-cyanomethylphenylmethacrylate) | 128 |

-continued

| Examples | Polymers | Tg (°C.) |
|---|---|---|
| P-128 | Poly(4-cyanophenylmethacrylate) | 155 |
| P-129 | Poly(cyclohexylmethacrylate) | 104 |
| P-130 | Poly(dodecylmethacrylate) | −65 |
| P-131 | Poly(diethylaminoethylmethacrylate) | −20 |
| P-132 | Poly(2-ethylsulfinylethylmeth-acrylate) | 25 |
| P-133 | Poly(hexadecylmethacrylate) | 15 |
| P-134 | Poly(hexylmethacrylate) | −5 |
| P-135 | Poly(2-hydroxypropylmethacrylate) | 76 |
| P-136 | Poly(4-methoxycarbonylphenylmeth-acrylate) | 106 |
| P-137 | Poly(3,5-dimethyladamanthylmeth-acrylate) | 196 |
| P-138 | Poly(dimethylaminoethylmethacrylate) | 20 |
| P-139 | Poly(3,3-dimethylbutylmethacrylate) | 45 |
| P-140 | Poly(3,3-dimethyl-2-butylmeth-acrylate) | 108 |
| P-141 | Poly(3,5,5-trimethylhexylmeth-acrylate) | 1 |
| P-142 | Poly(octadecylmethacrylate) | −100 |
| P-143 | Poly(tetradecylmethacrylate) | 80 |
| P-144 | Poly(4-butoxycarbonylphenylmeth-acrylamide) | 128 |
| P-145 | Poly(4-carboxyphenylmethacrylamide) | 200 |
| P-146 | Poly(4-ethoxycarbonylphenylmeth-acrylamide) | 168 |
| P-147 | Poly(4-methoxycarbonylphenylmeth-acrylamide) | 180 |
| P-148 | Poly(butylbutoxycarbonylmethacrylate) | 25 |
| P-149 | Poly(butylchloroacrylate) | 57 |
| P-150 | Poly(butylcyanoacrylate) | 85 |
| P-151 | Poly(cyclohexylchloroacrylate) | 114 |
| P-152 | Poly(ethylchloroacrylate) | 93 |
| P-153 | Poly(ethylethoxycarbonylmeth-acrylate) | 52 |
| P-154 | Poly(ethylethacrylate) | 27 |
| P-155 | Poly(ethylfluoromethacrylate) | 43 |
| P-156 | Poly(hexylhexyloxycarbonylmeth-acrylate) | −4 |
| P-157 | Poly(iso-butylchloroacrylate) | 90 |
| P-158 | Poly(iso-propylchloroacrylate) | 90 |

Remarks

The data in parentheses show the glass transition temperature of a homopolymer of the monomers which are the main components of a captioned polymer.

The term "aromatic amine developing agents" as used in the present invention includes aromatic primary, secondary and tertiary amine compounds, and more specifically, phenylenediamine series compounds and aminophenol series compounds. Typical examples of these compounds are 3-methyl-4-amino-N,N-diethylaniline, 3-methyl-4-amino-N-ethyl-N-β-hydroxyethylaniline, 3-methyl-4-amino-N-ethyl-N-β-methanesulfon-amidoethylaniline, 3-methyl-4-amino-N-ethyl-N-β-methoxy-ethylaniline, 4-methyl- 2-amino-N,N-diethylaniline, 4-methyl-2-amino-N-ethyl-N-β-methanesulfonamidoethylaniline, 2 amino-N-ethyl-N-β-hydroxyethylaniline, 3-methyl-4-methylamino-N-ethyl-N-β-hydroxyethylaniline, 3-methyl-4-dimethyl amino-N-ethyl-N-β-methanesulfoamidoethylaniline, 3-methyl-4-butylamino-N,N-diethylaniline, 3-methyl-4-acetylamino N-ethyl-N-β-hydroxyethylaniline, 3-methyl-4-methanesulfonamide-N-ethyl-N-β-methanesulfonamidoethylaniline, 3-methyl-4-benzylamino-N-ethyl-N-β-methane-sulfonamidoethylaniline, 3-methyl-4-cyclohexylamino-N-ethyl N-methylaniline and their sulfates, hydrochlorides, phosphates, p-toluenesulfonates, tetraphenylborates and p-(t-octyl)benzenesulfonates, as well as o-aminophenol, p-aminophenol, 4-amino-2-methylphenol, 2-amino-3-methylphenol, and 2-hydroxy-3-amino-1,4-dimethylbenzene.

In addition, the compounds described in L. F. A. Mason, *Photographic Processing Chemistry* (by Focal Press), pages 226–229 (1966), U.S. Pat. Nos. 2,193,015 and 2,592,364, and JP-A-48-64933, can be employed.

The term "oxidation product of an aromatic amine developing agent" as used in the present invention includes an oxidation product formed by taking away one electron or two electrons of the above described aromatic amine developing agents, and a compound formed by releasing $H^{\oplus}$ therefrom.

The compound capable of forming a chemical bond with the aromatic amine developing agent after color development to form a chemically inactive and substantially colorless compound is disclosed in EP 258,662 A2 and preferably represented by the following general formula (I) or (II):

$$R_1\text{-}(A)_n\text{-}X \quad \text{(I)}$$

$$R_2\text{-}\underset{\underset{B}{|}}{C}=Y \quad \text{(II)}$$

wherein $R_1$ and $R_2$, which may be the same or different, each represents an aliphatic group, an aromatic group or a heterocyclic group; X represents a group capable of being released by a reaction with an aromatic amine developing agent; A represents a group capable of reacting with an aromatic amine developing agent to form a chemical bond; n represents 0 or 1; B represents hydrogen, an aliphatic group, an aromatic group, a heterocyclic group, an acyl group or a sulfonyl group; Y represents a group capable of accelerating the addition of an aromatic amine developing agent to the compound represented by the general formula (II); and $R_1$ and X, Y and $R_2$ or Y and B may be linked to form a ring; provided that the compound represented by the general formula (I) or (II) has a second order reaction rate constant $K_2$ at 80° C. in a reaction with p-anisidine (measured by the method described in EP 258,662 A2) of from 1.0 l/mol.sec to $1\times10^{-5}$ l/mol.sec (hereinafter simply referred to as a "second order reaction rate constant").

The compound capable of forming a chemical bond with the oxidation product of the aromatic amine developing agent after color development processing to give a chemically inactive and substantially colorless compound is desclosed in EP 255,722 A2 and preferably represented by the following general formula (III):

$$R\text{—}Z \quad \text{(III)}$$

wherein R represents an aliphatic group, an aromatic group or a heterocyclic group; and Z represents a nucleophilic group or a group capable of being decomposed in the photographic material to release a nucleophilic group, and is a nucleophilic functional group having a Pearson's nucleophilic $^{n}CH_3I$ value of at least 5 (as defined in R. G. Pearson et al., *J. Am. Chem. Soc.*, Vol. 90, page 319 (1968)) or a group derived therefrom.

Now, the compounds represented by formulae (I), (II) and (III) are described in more detail below.

The aliphatic group represented by $R_1$, $R_2$, B or R is a straight chain, branched chain or cyclic alkyl group, alkenyl group or alkinyl group and these groups may be substituted with a substituent. The aromatic group represented by $R_1$, $R_2$, B or R may be a carbocyclic series aromatic group (for example, phenyl, naphthyl) or a heterocyclic series aromatic group (for example, furyl, thienyl, pyrazolyl, pyridyl, indolyl) and the group may be a monocyclic series or condensed ring series (for example, benzofuryl, phenanthridinyl). Furthermore, these aromatic rings may have a substituent.

The heterocyclic group represented by $R_1$, $R_2$, B or R is preferably a group having a 3-membered to 10-membered ring composed of carbon atom(s), oxygen atom(s), nitrogen atom(s), or sulfur atom(s), the heterocyclic ring itself may be a saturated ring or an unsaturated ring, and further the ring may be substituted with a substituent (for example, chromanyl, pyrrolidyl, pyrrolinyl, morpholinyl).

X in the general formula (I) represents a group capable of being released upon a reaction with an aromatic amine developing agent and preferably represents a group connected to A through an oxygen atom, a sulfur atom or a nitrogen atom (for example, 3-pyrazolyloxy, 3H-1,2,4-oxadiazolin-5-oxy, aryloxy, alkoxy, alkylthio, arylthio, substituted N-oxy) or a halogen atom.

A in the general formula (I) represents a group capable of reacting with an aromatic amine developing agent to form a chemical bond and includes a group containing an atom of low electron density, for example,

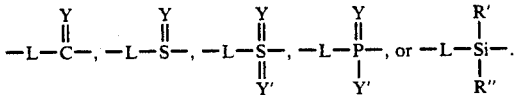

When X is a halogen atom, n is 0. In the above described formulae, L represents a single bond, an alkylene group,

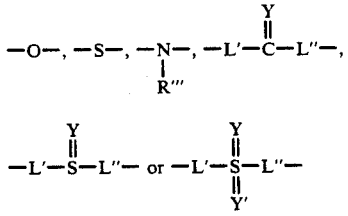

(for example, carbonyl, sulfonyl, sulfinyl, oxycarbonyl, phosphonyl, thiocarbonyl, aminocarbonyl or silyloxy).

Y has the same meaning as Y defined in the general formula (II), and Y' has the same meaning as defined for Y.

R' and R'', which may be the same or different, each represents —L'''—$R_0$. $R_0$ has the same meaning as $R_1$.

R''' represents hydrogen, an aliphatic group (for example, methyl, isobutyl, tert-butyl, vinyl, benzyl, octadecyl, cyclohexyl), an aromatic group (for example, phenyl, pyridyl, naphthyl), a heterocyclic group (for example, piperidyl, pyranyl, furyl, chromanyl), an acyl group (for example, acetyl, benzoyl), or a sulfonyl group (for example, methanesulfonyl, benzenesulfonyl).

L', L'' and L''', which may be the same or different, each represents —O—, —S— or

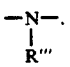

Among these groups, A is preferably a divalent group represented by

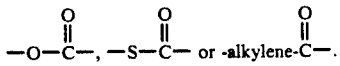

Of the compounds represented by the general formula (I), those represented by the general formula (I-a), (I-b), (I-c) or (I-d) described below and having a second order reaction rate constant $K_2$ (80° C.) in a reaction with p-anisidine in the range from $1\times10^{-1}$ l/mol.sec to $1\times10^{-5}$ l/mol.sec are preferred.

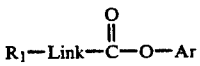

(I-a)

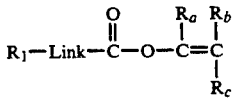

(I-b)

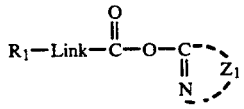

(I-c)

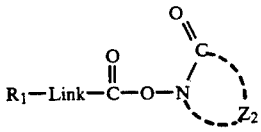

(I-d)

wherein $R_1$ has the same meaning as $R_1$ in formula (I); Link represents a single bond or —O—: Ar represents an aromatic group provided that it does not release a group useful as a photographic reducing group (such as a hydroquinone derivative, a catechol derivative by a reaction with an aromatic amine developing agent; $R_a$, $R_b$ and $R_c$, which may be the same or different, each represents hydrogen, an aliphatic group, an aromatic group, a heterocyclic group, an alkoxy group, an aryloxy group, a heterocyclic oxy group, a carboxyl group, an alkylthio group, an arylthio group, a heterocyclic thio group, an amino group, an alkylamino group, an acylamino group, a sulfonamido group, an acyl group, a sulfonyl group, an alkoxycarbonyl group, a sulfo group, a hydroxyl group, an acyloxy group, a ureido group, a urethane group, a carbamoyl group or a sulfamoyl group, and $R_a$ and $R_b$ or $R_b$ and $R_c$ may be linked to form a 5-membered to 7-membered substituted or unsubstituted heterocyclic ring heterocyclic spiro ring, heterocyclic bicyclo ring, heteroring condensed with an aromatic ring; and $Z_1$ and $Z_2$, which may be the same or different, each represents a non-metallic atomic group necessary for forming a 5-membered to 7-membered substituted or unsubstituted heterocyclic ring, heterocyclic spiro ring, heterocyclic bicyclo ring, or heterocyclic ring condensed with an aromatic ring.

In order to adjust the second order reaction constant $K_2$ (80° C.) in a reaction with p-anisidine in the range from $1\times10^{-1}$ l/mol.sec to $1\times10^{-5}$ l/mol.sec in the compound represented by the general formula (I-a), (I-b), (I-c) or (I-d), when Ar represents a carbocyclic series aromatic group in the general formula (I-a), one or more substituents may be appropriately selected. In this case, the sum of the Hammett's $\sigma$ value of the individual substituents is preferably not less than 0.2, more preferably not less than 0.4, and further more preferably not less than 0.6, although it depends on the type of group represented by $R_1$.

In the case of adding the compound represented by the general formula (I-a), (I-b), (I-c) or (I-d) to the photographic light-sensitive material during the production thereof, the total number of carbon atoms included in the compound is preferably at least 13, and higher numbers of carbon atoms are preferred.

It is preferred that the compound according to the present invention does not decompose during development processing in order to attain the objects of the present invention.

In the general formula (II), Y preferably represents an oxygen atom, a sulfur atom, $=N-R_4$ or

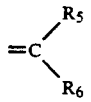

wherein, $R_4$, $R_5$ and $R_6$, which may be the same or different, each represents hydrogen, an aliphatic group (for example, methyl, isopropyl, tert-butyl, vinyl, benzyl, octadecyl, cyclohexyl), an aromatic group (for example, phenyl, pyridyl, naphthyl), a heterocyclic group (for example, piperidyl, pyranyl, furyl, chromanyl), an acyl group (for example, acetyl, benzoyl), or a sulfonyl group (for example, methanesulfonyl, benzenesulfonyl), and $R_5$ and $R_6$ may be linked to form a cyclic structure.

In the general formula (III), Z represents a nucleophilic group or a group capable of being decomposed in the photographic material to release a nucleophilic group. Preferred examples of the nucleophilic group include a nucleophilic group in which the atom directly chemically connecting to the oxidation product of the aromatic amine developing agent is an oxygen atom, a sulfur atom, or a nitrogen atom (for example, benzenesulfinyl, primary amino).

Of the compounds represented by the general formula (III) described above, a compound represented by the following general formula (III-a) is more preferred;

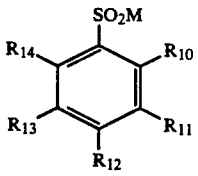

(III-a)

wherein M represents an atom or an atomic group forming an inorganic salt (for example, a salt of Li, Na, K, Ca, Mg) or an organic salt (for example, a salt of triethylamine, methylamine, ammonia),

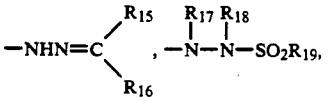

-continued

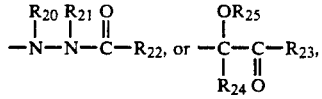

wherein $R_{15}$ and $R_{16}$, which may be the same or different, each represents hydrogen, an aliphatic group, an aromatic group, or a heterocyclic group, and $R_{15}$ and $R_{16}$ may be linked to form a 5-membered to 7-membered ring; $R_{17}$, $R_{18}$, $R_{20}$, and $R_{21}$, which may be the same or different, each represents hydrogen, an aliphatic group, an aromatic group, a heterocyclic group, an acyl group, an alkoxycarbonyl group, a sulfonyl group, a ureido group, or a urethane group, provided that at least one of $R_{17}$ and $R_{18}$ and at least one of $R_{20}$ and $R_{21}$, which may be the same or different, each represents hydrogen; $R_{22}$ represents hydrogen, an aliphatic group, an aromatic group, or a heterocyclic group; $R_{19}$ represents hydrogen, an aliphatic group, an aromatic group, a heterocyclic group, an alkylamino group, an arylamino group, an alkoxy group, an aryloxy group, an acyl group, an alkoxycarbonyl group, or an aryloxycarbonyl group; at least two of $R_{17}$, $R_{18}$ and $R_{19}$ may be linked to form a 5-membered to 7-membered ring, and at least two of $R_{20}$, $R_{21}$ and $R_{22}$ may be linked to form a 5-membered to 7-membered ring; $R_{23}$ represents hydrogen, an aliphatic group, an aromatic group or a heterocyclic group; $R_{24}$ represents hydrogen, an aliphatic group, an aromatic group, a halogen atom, an acyloxy group or a sulfonyl group; $R_{25}$ represents hydrogen or a hydrolyzable group; and $R_{10}$, $R_{11}$, $R_{12}$, $R_{13}$, and $R_{14}$, which may be the same or different, each represents hydrogen, an aliphatic group (for example, methyl, isopropyl, tert-butyl, vinyl, benzyl, octadecyl, cyclohexyl), an aromatic group (for example, phenyl, pyridyl, naphthyl), a heterocyclic group (for example, piperidyl, pyranyl, furyl, chromanyl), a halogen atom (for example, chlorine, bromine), $-SR_{26}$, $-OR_{26}$,

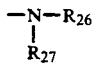

(wherein, $R_{26}$ and $R_{27}$, which may be the same or different, each represents hydrogen, an aliphatic group, an alkoxy group, or an aromatic group), an acyl group (for example, acetyl, benzoyl), an alkoxycarbonyl group (for example, methoxycarbonyl, butoxycarbonyl, cyclohexyloxycarbonyl, octyloxycarbonyl), an aryloxycarbonyl group (for example, phenyloxycarbonyl, naphthyloxycarbonyl), a sulfonyl group (for example, methanesulfonyl, benzenesulfonyl), a sulfonamido group (for example, methanesulfonamido, benzenesulfonamido), a sulfamoyl group, a ureido group, a urethane group, a carbamoyl group, a sulfo group, a carboxyl group, a nitro group, a cyano group, an alkoxyallyl group (for example, methoxyallyl, isobutoxyallyl, octyloxyallyl, benzyloxyallyl), an aryloxyallyl group (for example phenoxyallyl, naphthoxyallyl), a sulfonyloxy group (for example, methanesulfonyloxy, benzenesulfonyloxy), $-P(R_{26})_2$,

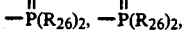

—$P(OR_{26})_2$, (wherein $R_{26}$ has the same meaning as defined above), or a formyl group.

In these groups, the group in which the sum of Hammett's $\sigma$ values to the —$SO_2M$ group is at least 0.5 is preferred.

Among the compounds represented by the general formulae (I), (II) and (III), those represented by the general formula (I) or (III) are preferred, although preferred compounds in the individual general formula are those as described above.

The compounds represented by the general formulae (I), (II) and (III) may be employed individually or in a combination of two or more thereof.

It is particularly preferred that a compound represented by the general formula (I) and a compound represented by the general formula (III) are employed together.

Representative examples of the compounds represented by the general formula (I), (II) or (III) used in the present invention are illustrated below, but the present invention is not to be construed as being limited thereto.

(I-1)

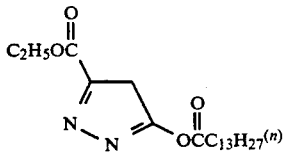

(I-2)

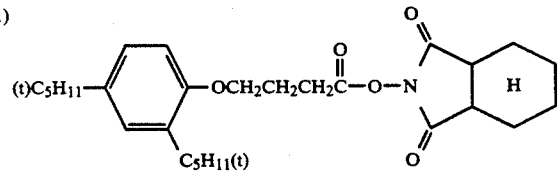

(I-3)

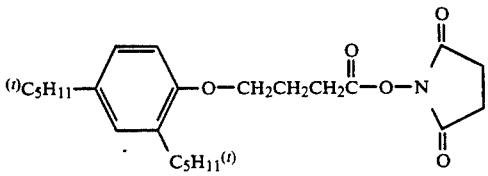

(I-4)

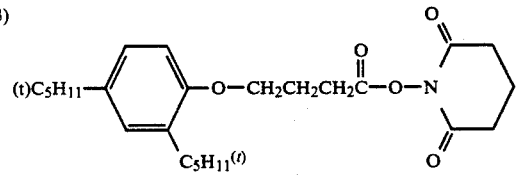

(I-5)

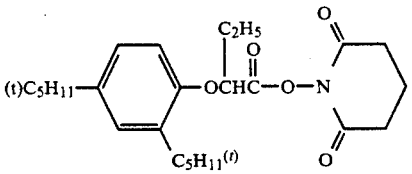

(I-6)

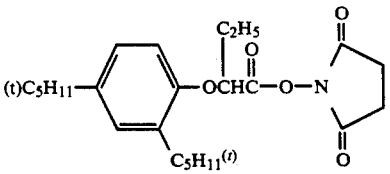

(I-7)

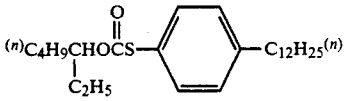

(I-8)

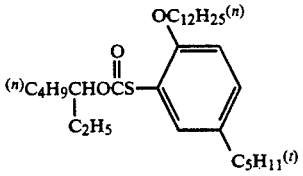

(I-9)

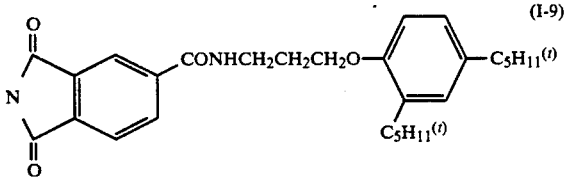

(I-10)

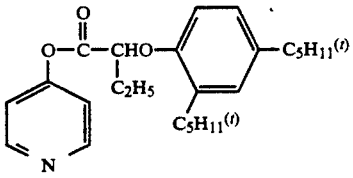

(I-11)

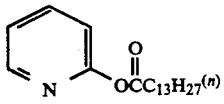

$^{(n)}C_{18}H_{37}I$ (I-12)

$^{(n)}C_{18}H_{37}Br$ (I-13)

(I-14)

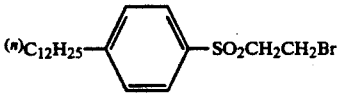

(I-15)

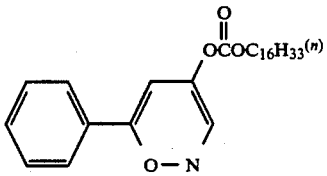

(I-16)

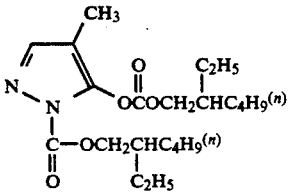

-continued
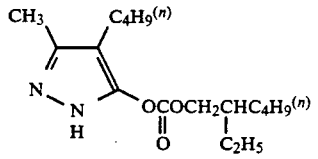
(I-17)
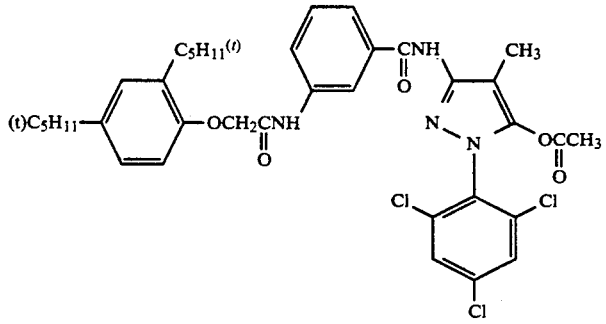
(I-18)
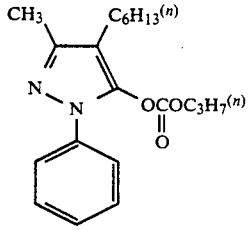
(I-19)
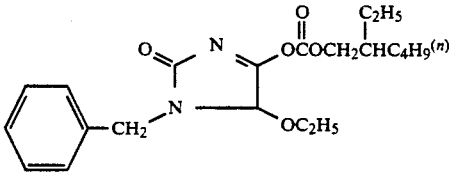
(I-20)
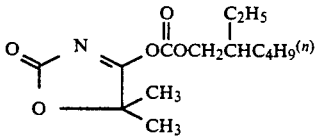
(I-21)
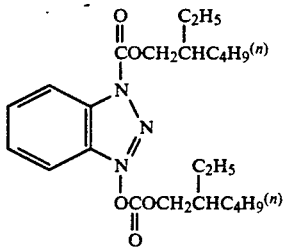
(I-22)
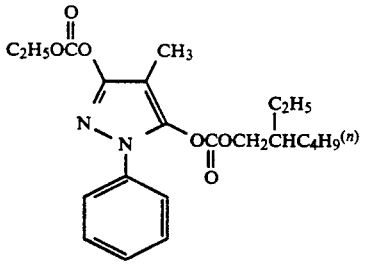
(I-23)
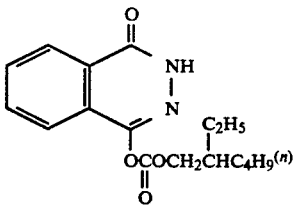
(I-24)
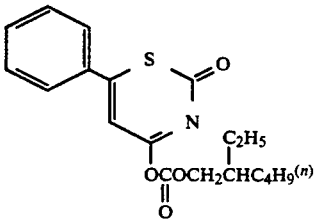
(I-25)
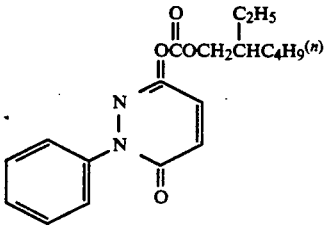
(I-26)

-continued
(I-27)
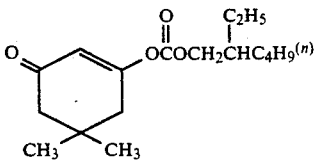
(I-28)
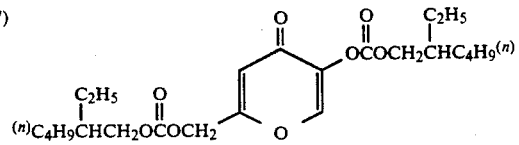
(I-29)
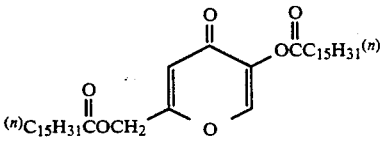
(I-30)
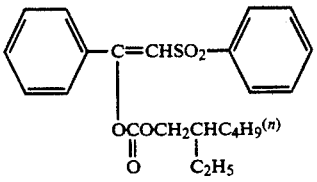
(I-31)
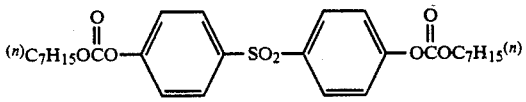
(I-32)
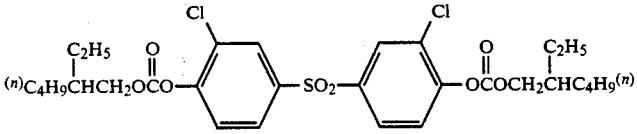
(I-33)
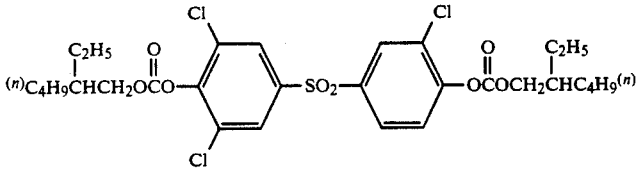
(I-34)
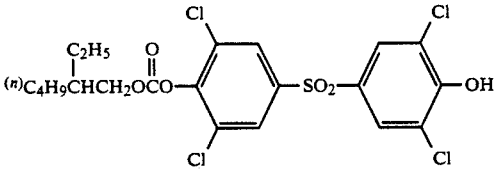
(I-35)
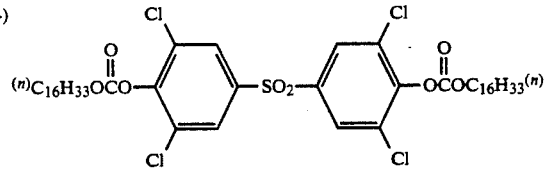
(I-36)
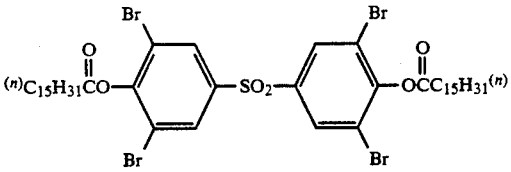
(I-37)
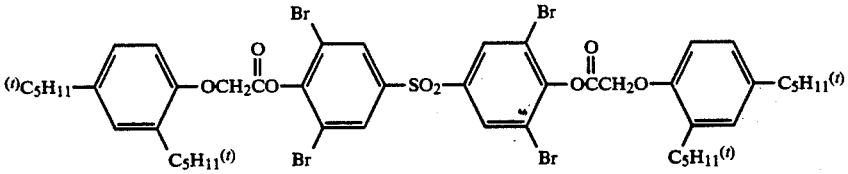
(I-38)
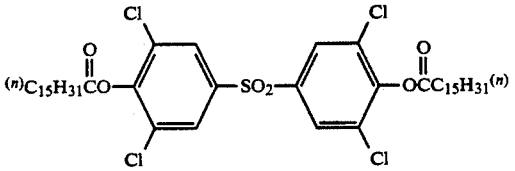
(I-39)
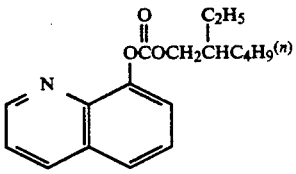

-continued
(I-40)
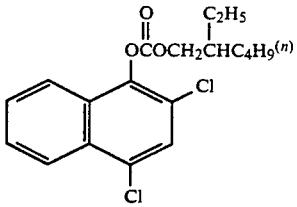
(I-41)
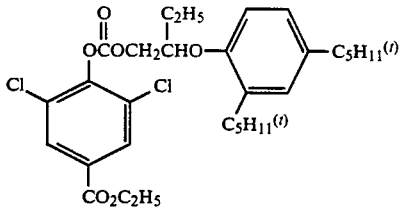
(I-42)
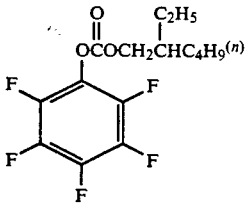
(I-43)
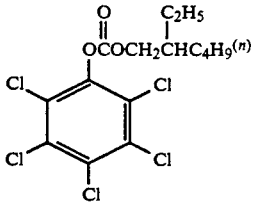
(I-44)
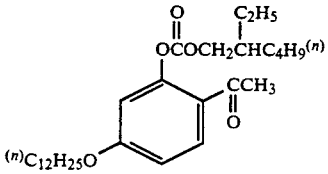
(I-45)
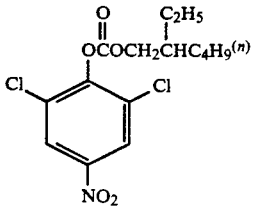
(I-46)
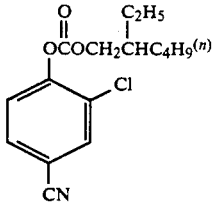
(I-47)
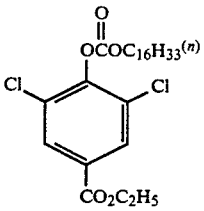
(I-48)
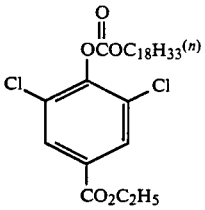
(I-49)
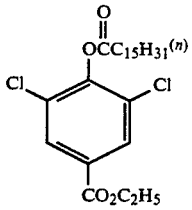
(I-50)
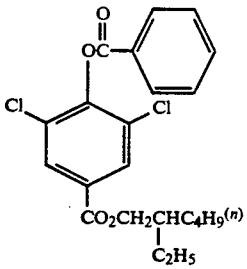
(I-51)
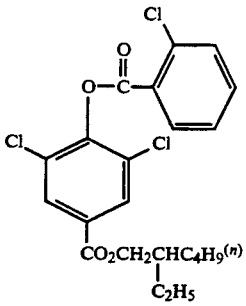
(I-52)
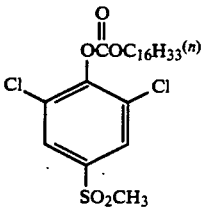
(I-53)
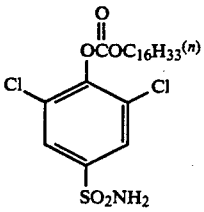

-continued
(I-54)
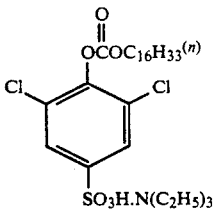
(I-55)
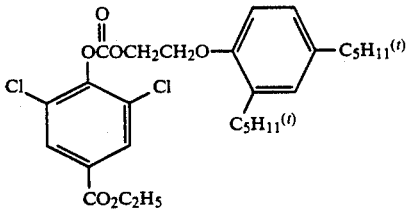
(I-56)
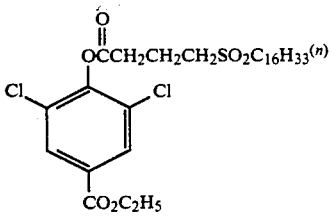
(I-57)
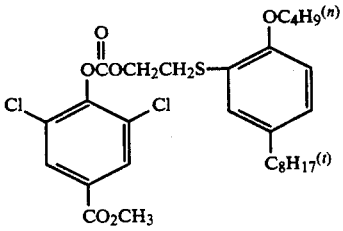
(I-58)
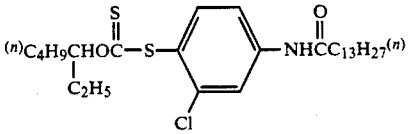
(I-59)
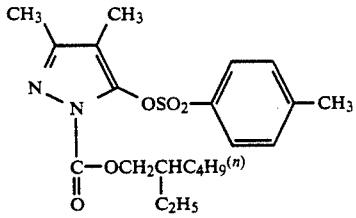
(I-60)
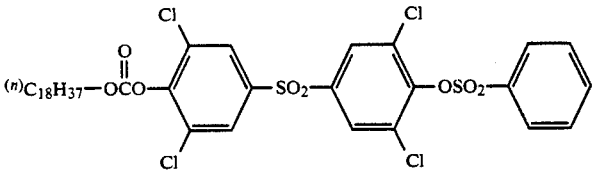
(I-61)
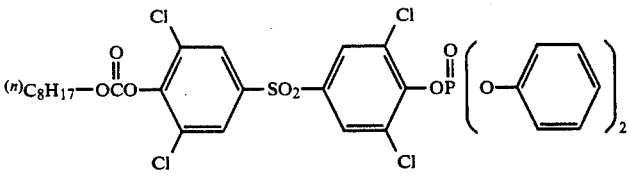
(I-62)
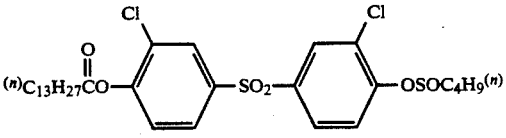
(I-63)
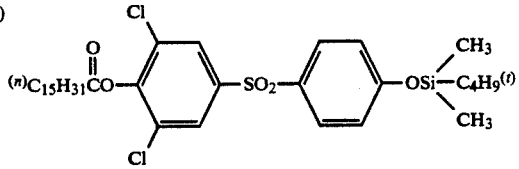
(I-64)
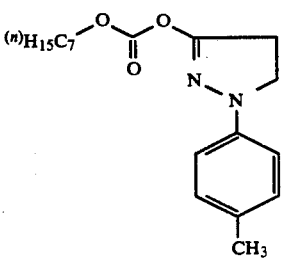
(I-65)
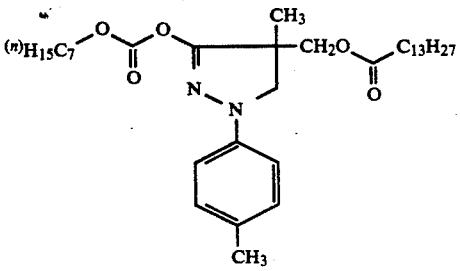

-continued
(I-67)
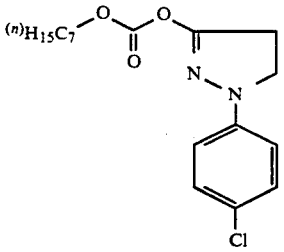
(I-68)
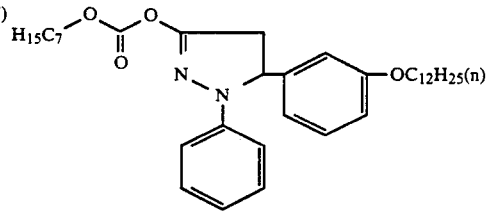
(I-69)
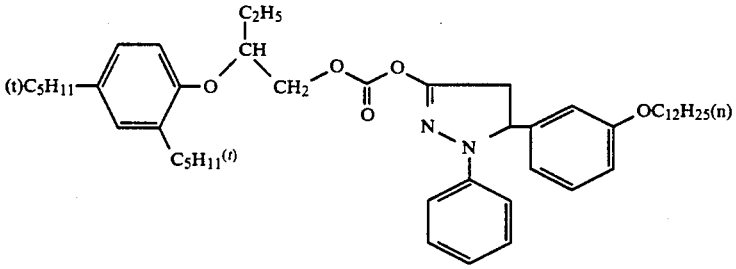
(I-70)
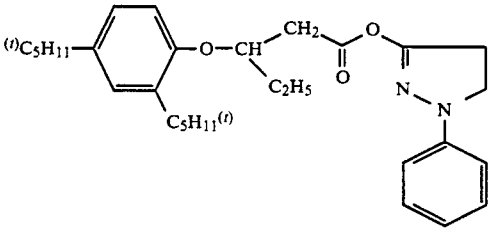
(I-71)
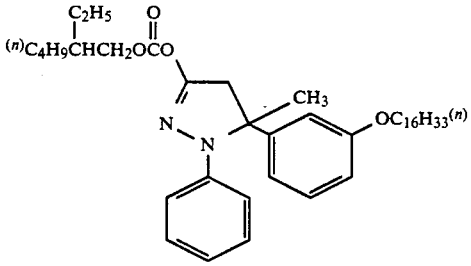
(I-72)
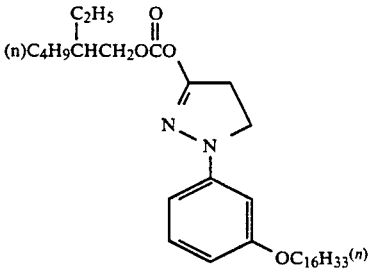
(I-73)
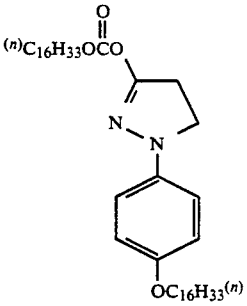
(I-74)
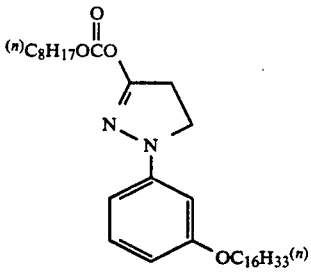
(I-75)
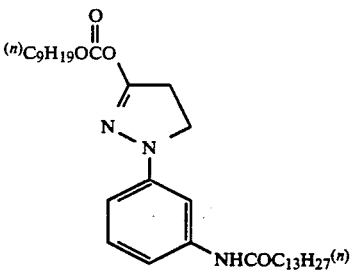
(I-76)
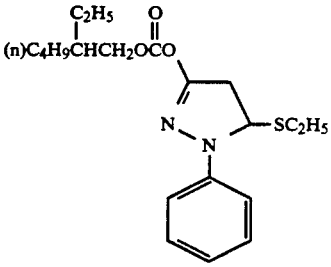
(I-77)
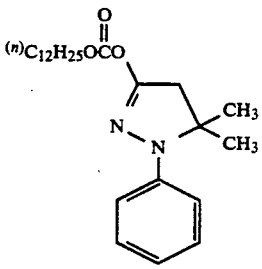

-continued
(I-78)
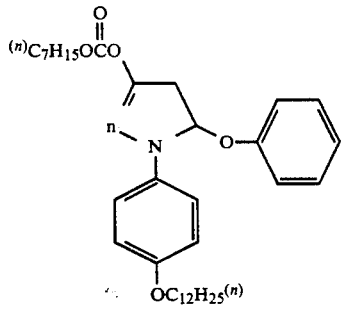
(I-79)
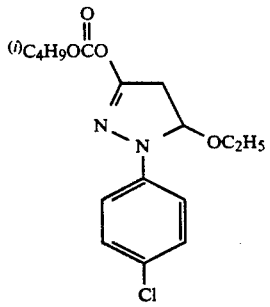
(I-80)
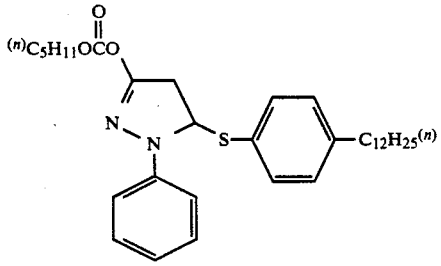
(I-81)
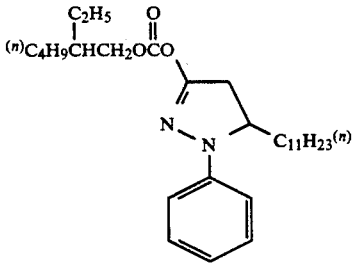
(I-82)
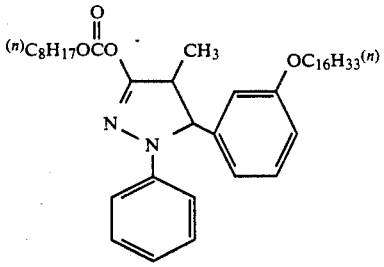
(I-83)
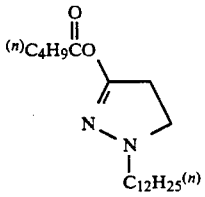
(I-84)
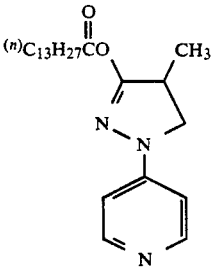
(I-85)
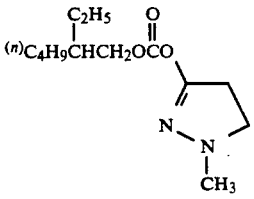
(I-86)
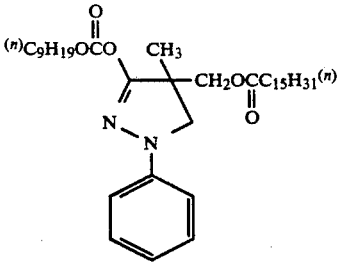
(I-87)
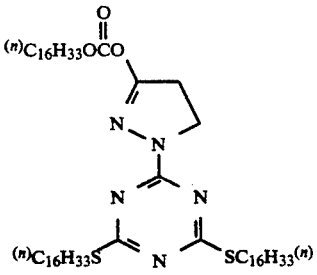
(I-88)
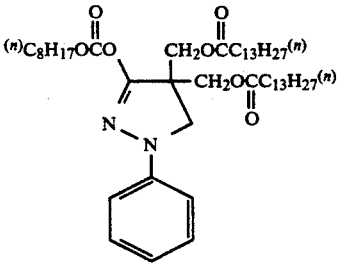
(I-89)
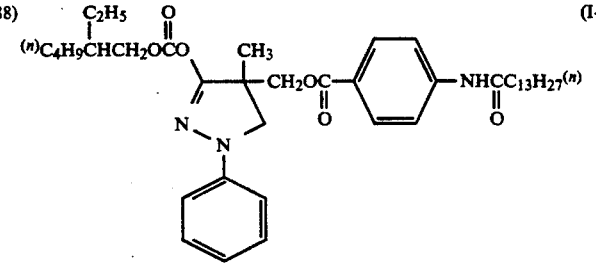

-continued
(I-90)
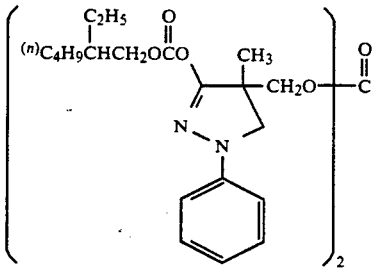
(I-91)
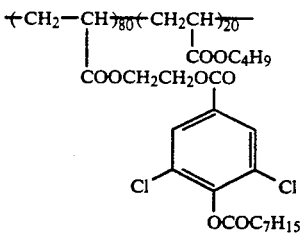
(I-92)
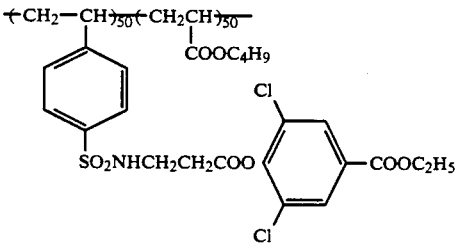
(I-93)
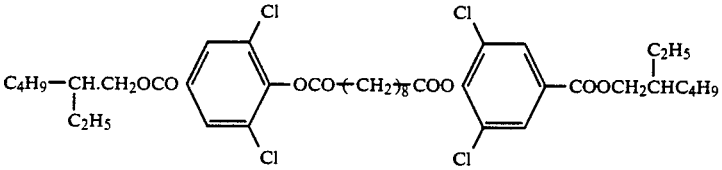
(I-94)
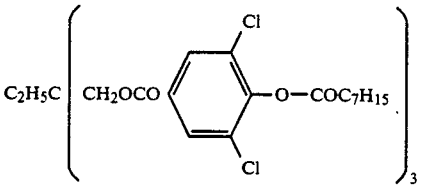
(II-1)
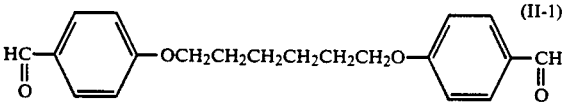
(II-2)
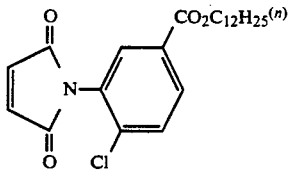
(II-3)
$CH_2{=}CH{-}SO_2{-}C_{18}H_{37}{}^{(n)}$
(II-4)
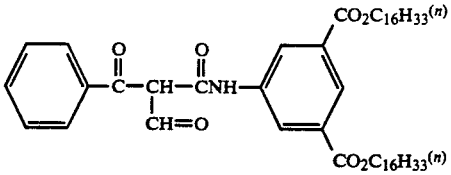
(II-5)
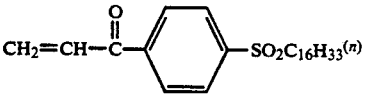
(III-1)
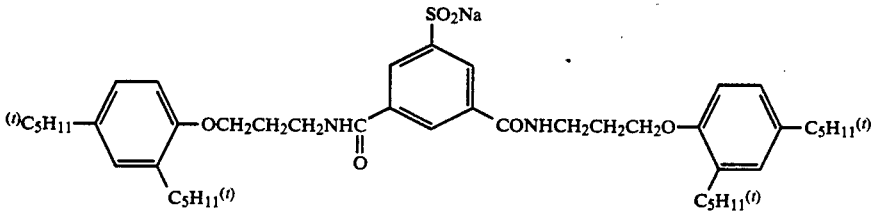

-continued
(III-2)
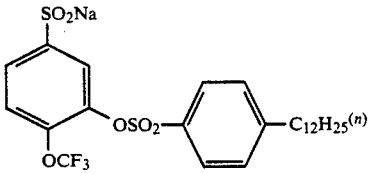
(III-3)
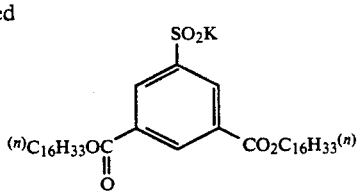
(III-4)
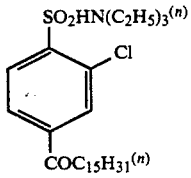
(III-5)
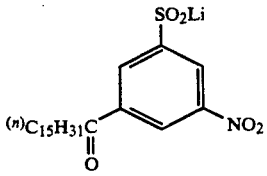
(III-6)
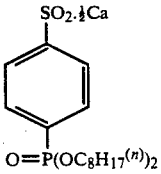
(III-7)
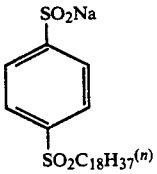
(III-8)
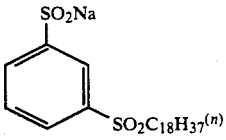
(III-9)
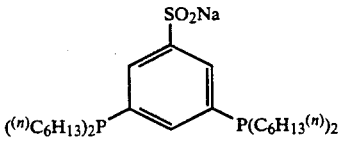
(III-10)
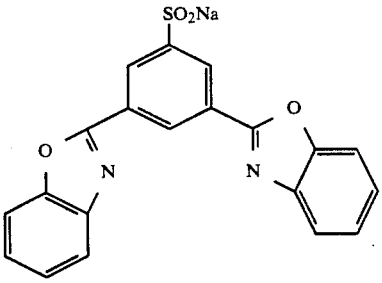
(III-11)
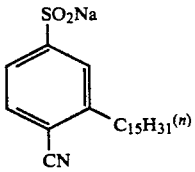
(III-12)
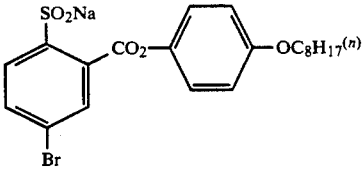
(III-13)
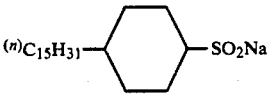
(III-14)
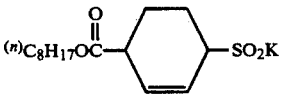
(III-15)
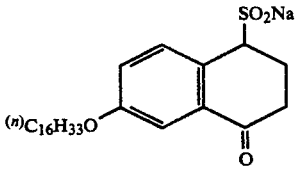
(III-16)
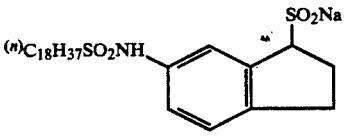
(III-17)
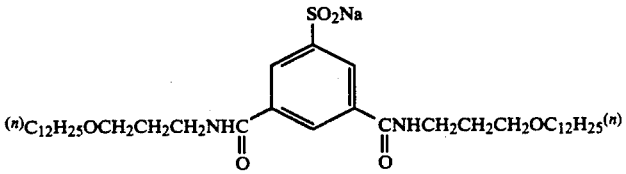

-continued
(III-18)
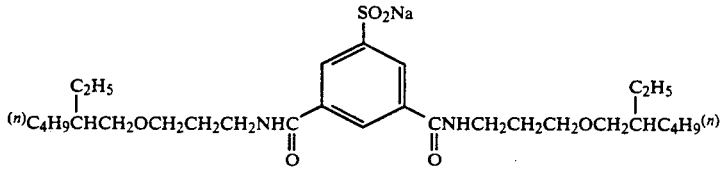
(III-19)
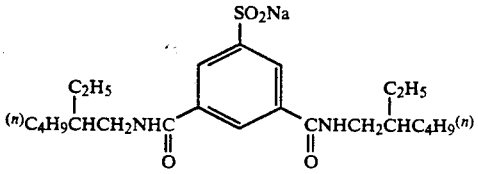
(III-20)
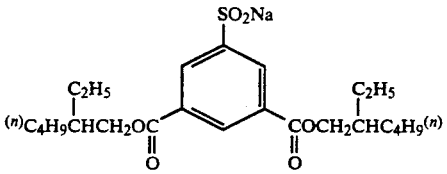
(III-22)
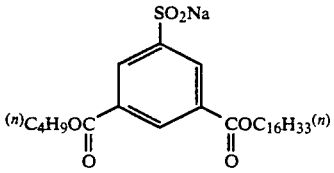
(III-23)
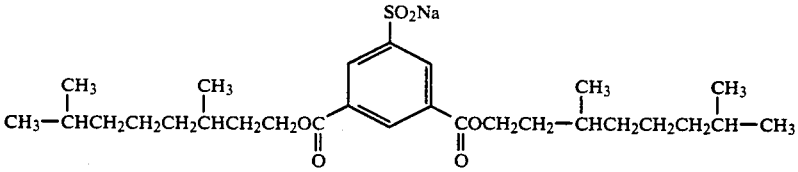
(III-24)
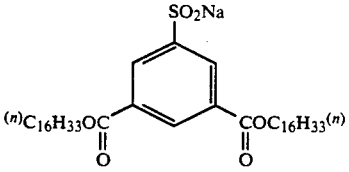
(III-25)
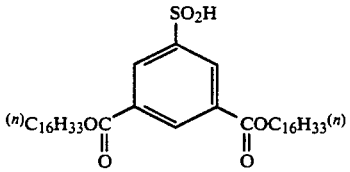
(III-26)
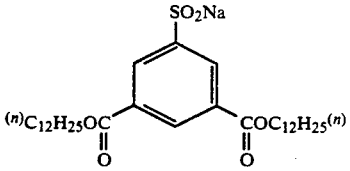
(III-27)
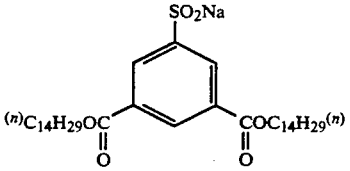
(III-28)
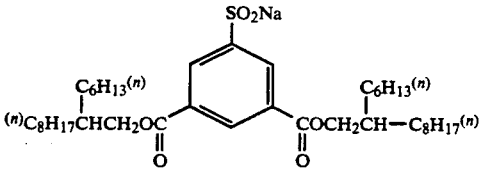
(III-29)
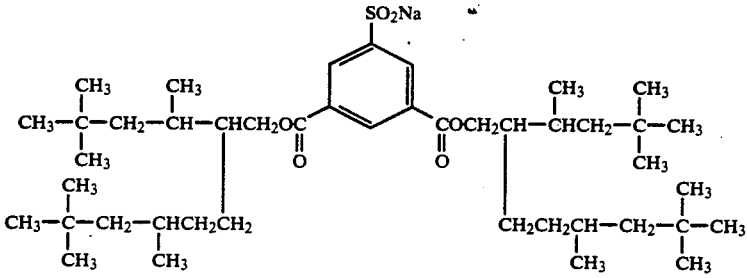

-continued
(III-30)
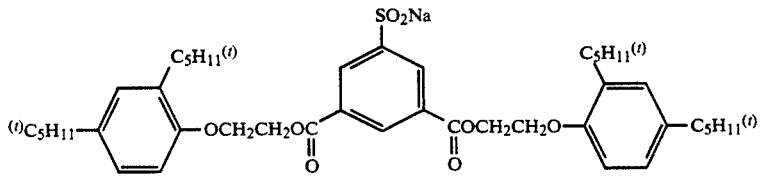
(III-31)
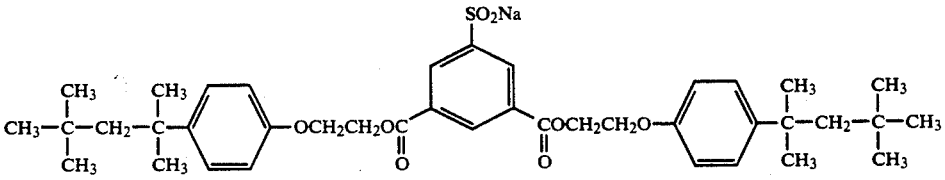
(III-32)
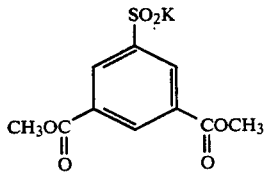
(III-33)
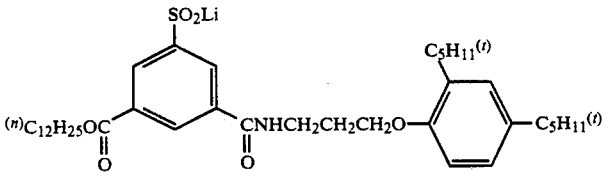
(III-34)
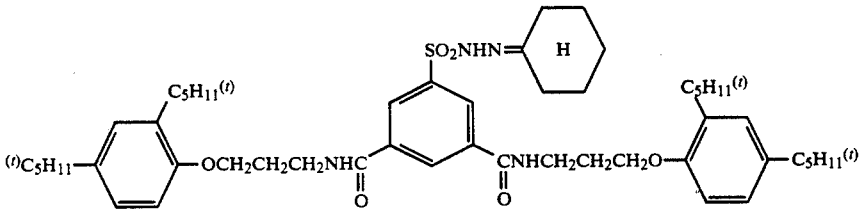
(III-35)
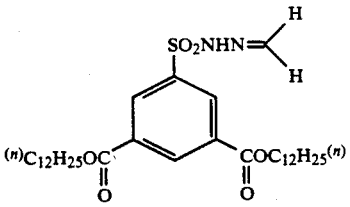
(III-36)
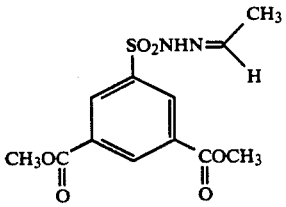
(III-37)
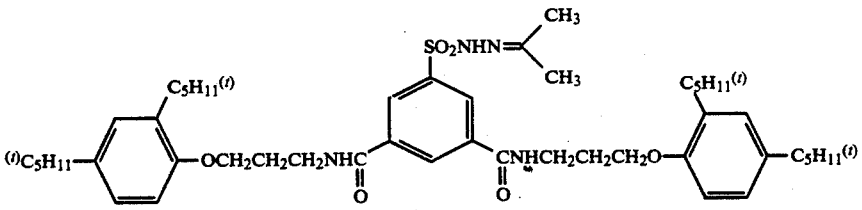
(III-38)
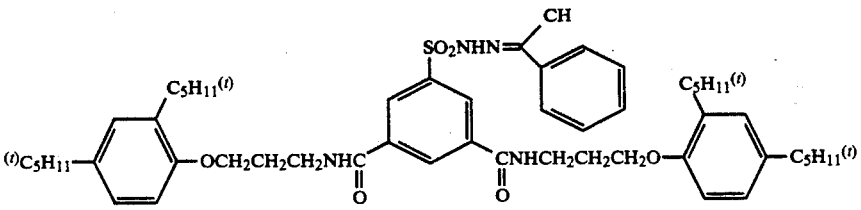

-continued
(III-39)
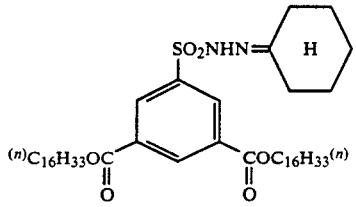
(III-40)
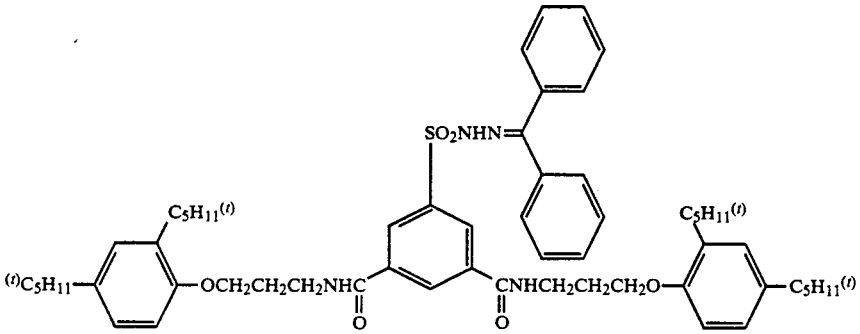
(III-41)
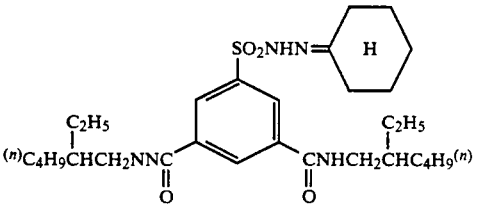
(III-42)
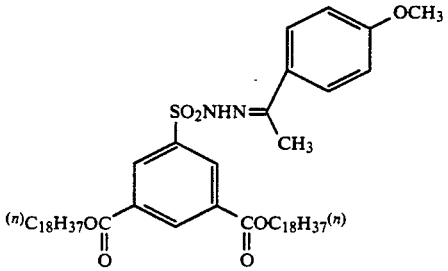
(III-43)
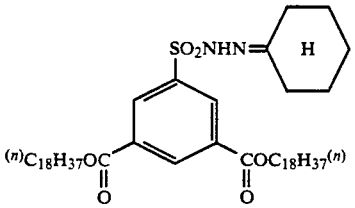
(III-44)
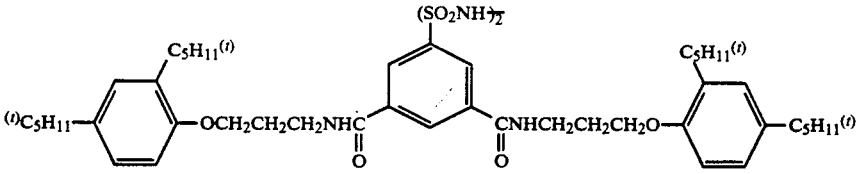
(III-45)
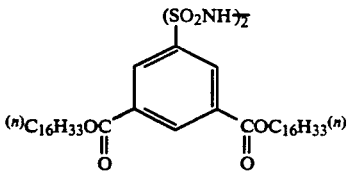
(III-46)
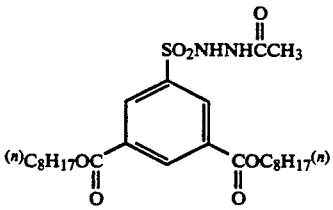
(III-47)
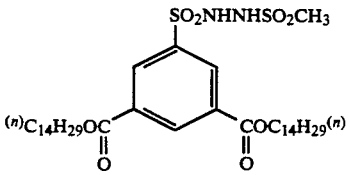

-continued
(III-48)
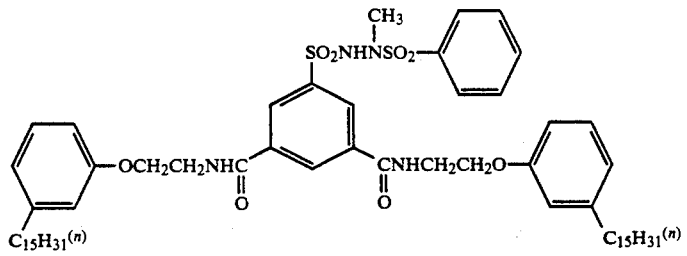
(III-49)
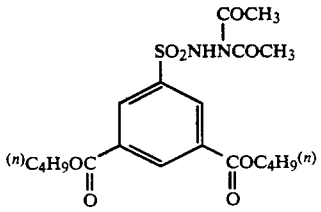
(III-50)
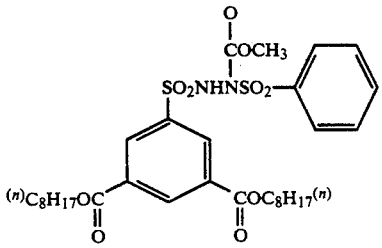
(III-51)
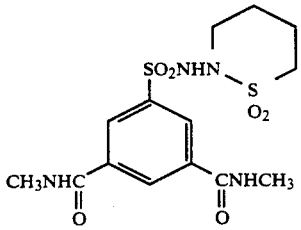
(III-52)
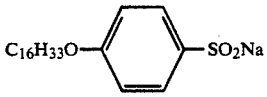
(III-53)
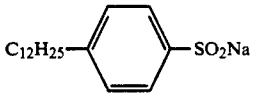
(III-54)
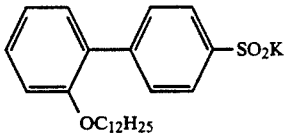
(III-55)
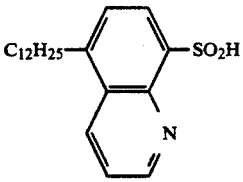
(III-56)
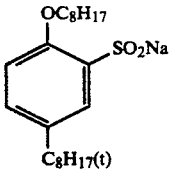
(III-57)
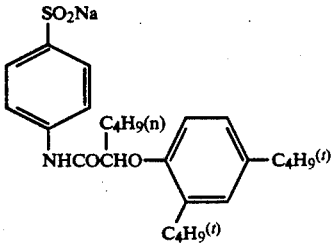

-continued (III-58)

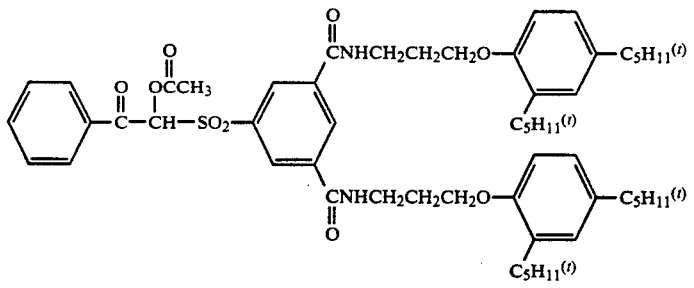

(III-59)

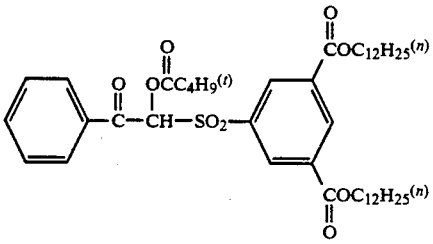

(III-60)

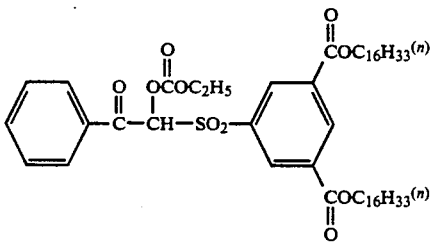

(III-61)

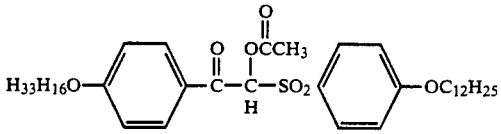

(III-62)

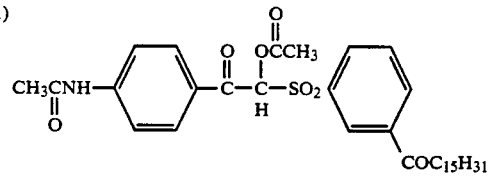

(III-63)

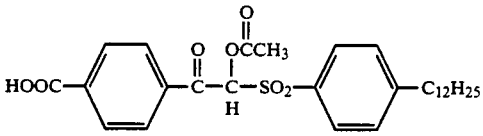

(III-64)

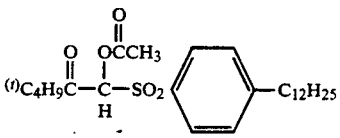

(III-65)

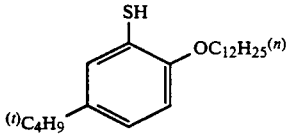

(III-66)

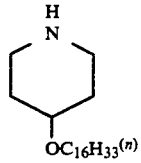

The compounds represented by the general formula (I), (II) or (III) can be synthesized according to the methods described in EP 230,048 A2, EP 258, 662 A2, EP 255,722 A2, JP-A-62-229145 and Japanese Patent Application No. 23467/86 or methods analogous thereto.

Examples of synthesis of typical compounds of the present invention are set forth below.

Synthesis Example 1 (Synthesis of Compound I-7)

Synthesis of
2-ethylhexyl-4-dodecylbenzenethiocarbonate
(above-mentioned Compound I-7)

150 ml of chloroform and 9.9 mol (0.071 mol) of triethylamine were added and dissolved in 18 g (0.065 mol) of 4-dodecylbenzenethiol and stirred at 25° C. To this was dropwise added 13.3 g (0.068 mol) of 2-ethylhexyl chlorocarbonate. After stirring for 30 minutes, a cold aqueous hydrochloric acid solution was added to the reaction mixture for liquid separation, and the chloroform layer separated was washed three times and with cold water and dried with Glauber's salt. After the Glauber's salt was filtered out, the chloroform was distilled out and the remaining precipitate was purified by column chromatography. The product was oily. Yield: 17.2 g, 61.2%.

| Result of elementary analysis ($C_{27}H_{46}O_2S_2$) | | | |
|---|---|---|---|
| | C | H | S |
| Measured data (%) | 74.34 | 10.66 | 14.91 |
| Calculated data (%) | 74.60 | 10.67 | 14.75 |

Synthesis Example 2 (Synthesis of Compound I-36)

Acetonitrile (300 ml) was added to 11.3 g of 3,3',5,5'-tetrabromobiphenylsulfone and 6.1 ml of triethylamine with stirring. To the mixture, 12.3 g of palmitic acid chloride was added dropwise at room temperature. After continued stirring for 5 hours, the reaction mixture was poured into 500 ml of water. The resulting crystal was recovered by filtration, washed with water and dried. Recrystallization with a mixed solvent of chloroform and ethyl acetate produced a crystal of Compound I-36. Yield: 17.5 g, 84.0%. Melting point: 125°-126° C.

| Result of elementary analysis ($C_{44}H_{66}Br_4O_6S$) | | | | |
|---|---|---|---|---|
| | C | H | Br | S |
| Measured data (%) | 50.60 | 6.21 | 30.39 | 3.11 |
| Calculated data (%) | 50.68 | 6.38 | 30.66 | 3.07 |

Synthesis Example 3 (Synthesis of Compound I-38)

Acetonitrile (300 ml) was added to 14.0 g of 3,3',5,5'-chloro-4,4'-dihydroxybiphenylsulfone and 11.2 ml of triethylamine with stirring. To the mixture, 22.0 g of palmitic acid chloride was added dropwise at room temperature. After completion of the addition, the internal temperature of the reaction system was elevated to 65° to 70° C. and the mixture was stirred for 1 hour. After completion of the reaction, the reaction mixture was poured into 1,000 ml of water, and the resulting crystal was recovered by filtration, washed with water and dried. Recrystallization with a mixed solvent of chloroform and ethyl acetate produced a crystal of Compound I-38. Yield: 19.7 g, 63.3%. Melting point 125°-126° C.

| Result of elementary analysis ($C_{44}H_{66}Cl_4O_6S$) | | | | |
|---|---|---|---|---|
| | C | H | Cl | S |
| Measured data (%) | 61.01 | 7.55 | 17.00 | 3.61 |
| Calculated data (%) | 61.10 | 7.69 | 16.40 | 3.71 |

Synthesis Example 4 (Synthesis of Compound I-41)

10.3 ml (0.0739 mol) of triethylamine was added to a solution of 15.8 g (0.0672 mol) of ethyl 3,5-dichloro-4-hydroxybenzoate in 158 ml of acetonitrile. Under stirring at 0° C., 27.3 g (0.0739 mol) of chlorocarbonyl-2-ethyl-2-(2,4-di(1,1-dimethylpropyl)phenoxy)ethyl was added dropwise at room temperature and the mixture was stirred for one hour and a half. To the reaction mixture, 800 ml of ethyl acetate was added and the ethyl acetate layer was washed with a saturated aqueous solution of sodium chloride and dried with Glauber's salt. After the Glauber's salt was filtered off, the filtrate was concentrated under vacuum to obtain 42.1 g of Compound IV-41 in a crude form. The crude product was purified by column chromatography on silica gel (800 g) using a hexane/ethyl acetate mixture as an eluting solvent under varying concentrations of 100/1 to 20/1. Compound I-41 was obtained as a colorless oil. Yield: 35.8 g, 94%.

| Result of elementary analysis ($C_{30}H_{40}Cl_2O_6$) | | | |
|---|---|---|---|
| | C | H | Cl |
| Measured data (%) | 63.68 | 7.06 | 12.23 |
| Calculated data (%) | 63.49 | 7.10 | 12.49 |

Synthesis Example 5 (Synthesis of Compound III-1)

i) Synthesis of 3,5-di-(2,4-di-tert-acylphenoxypropylcarbamoyl)benzenesulfonyl chloride To 10 g (0.034 mol) of 5-sulfoisophthalic acid dimethyl ester sodium salt were added 100 ml of toluene, 16 ml (0.080 mol) of a methanol solution containing 28% sodium methylate, and 24.7 g (0.085 mol) of 2,4-di-tert-amylphenoxypropylamine and the mixture was heated to 100° C. The mixture was heated for 3 hours while distilling off methanol therefrom and, after cooling the reaction mixture, cold water was added thereto. The toluene layer formed was recovered, washed twice with cold water, and then dried using Glauber's salt. Then the Glauber's salt was filtrated away, the filtrate was concentrated to dryness, dissolved in 100 ml of N,N-dimethylacetamide and 50 ml of acetonitrile and the solution was stirred at room temperature. To the solution was added 30 ml (0.326 mol) of phosphorus oxychloride and the mixture was heated to 50° C. to 60° C. for one hour. The reaction mixture was added to ice water, extracted with 300 ml of ethyl acetate, and the ethyl acetate layer formed was recovered, washed thrice with ice water, and dried over Glauber's salt. After filtrating away the Glauber's salt, ethyl acetate was distilled off from the filtrate, and the residue was purified by column chromatography to provide 11.5 g (yield of 41.9%) of the desired product.

ii) Synthesis of sodium 3,5-di-(2,4-di-tert-amylphenoxypropylcarbamoyl)benzenesulfinate (Compound III-1)

To 2 g (0.016 mol) of sodium sulfite and 2.4 g (0.029 mol) of sodium hydrogen carbonate were added 100 ml of water and 20 ml of acetonitrile and the mixture was stirred at 30° C. To the mixture was added dropwise a solution of 10.5 g (0.013 mol) of 3,5-di-(2,4-di-tert-amylphenoxypropylcarbamoyl)benzenesulfonyl chloride obtained in the aforesaid step dissolved in 100 ml of acetonitrile. After stirring the resultant mixture for one hour, the reaction mixture was poured onto ice water and extracted with 150 ml of ethyl acetate. The ethyl acetate layer was washed thrice with cold water and dried over Glauber's salt. After filtrating away the Glauber's salt, the residue was concentrated to dryness to provide 8.6 g (yield of 82.8%) of a solid product.

| Elemental Analysis for $C_{46}H_{67}N_2O_6SNa$: | | | | |
|---|---|---|---|---|
| | C | H | N | S |
| Found: | 68.75% | 8.39% | 3.32% | 3.92% |
| Calculated: | 69.14% | 8.45% | 3.51% | 4.01% |

Synthesis Example 6 (Synthesis of Compound III-25)

i) Synthesis of sodium 3,5-dihexadecyloxycarbonylbenzenesulfonate 210 ml of toluene, 4.57 ml (0.0705 mol) of methanesulfonic acid, and 68.3 g (0.282 mol) of hexadecanol were added to 20.8 g (0.0705 mol) of sodium 3,5-dimethyloxycarbonylbenzenesulfonate, and the mixture was heated for 19 hours while heating, refluxing, and distilling away the vaporizable component. After 500 ml of ethyl acetate was added thereto, the mixture was poured into 500 ml of water, and the precipitate was filtered off. The precipitate was then washed with acetonitrile and isopropanol to obtain a white solid containing sodium 3,5-dihexadecyloxycarbonylbenzenesulfonate. (Yield: 55 g, m.p.: 85°-95° C.)

ii) Synthesis of 3,5-dihexadecyloxycarbonylbenzenesulfonyl chloride 220 ml of ethyl acetate and 22 ml of DMAC were added to 36.6 g of the white solid containing sodium 3,5-dihexadecyloxycarbonylbenzenesulfonate. 28.1 ml (0.306 mol) of phosphorus oxychloride was added dropwise thereto over 14 minutes while heated to 40° C. and stirring, and the mixture was further stirred for 3 hours and 30 minutes at 40° C. and for 2 hours at 55° C. The reaction mixture was poured into 300 ml of ice water with stirring, and was twice extracted with 1 l of chloroform, followed by drying with Glauber's salt. After filtering off Glauber's salt, the solution was concentrated under reduced pressure. The residue thus obtained was recrystallized from chloroform/acetonitrile to obtain a white solid containing 3,5-dihexadecyloxycarbonylbenzenesulfonyl chloride. (Yield: 31.0 g, m.p.: 48°-50° C.)

iii) Synthesis of 3,5-dihexadecyloxycarbonylbenzenesulfinic acid (Compound III-25)

87 ml of water and 18.2 ml (0.218 mol) of 12N-HCl were added to the solution of 87 ml of chloroform and 8.65 g (0.0121 mol) of the white solid containing 3,5-dihexadecyloxycarbonylbenzenesulfonyl chloride, and then 7.93 g of zinc was added thereto at 5° C. followed by stirring for 4 hours and 30 minutes. After the insoluble component was removed therefrom, the solution was extracted with 100 ml of chloroform, washed with saturated brine, and dried with Glauber's salt. After removing Glauber's salt, the solution was concentrated under reduced pressure, and the residue was recrystallized from hot hexane to obtain a colorless crystal of 3,5-dihexadecyloxycarbonylbenzenesulfinic acid. (Yield: 4.43 g, 48% (based on sodium 3,5-dimethyloxycarbonylbenzenesulfonate), m.p.: 63°-65° C.)

Synthesis Example 7 (Synthesis of Compound III-24)

The same procedures of Synthesis Example 6 were repeated, and 500 ml of a saturated aqueous solution of sodium carbonate was added to the thus obtained 300 ml of a chloroform solution of Compound (III-24). The precipitate was collected and washed with water to obtain a colorless crystal of sodium 3,5-dihexadecyloxycarbonylbenzenesulfinate. (Yield: 32% (based on sodium 3,5-dihexadecyloxycarbonylbenzenesulfonate), m.p.: 229°-231° C.)

Synthesis Example 8 (Synthesis of Compound III-39)

i) Synthesis of 3,5-dihexadecyloxycarbonylbenzenesulfonyl hydrazide

A solution of 26 ml of chloroform and 5.20 g of a white solid containing 3,5-dihexadecyloxycarbonylbenzenesulfonyl chloride was added dropwise to 2.28 g (0.0364 mol) of 80% hydrazine hydrate, followed by stirring for 2 hours. Then, 200 ml of ethyl acetate was added thereto, and the mixture was washed with saturated brine and dried with Glauber's salt. After removing Glauber's salt, the solution was concentrated under reduced pressure, and the residue was recrystallized from hot ethyl acetate to obtain a white solid containing 3,5-dihexadecyloxycarbonylbenzenesulfonyl hydrazide. (Yield: 3.66 g, m.p.: 83° -88° C.)

ii) Synthesis of cyclohexane 2-(3,5-bis(hexadecyloxycarbonyl)-benzenesulfonyl)hydrazone 100 ml of methanol and 0.81 mol (0.00780 mol) of cyclohexanone were added to 5.03 g (0.00709 mol) of 3,5-dihexadecyloxycarbonylbenzenesulfonyl hydrazide, and the mixture was stirred for 1 hour and 30 minutes while heating and refluxing, followed by cooled to room temperature. The precipitate was collected and recrystallized from a mixed solvent (hexane/ethyl acetate:50/1) to obtain a white solid containing Compound (III-39). (Yield: 3.22 g, m.p.: 87°-88° C.)

Synthesis Example 9 (Synthesis of Compound III-45)

5 ml of dimethylacetamide and 15 ml of ethyl acetate were added to 1.0 g of 3,5-dihexadecyloxycarbonylbenzenesulfonyl hydrazide, and 1.01 g of crystals of 3,5-dihexadecyloxycarbonylbenzenesulfonyl chloride was further added thereto while stirring. After stirring for 30 minutes at room temperature, 0.2 ml of pyridine was added dropwise thereto, and stirred further for 5 hours. After the completion of reaction, the reaction mixture was poured into 100 ml of water, and crystals thus-precipitated was collected and dried. The crystals were purified with a silica gel column chromatography to obtain crystals of Compound (III-45). (Yield: 0.4 g (20.5%), m.p.: 148°-150° C.)

The hydrophilic colloid layer which the compound according to the present invention described above can be incorporated into means at least one layer selected from light-insensitive layers such as an interlayer, an ultraviolet light absorbing layer, a protective layer, etc. and light-sensitive layers such as a blue-sensitive layer, a green-sensitive layer and a red-sensitive layer. The compound is preferably incorporated into a green-sensitive layer. The compound may be incorporated into the layer which the water-insoluble and organic solvent soluble polymer employed in the present invention can be incorporated into or into the different layer therefrom.

The preservability improving compound for use in the present invention which has low molecular weight or is easily soluble in water may be added to a processing solution and carried over in a color photographic material during the step of development processing of the color photographic material. However, it is preferred to incorporate the compound into a color photographic material during the step of producing the color photographic material. In the latter case, the compound is usually dissolved in a high-boiling solvent (an oil) having a boiling point of at least 170° C. at atmospheric pressure or a low-boiling solvent, or a mixture of the above described oil and low-boiling solvent, and the solution is dispersed by emulsification in an aqueous solution of a hydrophilic colloid such as gelatin. The compound for use in the present invention described above is preferably soluble in the high-boiling organic solvent. There is no particular restriction on the particle size of the emulsified dispersion particles of the compound but the particle size is preferably from 0.05 μm to 0.5 μm, particularly preferably from 0.1 μm to 0.3 μm. Further, it is particularly preferred that the compound for use in the present invention is co-emulsified with coupler(s) to achieve the effects of the present invention.

The content of the above described compound for use in the present invention is from $1\times10^{-2}$ mol to 10 mols, preferably from $3\times10^{-2}$ mols to 5 mols per mol of the coupler in the same layer.

The compound according to the present invention described above can be used in combination with a yellow coupler, a magenta coupler, or a cyan coupler.

The coupler which is used in combination with the above described compound may be 4-equivalent or 2-equivalent for silver ion, and also may be in the form of a polymer or an oligomer. Furthermore, the couplers which are used in combination with the above described compound according to the present invention may be used singly or as a mixture of two or more kinds thereof.

Couplers which can be preferably used in the present invention include those represented by the following general formula (IV), (V), (VI), (VII) and (VIII):

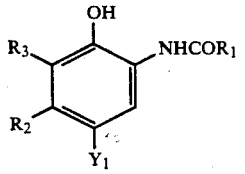
(IV)

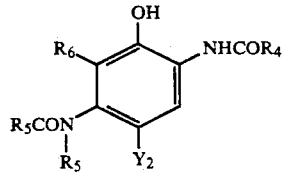
(V)

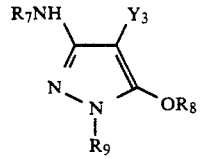
(VI)

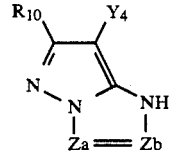
(VII)

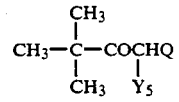
(VIII)

wherein, $R_1$, $R_4$, and $R_5$, which may be the same or different, each represents an aliphatic group, an aromatic group, a heterocyclic group, an aromatic amino group or a heterocyclic amino group; $R_2$ represents an aliphatic group; $R_3$ and $R_6$, which may be the same or different, each represents hydrogen, a halogen atom, an aliphatic group, an aliphatic oxy group, or an acylamino group; $R_5'$ represents hydrogen, or a group represented by $R_5$ defined above; $R_7$ and $R_9$, which may be the same or different, each represents a substituted or unsubstituted phenyl group; $R_8$ represents hydrogen, an aliphatic acyl group, an aromatic acyl group, an aliphatic sulfonyl group, or an aromatic sulfonyl group; $R_{10}$ represents hydrogen or a substituent; Q represents a substituted or unsubstituted N-phenyl-carbamoyl group; Za and Zb each represents a methine group, a substituted methine group, or =N—; and $Y_1$, $Y_2$, $Y_3$, $Y_4$, and $Y_5$, and $R_5$, which may be the same or different, each represents hydrogen, or a group capable of being cleaved by a coupling reaction with the oxidation product of a color developing agent (hereinafter, the group is referred to as a "releasing group").

In the general formulae (IV) and (V) described above, $R_2$ and $R_3$ or $R_5$ and $R_6$ may be linked to form a 5-membered, 6-membered, or 7-membered ring.

Furthermore, the coupler represented by the above described formula may form a dimer or a higher polymer through $R_1$, $R_2$, $R_3$ or $Y_1$; $R_4$, $R_5$, $R_6$ or $Y_2$; $R_7$, $R_8$, $R_9$ or $Y_3$; $R_{10}$, Za, Zb or $Y_4$; or Q or $Y_5$.

The aliphatic group described above is a straight chain, branched chain or cyclic alkyl, alkenyl, or alkinyl group.

Suitable examples of the phenol type cyan couplers represented by the general formula (IV) include those having an acylamino group at the 2-position of the phenol nucleus and an alkyl group at the 5-position thereof (including polymer couplers).as described, for example, in U.S. Pat. Nos. 2,369,929, 4,518,687, 4,511,647 and 3,772,002. Representative specific examples thereof include the coupler described in Example 2 of Canadian Patent 625,822, Compound (1) as described in U.S. Pat. No. 3,772,002, Compounds (I-4) and (I-5) as described in U.S. Pat. No. 4,564,590, Compounds (1), (2), (3) and (24) as described in JP-A-61-39045, and Compound (C-2) as described in JP-A-62-70846.

Suitable examples of the phenol type cyan couplers represented by the general formula (V) include 2,5-diacylamino-substituted phenol type couplers as described, for example, in U.S. Pat. Nos. 2,772,162, 2,895,826, 4,334,011 and 4,500,635, and JP-A-59-164555. Representative specific examples thereof include Compound (V) as described in U.S. Pat. No. 2,895,826, Compound (17) as described in U.S. Pat. No. 4,557,999, Compounds (2) and (12) as described in U.S. Pat. No. 4,565,777, Compound (4) as described in U.S. Pat. No. 4,124,396 and Compound (I-19) as described in U.S. Pat. No. 4,613,564.

Other suitable examples of the phenol type cyan couplers represented by the general formula (V) include those having a nitrogen-containing heterocyclic ring condensed to the phenol nucleus as described, for example, in U.S. Pat. Nos. 4,327,173, 4,564,586 and 4,430,423, JP-A-61-390441 and JP-A-62-257158. Representative specific examples thereof include Couplers (1) and (3) as described in U.S. Pat. No. 4,327,173, Compounds (3) and (16) as described in U.S. Pat. No. 4,564,586, Compounds (1) and (3) as described in U.S. Pat. No. 4,430,423 and the following compounds. p

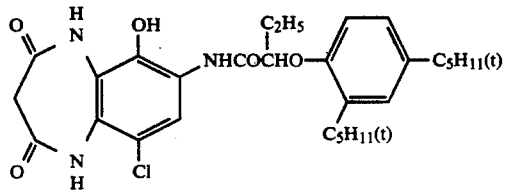

-continued

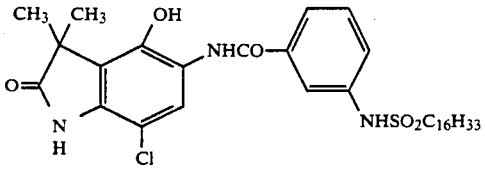

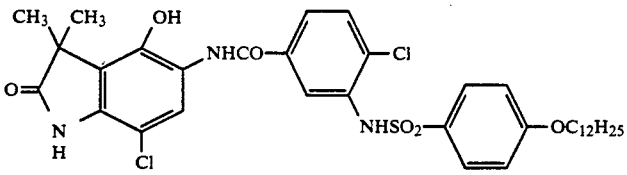

Furthermore, other suitable examples of the phenol type cyan couplers represented by the general formula (IV) or (V) include ureido type couplers as described, for example, in U.S. Pat. Nos. 4,333,999, 4,451,559, 4,444,872, 4,427,767 and 4,579,813 and European Patent 067,689 B1. Representative specific examples thereof include Coupler (7) as described in U.S. Pat. No. 4,333,999, Coupler (1) as described in U.S. Pat. No. 4,451,559, Coupler (14) as described in U.S. Pat. No. 4,444,872, Coupler (3) as described in U.S. Pat. No. 4,427,767, Couplers (6) and (24) as described in U.S. Pat. No. 4,609,619, Couplers (1) and (11) as described in U.S. Pat. No. 4,579,813, Couplers (45) and (50) as described in European Patent 067,689 B1 and Coupler (3) as described in JP-A-61-42658.

Of 5-pyrazolone type couplers represented by the general formula (VI), those substituted with an arylamine group or an acylamino group at the 3-position thereof are preferred in view of hue and color density of dyes formed therefrom. Representative examples thereof are described, for example, in U.S. Pat. Nos. 2,311,082, 2,343,703, 2,600,788, 2,908,573, 3,062,653, 3,152,896 and 3,936,015. In two-equivalent 5-pyrazolone type couplers, nitrogen atom releasing groups as described in U.S. Pat. No. 4,310,619 and arylthio groups as described in U.S. Pat. No. 4,351,897 are preferred as releasing groups. Further, 5-pyrazolone type couplers having a ballast group as described in European Patent 73,636 are advantageous because they provide a high color density.

Of pyrazoloazole type couplers represented by the general formula (VII), imidazo[1,2-b]pyrazoles as described in U.S. Pat. No. 4,500,630 are preferred and pyrazolo[1,5-b][1,2,4]triazoles as described in U.S. Pat. No. 4,540,654 are particularly preferred in view of less yellow subsidiary adsorption and light fastness of dyes formed therefrom.

Further, pyrazolotriazole couplers having a branched alkyl group directly connected to the 2-, 3- or 6-position of the pyrazolotriazole ring as described in JP-A-61-65245, pyrazoloazole couplers having a sulfonamido group as described in JP-A-61-65246, pyrazoloazole couplers having an alkoxyphenylsulfonamido ballast group as described in JP-A-61-147254, and pyrazolotirazole couplers having an alkoxy group at the 6-position thereof as described in EP-A-226849 are also preferably employed.

Specific examples of these pyrazoloazole magenta couplers are set forth below.

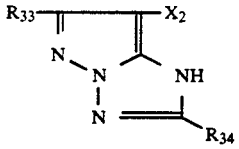

| Compound | $R_{33}$ | $R_{34}$ | $X_2$ |
|---|---|---|---|
| M-1 | $CH_3$— | 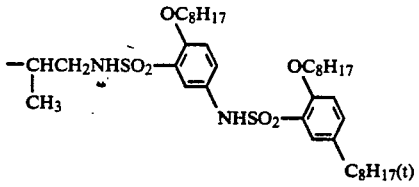 | Cl |
| M-2 | " | 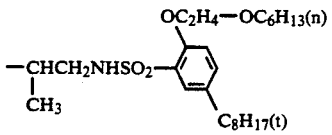 | " |

-continued
| | | | |
|---|---|---|---|
| M-3 | " | 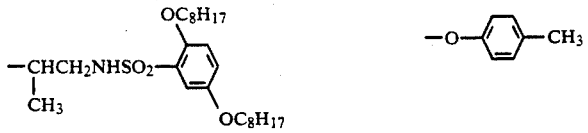 | |
| M-4 | 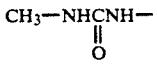 | 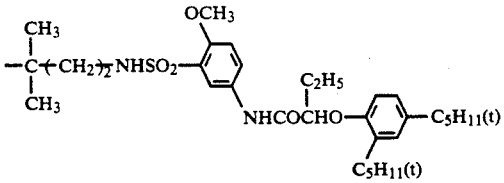 | 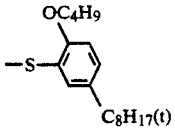 |
| M-5 | $CH_3$— | 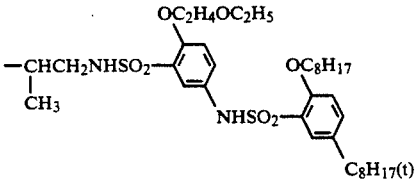 | Cl |
| M-6 | $CH_3$— | 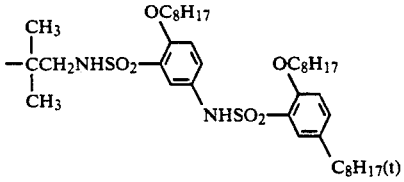 | Cl |
| M-7 | 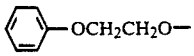 | 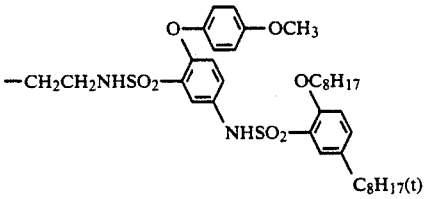 | 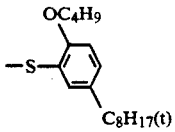 |
| M-8 | $CH_3CH_2O$— | " | " |
| M-9 | 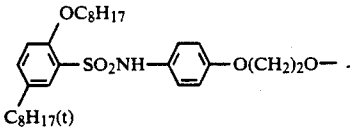 | 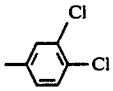 | " |
| M-10 | 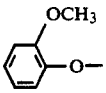 | 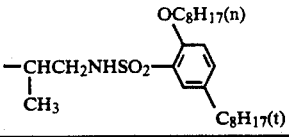 | Cl |
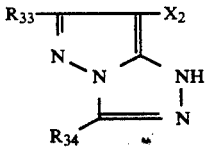
| Compound | $R_{33}$ | $R_{34}$ | $X_2$ |
|---|---|---|---|
| M-11 | $CH_3$— | 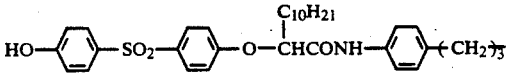 | Cl |
| M-12 | " | 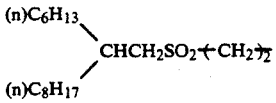 | " |

-continued

| | | | |
|---|---|---|---|
| M-13 | $CH_3$, $CH_3$ CH— | $OC_4H_9$, $SO_2$(CH$_2$)$_3$, $C_8H_{17}$(t) | " |
| M-14 | —(CH—CH$_2$)$_{50}$—(CH$_2$—C)$_{50}$— ; $COOCH_2CH_2OCH_3$ ; $CH_3$, CONH— | $CH_3$—CH—, $CH_2NHSO_2CH_3$ | " |
| M-15 | —O— | $C_8H_{17}$, $(CH_2)_2NHSO_2$—, $C_8H_{17}$(t) | " |
| M-16 | Cl, —O— | " | $OC_4H_9$, —S—, $C_8H_{17}$(t) |

Suitable specific examples of the pivaloyl acetanilide type yellow couplers represented by the general formula (VII) include Compounds (Y-1) to (Y-39) as described in columns 37 to 54 of U.S. Pat. No. 4,622,287. Of these compounds, Compounds (Y-1), (Y-4), (Y-6), (Y-7), (Y-15), (Y-21), (Y-22), (Y-23), (Y-26), (Y-35), (Y-36), (Y-37), (Y-38) and (Y-39) are preferred. Other suitable specific examples include Compounds (Y-1) to (Y-33) as described in columns 19 to 24 of U.S. Pat. No. 4,623,616. Of these compounds, Compounds (Y-2), (Y-7), (Y-8), (Y-12), (Y-20), (Y-21), (Y-23) and (Y-29) are preferred.

In addition, preferred yellow couplers include Compound (34) as described in column 6 of U.S. Pat. No. 3,408,194, Compounds (16) and (19) as described in column 8 of U.S. Pat. No. 3,933,501, Compound (9) as described in columns 7 to 8 of U.S. Pat. No. 4,046,575, Compound (1) as described in columns 5 to 6 of U.S. Pat. No. 4,133,958, Compound 1 as described in column 5 of U.S. Pat. No. 4,401,752, and the following compounds (a) to (g).

$(CH_3)_3C$—C(=O)—CH(X)—C(=O)—NH— ; $R_{22}$ ; Cl

| Compound | $R_{22}$ | X |
|---|---|---|
| a | $CH_3$, —COOCHCOOC$_{12}$H$_{25}$ | N, O=, =O, N—N, $CH_2$— |
| b | $C_4H_9$, —COOCHCOOC$_{12}$H$_{25}$ | " |
| c | —NHCO(CH$_2$)$_3$O—, $C_5H_{11}$(t), $C_5H_{11}$(t) | —O—, $SO_2$—, $OCH_2$— |

-continued

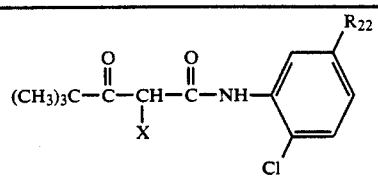

| Compound | $R_{22}$ | X |
|---|---|---|
| d | " | 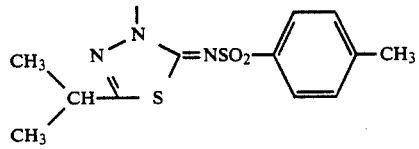 |
| e | " | 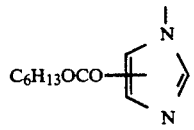 |
| f | $-NHSO_2C_{12}H_{25}$ | 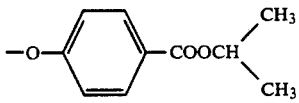 |
| g | $-NHSO_2C_{16}H_{33}$ | 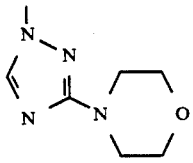 |

The couplers represented by the general formulae (IV) to (VIII) described above can be synthesized by the methods as described in the publications listed below.

The cyan couplers represented by the general formula (IV) or (V) can be synthesized by the following known methods. For example, the cyan couplers represented by the general formula (IV) can be synthesized by the methods described in U.S. Pat. Nos. 2,423,730 and 3,772,002, and the cyan couplers represented by the general formula (V) can be synthesized by the methods described in U.S. Pat. Nos. 2,895,826, 4,333,999 and 4,327,173.

The magenta couplers represented by the general formula (VI) can be synthesized by the methods described in JP-A-49-74027 and JP-A-49-74028, JP-B-48-27930 and JP-B-53-33846, and U.S. Pat. No. 3,519,429. Also the magenta couplers represented by the general formula (VII) can be synthesized by the methods described in JP-A-59-162548, U.S. Pat. No. 3,725,067, JP-A-59-171956 and JP-A-60-33552.

The yellow couplers represented by the general formula (VIII) can be synthesized by the methods described in JP-A-54-48541, JP-B-58-10739, U.S. Pat. No. 4,326,024, and Research Disclosure, No. 18053.

Each of these couplers is generally incorporated into a silver halide emulsion layer in an amount of from $2\times10^{-3}$ mol to $5\times10^{-1}$ mol, and preferably form $1\times10^{-2}$ mol to $5\times10^{-1}$ mol per mol of silver present in the layer.

The compounds according to the present invention may be employed together with known color fading preventing agents. Particularly preferred color fading preventing agents include (i) aromatic compounds represented by the general formula (IX) described below, (ii) amine compounds represented by the general formula (X) described below, and (iii) metal complex containing copper, cobalt, nickel, palladium or platinum as the central metal and having at least one organic ligand having a bidentate or higher conformation.

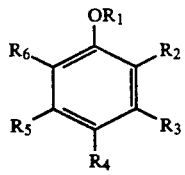

(IX)

wherein $R_1$ represents hydrogen, an alkyl group, an alkenyl group, an aryl group, a heterocyclic group or

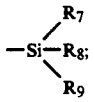

$R_7$, $R_8$ and $R_9$, which may be the same or different, each represents an alkyl group, an alkenyl group, an aryl group, an alkoxy group, an alkenoxy group or an aryloxy group; $R_2$, $R_3$, $R_4$, $R_5$ and $R_6$, which may be the same or different, each represents hydrogen, an alkyl group, an alkenyl group, an aryl group, an acylamino group, an alkylamino group, an alkylthio group, an arylthio group, an alkoxycarbonyl group, an aryloxycarbonyl group, a halogen atom or —O—$R_1'$; $R_1'$ has the same meaning as defined for $R_1$; $R_1$ and $R_2$ may be linked to form a 5-membered ring, 6-membered ring or spiro ring; and $R_2$ and $R_3$ or $R_3$ and $R_4$ may be linked to form a 5-membered ring, 6-membered ring or spiro ring,

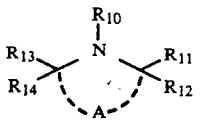

(X)

wherein $R_{10}$ represents hydrogen, an alkyl group, an alkenyl group, an alkinyl group, an acyl group, a sulfonyl group, a sulfinyl group, an oxy-radical group or a hydroxyl group; $R_{11}$, $R_{12}$, $R_{13}$ and $R_{14}$, which may be the same or different, each represents hydrogen or an alkyl group; and A represents a non-metallic atomic group necessary for forming a 5-membered, 6-membered or 7-membered ring.

In formulae (IX) or (X), an alkyl, aryl or heterocyclic moiety included in the substituent may further be substituted with one or more substituents.

Representative specific examples of these compounds include Compound A-1 to A-60 as described in pages 49 to 63 of JP-A-62-92945 and the following compounds.

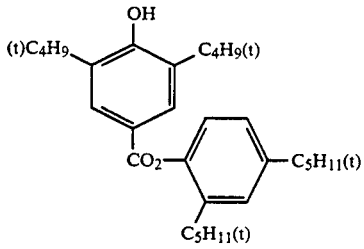

A-61

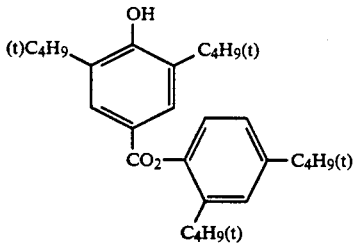

A-62

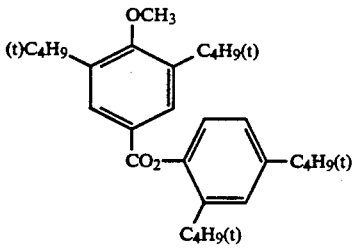

A-63

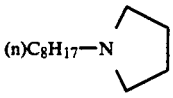

A-64

-continued

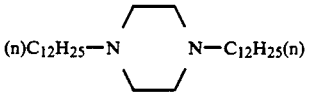

A-65

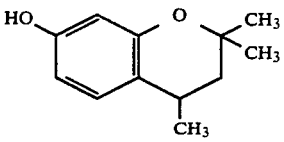

A-66

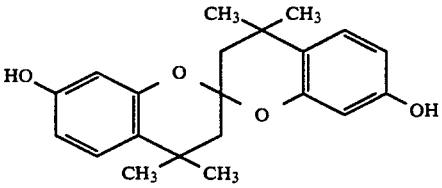

A-67

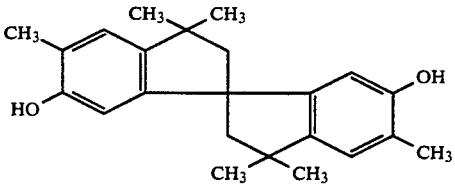

A-68

A specific example of a compound other than the compounds represented by formula (IX) or (X) is set forth below.

$CH_2{=}CH_2OC_{14}H_{29}(n)$ A-69

The compound represented by the general formula (IX) to (X) can be added in a range from 10 mol % to 400 mol %, preferably from 30 mol % to 300 mol % based on the amount of a coupler. The metal complex can be added in a range from 1 mol % to 100 mol %, preferably from 3 mol % to 40 mol % to a coupler.

According to the present invention, the organic synthetic polymer and the preservability improving compound capable of forming a chemical bond with a developing agent or an oxidation product thereof remaining in the photographic material after development processing can be added together in the same layer or separately in different layers. More specifically, the organic synthetic polymer according to the present invention can be added to a silver halide emulsion layer, or a light-insensitive layer such as an intermediate layer, an ultraviolet light absorbing layer or a protective layer. It is preferred to add the polymer to a silver halide emulsion layer, and particularly to incorporate it into oil droplets containing a cyan coupler dispersed in an emulsion layer. On the other hand, the preservability improving compound according to the present invention can be incorporated into any hydrophilic colloid layer described above, and is preferably added to a silver halide emulsion layer containing a magenta coupler.

In the present invention, with respect to a preferred order of the combination of the compounds and couplers, the organic synthetic polymer is preferably employed together with a cyan coupler, a yellow coupler and a magenta coupler in this order, and the preservability improving compound is preferably employed together with a magenta coupler, a cyan coupler and a yellow coupler in this order.

A more preferred combination of the organic synthetic polymer and the cyan coupler is described below. Particularly preferred combinations according to the present invention are combinations of the cyan coupler represented by the general formula (IV) or (V) and the polymer which is composed of a monomer in an amount of 50% or more such that a homopolymer of the monomer shows a Tg of 50° C. or higher, more preferably, combinations of the cyan coupler represented by the general formula (IV) or (V) and the polymer which is composed of a monomer in an amount 70% or more such that a homopolymer of the monomer shows a Tg of 80° C. or higher, and further more preferably, combinations of the cyan coupler represented by the general formula (IV) wherein $R_2$ is an alkyl group having from 2 to 4 carbon atoms, and the polymer which is composed of an acrylamide type and/or methacrylamide type monomer in an amount of 70% or more such that a homopolymer of the monomer shows a Tg of 80° C. or higher.

As the organic solvent having a high boiling point which is employed in the present invention, any compound which has a melting point of 100° C. or lower and a boiling point of 140° C. or higher and which is immiscible with water and a good solvent for a coupler, may be utilized.

Preferred organic solvents having a high boiling point are represented by the following general formula (S-I), (S-II), (S-III), (S-IV), (S-V) or (S-VI):

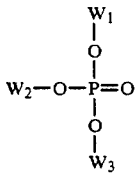
(S-I)

$W_1-COOW_2$ (S-II)

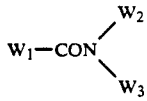
(S-III)

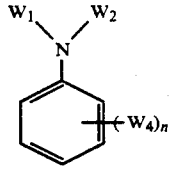
(S-IV)

$W_1-O-W_2$ (S-V)

$HO-W_5$ (S-VI)

wherein $W_1$, $W_2$ and $W_3$, which may be the same or different each represent a substituted or unsubstituted alkyl group, a substituted or unsubstituted cycloalkyl group, a substituted or unsubstituted alkenyl group, a substituted or unsubstituted aryl group or a substituted or unsubstituted heterocyclic group; $W_4$ represents $W_1$, $-O-W_1$ or $-S-W_1$; n is an integer from 1 to 5 and when n is two or more, plural $W_4$ groups may be the same or different; $W_1$ and $W_2$ in the general formula (S-V) may be linked to form a condensed ring; $W_5$ represents a substituted or unsubstituted alkyl group or a substituted or unsubstituted aryl group and the total number of carbon atoms included in $W_5$ is not less than 12.

Specific examples of the organic solvents having a high boiling point which can be used in the present invention are set forth below, but the present invention is not to be construed as being limited thereto.

$O=P(OC_4H_9(n))_3$ (S-1)

$O=P(OCH_2CH_2CH(CH_3)_2)_3$ (S-2)

$O=P(OC_6H_{13}(n))_3$ (S-3)

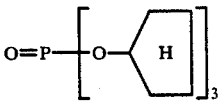
(S-4)

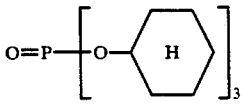
(S-5)

$O=P(OC_8H_{17}(n))_3$ (S-6)

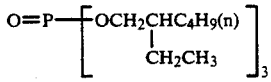
(S-7)

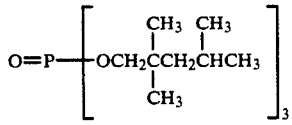
(S-8)

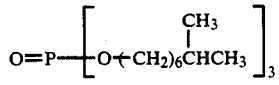
(S-9)

$O=P(OC_9H_{19}(n))_3$ (S-10)

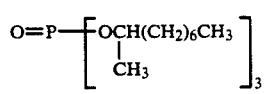
(S-11)

$O=P(OC_{10}H_{21}(n))_3$ (S-12)

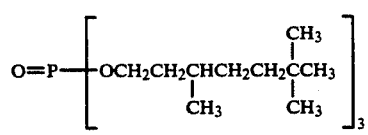
(S-13)

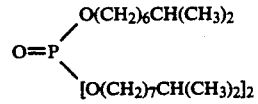
(S-14)

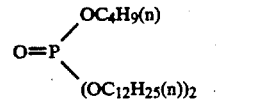
(S-15)

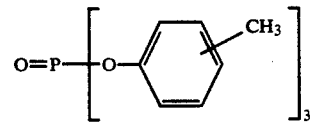
(S-16)

-continued
(S-17)
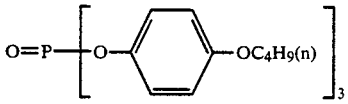
(S-18)
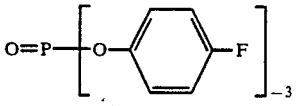
(S-19)
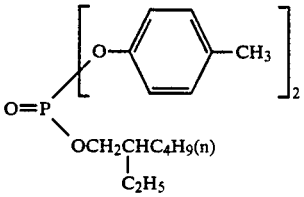
(S-20)
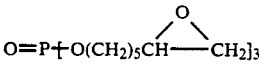
(S-21)
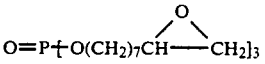
(S-22)
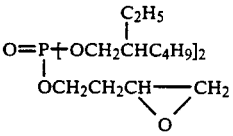
(S-23)
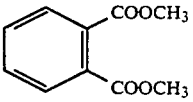
(S-24)
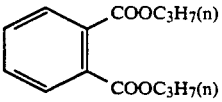
(S-25)
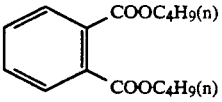
(S-26)
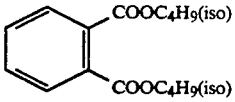
(S-27)
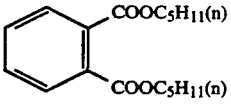
(S-28)
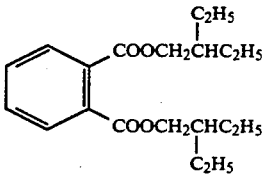
-continued
(S-29)
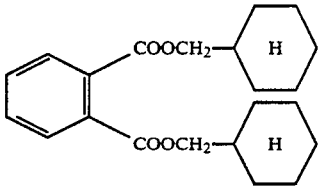
(S-30)
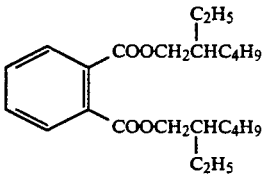
(S-31)
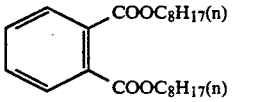
(S-32)
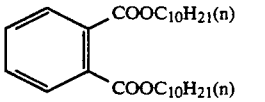
(S-33)
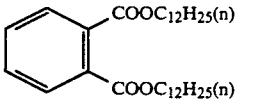
(S-34)
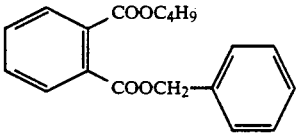
(S-35)
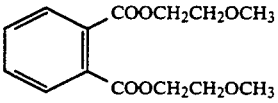
(S-36)
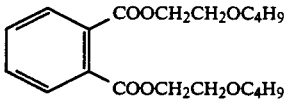
(S-37)
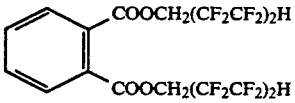
(S-38)
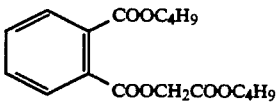
(S-39)
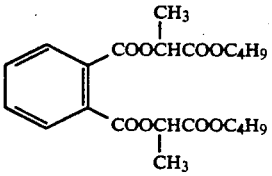

-continued
(S-40)
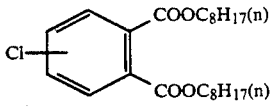
(S-41)
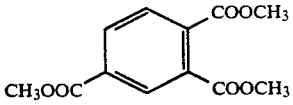
(S-42)
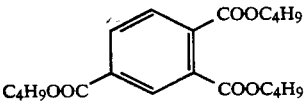
(S-43)
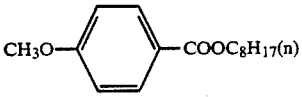
(S-44)
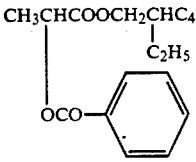
(S-45)
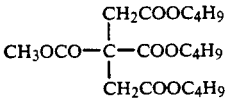
(S-46)
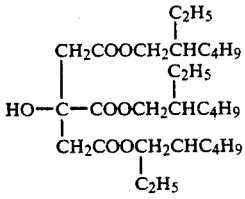
(S-47)
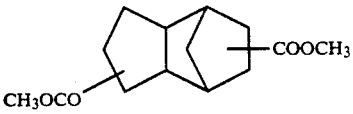
(S-48)
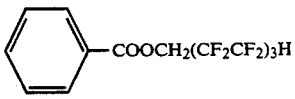
(S-49)
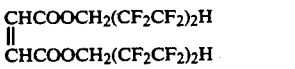
(S-50)
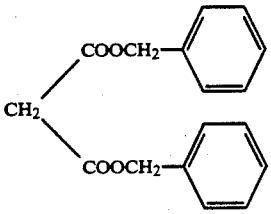
(S-51)
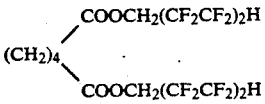
-continued
(S-52)
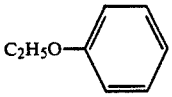
(S-53)
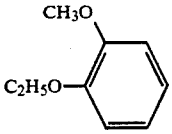
(S-54)
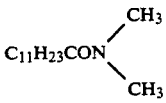
(S-55) $C_{12}H_{25}OH$
(S-56) $C_{16}H_{33}OH$
(S-57) $C_{18}H_{37}OH$
(S-58) $C_{10}H_{21}O(CH_2)_5O(CH_2)_2OH$
(S-59)
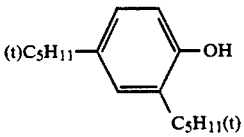
(S-60)
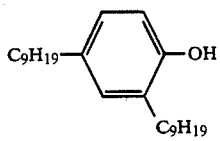
(S-61) $CH_3(CH_2)_{17}Cl$
(S-62) $CH_3(CH_2)_{15}Br$
(S-63)
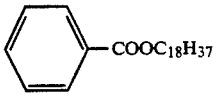
(S-64)
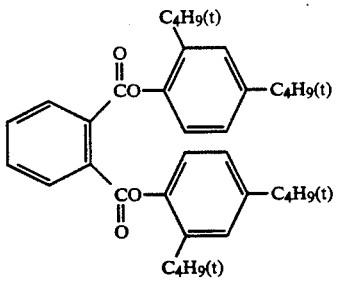
(S-65)
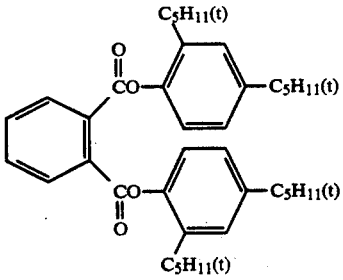
(S-66)
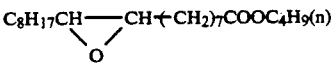

-continued

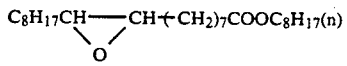

(S-67)

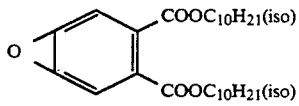

(S-68)

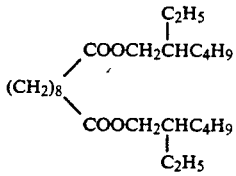

(S-69)

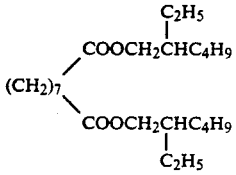

(S-70)

The dispersion containing the organic synthetic polymer, the preservability improving compound capable of forming a chemical bond with an aromatic amine developing agent or an oxidation product thereof, a coupler, and optional additives according to the present invention can be prepared in the following manner.

The polymer according to the present invention which may be synthesized by a solution polymerization method, an emulsion polymerization method, a suspension polymerization method, and is not cross-linked (i.e., a linear polymer), the organic solvent having a high boiling point and the coupler is completely dissolved in an auxiliary organic solvent. The solution is dispersed in water, preferably in an aqueous solution of a hydrophilic colloid, and more preferably in an aqueous solution of gelatin with the assistance of a dispersant using ultrasonic agitation, a colloid mill, to form fine particles. Then, the dispersion is mixed with a silver halide emulsion.

Alternatively, water or an aqueous solution of a hydrophilic colloid such as an aqueous solution of gelatin, is added to an auxiliary organic solvent containing a dispersant such as a surface active agent, the polymer according to the present invention, the organic solvent having a high boiling point and the coupler to prepare an oil-in-water type dispersion accompanied by phase inversion.

Further, the dispersion may be mixed with a photographic emulsion after removing the auxiliary organic solvent therefrom by distillation, noodle washing, ultrafiltration, etc.

The term "auxiliary organic solvent" as used herein means an organic solvent which is useful in forming an emulsified dispersion, which is finally removed substantially from the photographic light-sensitive material during the drying step after coating or by the above-described method, and which is an organic solvent having a low boiling point or a solvent having a certain extent of solubility in water and removable by washing with water.

The auxiliary organic solvents has a boiling point of from about 30° C. to about 140° C. at atmospheric pressure. Specific examples of the auxiliary organic solvents include a lower alkyl acetate such as ethyl acetate, isopropyl acetate, butyl acetate, ethyl propionate, methanol, ethanol, sec-butyl alcohol, cyclohexanol, a fluorinated alcohol, methyl isobutyl ketone, β-ethoxyethyl acetate, methyl cellosolve acetate, acetone, methyl acetone, acetonitrile, dioxane, dimethylformamide, dimethylsulfoxide, chloroform, or cyclohexane.

The color photographic light-sensitive material according to the present invention preferably contains ultraviolet light absorbing agent(s) in the hydrophilic colloid layer. Suitable examples of the ultraviolet light absorbing agents used include aryl group-substituted benzotriazole compounds (for example, those described in U.S. Pat. No. 3,533,794), 4-thiazolidone compounds (for example, those described in U.S. Pat. Nos. 3,314,794 and 3,352,681), benzophenone compounds (for example, those described in JP-A-46-2784), cinnamic acid ester compounds (for example, those described in U.S. Pat. Nos. 3,705,805 and 3,707,375), butadiene compounds (for example, those described in U.S. Pat. No. 4,045,229), and benzoxazole compounds (for example, those described in U.S. Pat. No. 3,700,455). Furthermore, ultraviolet light absorptive couplers (for example, α-naphtholic cyan dye forming couplers) or ultraviolet light absorptive polymers may be used as ultraviolet light absorbing agents. These ultraviolet light absorbing agents may be mordanted in a specific layer.

Preferred ultraviolet light absorbing agents are represented by the following general formula (U-I) or (U-II):

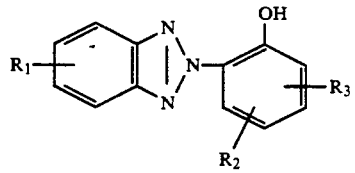

(U-I)

wherein $R_1$, $R_2$ and $R_3$, which may be the same or different, each represents hydrogen, a halogen atom, a nitro group, a hydroxyl group, a substituted or unsubstituted alkyl group, a substituted or unsubstituted alkoxy group, a substituted or unsubstituted aryl group, a substituted or unsubstituted aryloxy group or a substituted or unsubstituted acylamino group.

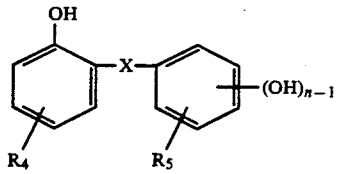

(U-II)

wherein $R_4$ and $R_5$, which may be the same or different, each represents hydrogen, a substituted or unsubstituted alkyl group, a substituted or unsubstituted alkoxy group or a substituted or unsubstituted acyl group; X represents —CO— or —COO—; and n is an integer from 1 to 4.

Specific examples of the compounds represented by the general formula (U-I) or (U-II) are set forth below, but the present invention is not to be construed as being limited thereto.

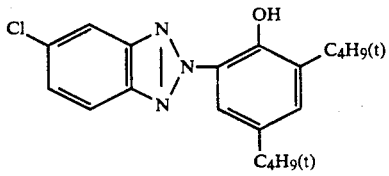
(U-1)

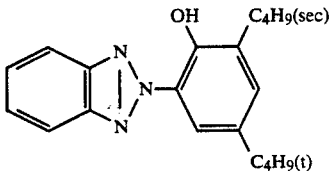
(U-2)

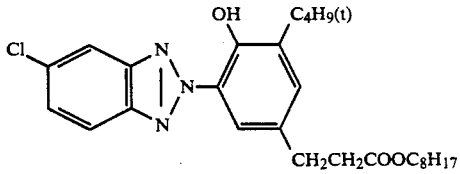
(U-3)

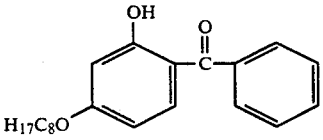
(U-4)

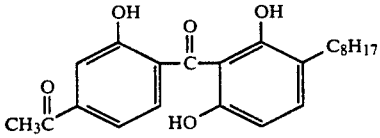
(U-5)

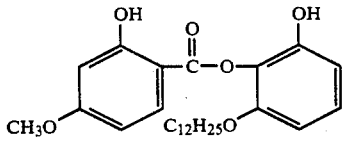
(U-6)

Any silver halide, such as silver chloride, silver iodobromide, silver bromide, silver chlorobromide or silver chloroiodobromide, conventionally used in a silver halide emulsion can be employed in the silver halide emulsion according to the present invention. The silver halide grains may be coarse grains or fine grains. The grain size distribution may be narrow or broad, but it is preferred to use a monodisperse emulsion having a coefficient of variation not more than 15% and more preferably not more than 10%.

The silver halide grains may have a regular crystal structure or an irregular crystal structure, such as a spherical structure, a tabular structure, or a twin structure. Further, any crystal structure having a varied ratio of a [100] plane to a [111] plane may be employed.

The crystal structure of silver halide grains may be uniform throughout the grains, or composed of different layer compositions between the inner portion and the outer portion. Moreover, the silver halide grains may be of surface latent image type in which latent images are formed mainly in the surface portion thereof, or of internal latent image type in which latent images are formed mainly in the interior thereof. Those in which latent images are formed mainly in the interior thereof are particularly advantageously employed for forming direct positive images.

The silver halide emulsions can be those prepared by an acid process, a neutral process and an ammonia process. Further, silver halide grains prepared by a double jet process, a single jet process, a reverse mixing process or a conversion method, can be employed.

It is also possible to use a mixture of two or more kinds of silver halide emulsions which are prepared separately.

Silver halide photographic emulsions containing silver halide grains dispersed in a binder can be subjected to chemical sensitization using a chemical sensitizer. Chemical sensitizers which can be preferably employed in combination in the present invention include noble metal sensitizers, sulfur sensitizers, selenium sensitizers, and reducing sensitizers.

Noble metal sensitizers include gold compounds and ruthenium, rhodium, palladium, iridium, and platinum compounds.

Ammonium thiocyanate or sodium thiocyanate can be employed together with the gold compound.

Sulfur sensitizers include active gelatin and sulfur compounds.

Selenium sensitizers include active or inactive selenium compounds.

Reducing sensitizers include stannous salts, polyamines, bisalkylaminosulfides, silane compounds, iminoaminomethanesulfinic acids, hydrazinium salts, and hydrazine derivatives.

In the color photographic light-sensitive material according to the present invention, it is preferred to appropriately provide a layer such as a protective layer, intermediate layer, a filter layer, an antihalation layer, or a backing layer, in addition to the silver halide emulsion layer.

As the binder or the protective colloid for the photographic emulsion layers or intermediate layers of the color photographic light-sensitive material according to the present invention, gelatin is advantageously used, but other hydrophilic colloids can be used.

For example, it is possible to use proteins such as gelatin derivatives, graft polymers of gelatin and other polymers, albumin, and casein; saccharide derivatives including cellulose derivatives such as hydroxyethyl cellulose carboxymethyl cellulose, cellulose sulfate, sodium alginate, and starch derivatives; and various synthetic hydrophilic high molecular substances such as homopolymers or copolymers, for example, polyvinyl alcohol, polyvinyl alcohol semiacetal, poly-N-vinylpyrrolidone, polyacrylic acid, polymethacrylic acid, polyacrylamide, polyvinylimidazole and polyvinylpyrazole.

As gelatin, not only lime-processed gelatin, but also acid-processed gelatin and enzyme-processed gelatin as described in *Bull. Soc. Sci. Phot. Japan,* No. 16, page 30 (1966) may be used. Further, hydrolyzed products of gelatin or enzymatically decomposed products of gelatin can also be used.

The silver halide emulsion layer and the subsidiary layer of the color photographic light-sensitive material of the present invention can contain various conventional photographic additives. For example, antifogging agents, dye image fading preventing agents, color contamination preventing agents, brightening agents, antistatic agents, hardening agents, surface active agents, plasticizers, wetting agents and ultraviolet light absorbing agents, as described in *Research Disclosure,* Vol. 176, No. 17643, can be appropriately employed.

The silver halide color photographic material of the present invention can be produced by coating one or more constituent layers such as one or more silver halide emulsion layers and one or more subsidiary layers, each containing various photographic additives as described above, if desired, on a support which has been subjected to a corona discharge treatment, a flame treatment or an ultraviolet irradiation treatment, or on a support having a subbing layer or an intermediate layer.

Examples of supports which can be advantageously employed include baryta coated paper, polyethylene coated paper, polypropylene type synthetic paper, a transparent support, for example, a glass plate, a polyester film such as a cellulose triacetate film, a cellulose nitrate film, a polyethylene terephthalate film, a polyamide film, a polycarbonate film, a polystyrene film, a polychlorinated resin, having a reflective layer or having incorporated therein a reflective substance. A suitable support can be selected depending on the purpose for which the photographic light-sensitive material is to be used.

In the present invention, photographic emulsion layers and other constituent layers can be coated on a support or other layers on a support using various conventional coating methods. Examples of such coating methods include the dip coating method, the air doctor coating method, the curtain coating method and the hopper coating method. Further, the coating methods as described in U.S. Pat. Nos. 2,761,791 and 2,941,898, in which two or more layers may be coated at the same time, may be used.

In the present invention, the position of each emulsion layer can be in any order which is appropriate. For example, the layers may be in the order of blue-sensitive emulsion layer, green-sensitive emulsion layer and red-sensitive emulsion layer from the support, or in the order of red-sensitive emulsion layer, green-sensitive emulsion layer and blue-sensitive emulsion layer from the support.

Further, an ultraviolet light absorbing layer may be provided as a support side layer adjacent to an emulsion layer farthest from the support, or, if desired, as a layer adjacent to an emulsion layer farthest from the support and farther than the emulsion layer from the support. In the latter case, it is particularly preferred to provide a layer substantially containing only gelatin as the uppermost layer.

A color developing solution which can be used in development processing of the color photographic light-sensitive material according to the present invention is an alkaline aqueous solution containing preferably an aromatic primary amine color developing agent as a main component. As the color developing agent, while an aminophenol type compound is useful, a p-phenylenediamine type compound is preferably employed. Typical examples of the p-phenylenediamine type compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl 4-amino-N-ethyl-N-β-methoxyethylaniline, or a sulfate, hydrochloride, p-toluenesulfonate thereof.

Two or more color developing agents may be employed in a combination thereof, depending on the purpose.

The color developing solution can ordinarily contain pH buffering agents, such as carbonates, borates or phosphates of alkali metals; and development inhibitors or anti-fogging agents such as bromides, iodides, benzimidazoles, benzothiazoles, or mercapto compounds. Further, if necessary, the color developing solution may contain various preservatives, such as hydroxylamine, diethylhydroxylamine, sulfites, hydrazines, phenylsemicarbazides, triethanolamine, catechol sulfonic acids, triethylenediamine(1,4-diazabi-cyclo[2,2,2]octane); organic solvents such as ethylene glycol, diethylene glycol; development accelerators such as benzyl alcohol, polyethylene glycol, quarternary ammonium salts, amines; dye forming couplers; competing couplers; fogging agents such as sodium borohydride; auxiliary developing agents such as 1-phenyl-3-pyrazolidone; viscosity imparting agents; and various chelating agents represented by aminopolycarboxylic acids, aminopolyphosphonic acids, alkylphosphonic acids and phosphonocarboxylic acids. Representative examples of the chelating agents include ethylenediaminetetraacetic acid, nitrilotriacetic acid, diethylenetriaminepentaacetic acid, cyclohexanediaminetetraacetic acid, hydroxyethyl iminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di-(o-hydorxyphenylacetic acid), and salts thereof.

Of the above described development accelerators, it is preferred to employ as small an amount of benzyl alcohol as possible in view of prevention of environmental pollution and poor color formation. It is most preferred not to employ benzyl alcohol.

In case of conducting reversal processing, color development is usually conducted after black-and-white development. In a black-and-white developing solution, known black-and-white developing agents, for example, dihydroxybenzenes such as hydroquinone, 3-pyrazolidones such as 1-phenyl-3-pyrazoldione, or aminophenols such as N-methyl-p-aminophenol, may be employed individually or in a combination.

Further, direct positive images can be obtained using the above described internal latent image type silver halide emulsion without conducting reversal processing. In such a case, fogging treatment is performed using light or a nucleating agent before or simultaneously with color development.

The pH of the color developing solution or the black-and-white developing solution is usually in a range from 9 to 12. Further, the amount of replenishment for the developing solution can be varied depending on color photographic light-sensitive materials to be processed, but is generally not more than 3 liters per square meter of the photographic light-sensitive material. The amount of replenishment can be reduced to not more than 500 ml by decreasing the bromide ion concentration in the replenisher. In the case of reducing the amount of replenishment, it is preferred to prevent evaporation and aerial oxidation of the processing solution by means of reducing the area of a processing tank which is contact with the air. Further, the amount of replenishment can be reduced by limiting the accumulation of bromide ions in the developing solution.

After color development, the photographic emulsion layers are usually subjected to a bleach processing. The bleach processing can be performed simultaneously with a fix processing (bleach-fix processing), or it can be performed independently from the fix processing. Further, for the purpose of rapid processing, a processing method wherein after a bleach processing a bleach-fix processing is conducted may be employed. Moreover, it may be appropriate depending on the purpose to process using a continuous two tank bleach-fixing bath, to carry out fix processing before bleach-fix processing, or to conduct bleach processing after bleach-fix processing.

Examples of bleaching agents which can be employed in the bleach processing or bleach-fix processing include compounds of a multivalent metal such as iron(III), cobalt(III), chromium(VI), copper(II); peracids; quinones; or nitro compounds. Representative examples of the bleaching agents include ferricyanides; dichloromates; organic complex salts of iron(III) or cobalt(III), for example, complex salts of aminopolycarboxylic acids (such as ethylenediamine-tetraacetic acid, diethylenetriaminepentaacetic acid, cyclohexanediaminetetraacetic acid, methyliminodiacetic acid, 1,3-diaminopropanetetraacetic acid, glycol ether diaminetetraacetic acid), or complex salts of organic acids (such as citric acid, tartaric acid, malic acid); persulfates; bromates; permanganates; or nitrobenzenes. Of these compounds, iron(III) complex salts of aminopolycarboxylic acids represented by an iron(III) complex salt of ethylenediaminetetraacetic acid and persulfates are preferred in view of rapid processing and less environmental pollution. Furthermore, iron(III) complex salts of aminopolycarboxylic acids are particularly useful in both bleaching solutions and bleach-fixing solutions.

The pH of the bleaching solution or bleach-fixing solution containing an iron(III) complex salt of a aminopolycarboxylic acid is usually in a range from 5.5 to 8. For the purpose of rapid processing, it is possible to process at pH lower than the above described range.

In the bleaching solution, the bleach-fixing solution or a prebath thereof, a bleach accelerating agent can be used, if desired. Specific examples of suitable bleach accelerating agents include compounds having a mercapto group or a disulfide bond as described in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-10423, JP-A-53-124424, JP-A-53-141623, JP-A-53-28426, and *Research Disclosure,* No. 17129 (July 1978); thiazolidine derivatives as described in JP-A-50-140129; thiourea derivatives as described in JP-B-45-8506, JP-A-52-20832, JP-A-53-32735, and U.S. Pat. No. 3,706,561; iodides as described in West German Patent 1,127,715, and JP-A-58-16235; polyoxyethylene compounds as described in West German Patents 966,410 and 2,748,430; polyamine compounds as described in JP-B-45-8836; other compounds as described in JP-A-49-42434, JP-A-49-59644, JP-A-53-94927, JP-A-54-35727, JP-A-55-26506, and JP-A-58-163940; and bromide ions. Of these compounds, the compounds having a mercapto group or a disulfide bond are preferred in view of their large bleach accelerating effects. Particularly, the compounds as described in U.S. Pat. No. 3,893,858, West German Patent 1,290,812 and JP-A-53-95630 are preferred. Further, the compounds described in U.S. Pat. No. 4,552,834 are also preferred. These bleach accelerating agents may be incorporated into the color photographic light-sensitive material.

Fixing agents which can be employed in the fixing solution or bleach-fixing solution include thiosulfates, thiocyanate, thioether compounds, thioureas, a large amount of iodide. Of these compounds, thiosulfates are generally employed. Particularly, ammonium thiosulfate is most widely employed. It is preferred to use sulfites, bisulfites or carbonylbisulfite adducts as preservatives in the bleach-fixing solution.

After a desilvering step, the silver halide color photographic material according to the present invention is generally subjected to a water washing step and/or a stabilizing step.

The amount of water required for the water washing step may be set in a wide range depending on the characteristics of photographic light-sensitive materials (due to elements used therein, for example, couplers), uses thereof, the temperature of washing water, the number of water washing tanks (stages), the replenishment system such as countercurrent or orderly current, or other various conditions. The relationship between the number of water washing tanks and the amount of water in a multistage countercurrent system can be determined based on the method described in *Journal of the Society of Motion Picture and Television Engineers,* Vol. 64, pages 248 to 253 (May, 1955).

According to the multi-stage countercurrent system described in the above publication, the amount of water for washing can be significantly reduced. However, the increase in standing time of water in a tank causes propagation of bacteria, and problems such as adhesion of floatage formed on the photographic materials occur. In the method of processing the silver halide color photographic material according to the present invention, a method for reducing amounts of calcium ions and magnesium ions as described in JP-A-62-288508 can be particularly effectively employed in order to solve such problems. Further, sterilizers, for example, isothiazolone compounds described in JP-A-57-8542, thiabendazoles, chlorine type sterilizers such as sodium chloroisocyanurate, benzotriazoles, sterilizers described in Hiroshi Horiguchi, Bokin-Bodai No Kagaku, Biseibutsu No Mekkin-, Sakkin-, Bobai-Gijutsu, edited by Eiseigijutsu Kai, Bokin-Bobaizai Jiten, edited by Nippon Bokin-Bobai Gakkai, can be employed.

The pH of the washing water used in the processing the present invention is usually from 4 to 9, preferably from 5 to 8. The temperature of the washing water and time for the water washing step can be variously set depending on the characteristics or uses of photographic light-sensitive materials. However, it is typical to select a range of from 15° C. to 45° C. and a period from 20 sec. to 10 min. and preferably a range of from 25° C. to 40° C. and a period from 30 sec. to 5 min.

The photographic light-sensitive material of the present invention can also be directly processed with a stabilizing solution in place of the above-described water washing step. In such a stabilizing process, any known methods as described in JP-A-57-8543, JP-A-58-14834 and JP-A-60-220345 can be employed.

Further, it is possible to conduct the stabilizing process subsequent to the above-described water washing process.

Overflow solutions resulting from replenishment for the above-described washing water and/or stabilizing solution may be reused in other steps such as a desilvering step.

For the purpose of simplification and acceleration of processing, a color developing agent may be incorporated into the silver halide color photographic material according to the present invention. In order to incorporate the color developing agent, it is preferred to employ various precursors of color developing agents. Suitable examples of the precursors of developing agents include indoaniline type compounds as described in U.S. Pat. Nos. 3,342,597, Schiff's base type compounds as described in U.S. Pat. No. 3,342,599 and *Research Disclosure,* Vol. 148, No. 14850 and ibid., Vol. 151, No. 15159, aldol compounds as described in *Research Disclosure,* No. 13924, metal salt complexes as described in U.S. Pat. No. 3,719,492, and urethane type compounds as described in JP-A-53-135628.

Further, the silver halide color photographic material according to the present invention may contain, if desired, various 1-phenyl-3-pyrazolidones for the purpose of accelerating color development. Typical examples of the compounds include those as described in JP-A-56-64339, JP-A-57-14454, and JP-A-58-115438.

In the present invention, various processing solutions can be employed in a temperature range from 10° C. to 50° C. Although a standard temperature is from 33° C. to 38° C., it is possible to carry out the processing at higher temperatures in order to accelerate the processing whereby the processing time is shortened, or at lower temperatures in order to achieve improvement in image quality and to maintain stability of the processing solutions.

Further, for the purpose of saving the amount of silver employed in the color photographic light-sensitive material, the photographic processing may be conducted utilizing color intensification using cobalt or hydrogen peroxide as described in West German Patent 2,226,770 or U.S. Pat. No. 3,674,499.

The present invention is now explained in greater detail with reference to the following examples, but the present invention is not to be construed as being limited thereto. Unless otherwise indicated, all parts, percents and ratios are by weight.

EXAMPLE 1

On a paper support, both surfaces of which were laminated with polyethylene, were coated layers as shown in Table 1 below in order to prepare a multilayer color printing paper, which was designated Light-Sensitive Material C. The coating solutions used were prepared in the following manner.

Preparation of the Coating Solution for the First Layer 19.1 g of Yellow Coupler (a) and 4.4 g of Color Image Stabilizer (b) were dissolved in a mixture of 27.2 ml of ethyl acetate and 10.9 ml of Solvent (c) and the resulting solution was added to 185 ml of a 10% aqueous solution of gelatin containing 16 ml of a 10% aqueous solution of sodium dodecylbenzenesulfonate. The mixture was emulsified and dispersed using a homogenizer to obtain an emulsified dispersion. Separately, to a silver chlorobromide emulsion (having a bromide content of 80 mol % and containing 70 g of silver per kg of the emulsion) was added $7.0\times10^{-4}$ mol of a blue-sensitive sensitizing dye shown below per mol of the silver chlorobromide to prepare a blue-sensitive emulsion. The above-described dispersion was mixed with 90 g of the blue-sensitive silver chlorobromide emulsion, with the concentration of the resulting mixture being controlled with gelatin, to form the composition shown in Table 1 below, i.e., the coating solution for the first layer.

Coating solutions for the second layer to the seventh layer were prepared in a similar manner as described for the coating solution for the first layer.

To each layer was added 1-oxy-3,5-dichloro-s-traizine sodium salt as a gelatin hardener.

The following spectral sensitizers were used in the emulsion layers, respectively.

Blue-Sensitive Emulsion Layer:

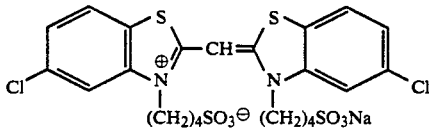

(amount added: $7.0\times10^{-4}$ mol per mol of silver halide)

Green-Sensitive Emulsion Layer:

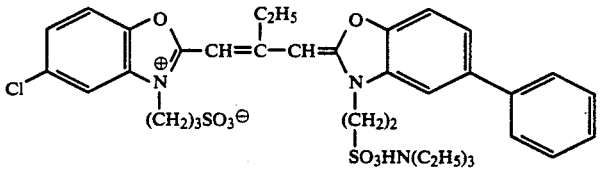

(amount added: $4.0\times10^{-4}$ mol per mol of silver halide)

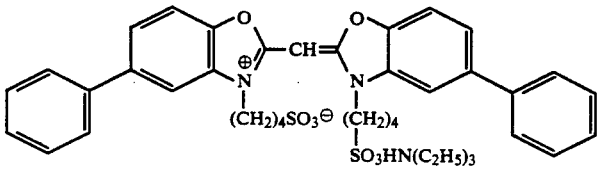

(amount added: $7.0\times10^{-4}$ mol per mol of silver halide)

Red-Sensitive Emulsion Layer:

-continued

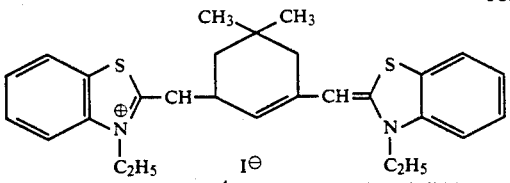

(amount added: $1.0 \times 10^{-4}$ mol per mol of silver halide)

The following dyes were employed as irradiation preventing dyes in the emulsion layers, respectively.

Green-Sensitive Emulsion Layer:

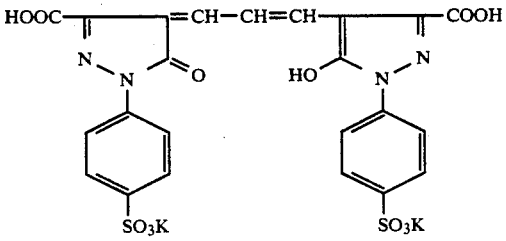

Red-Sensitive Emulsion Layer:

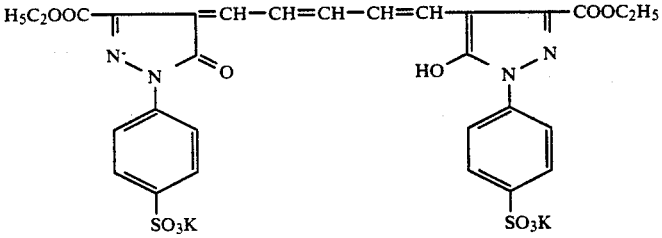

The compounds used in this examples had the structures shown below.

Yellow Coupler (a):
Yellow Coupler (Y-1)

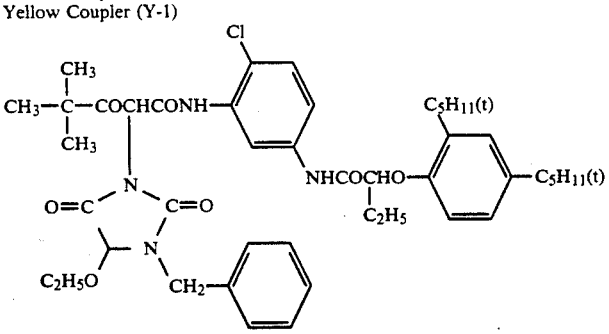

Color image Stabilizer (b):

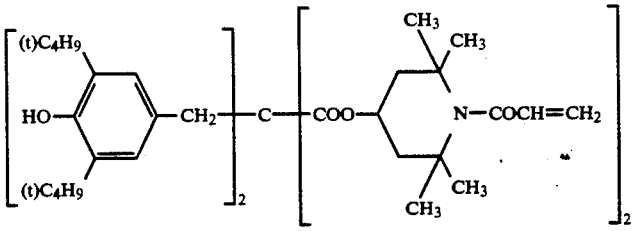

Solvent (c):

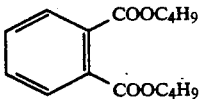

Color Mixing Preventing Agent (d):

-continued
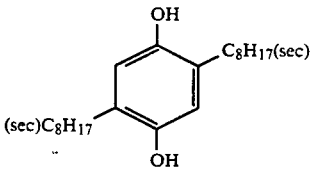
Magenta Coupler (e):
Magenta Coupler (M-5)
Color Image Stabilizer (f):
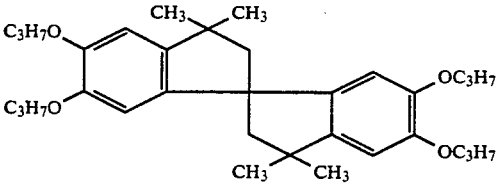
Solvent (g):
A mixture of $(C_8H_{17}H)_3P{=}O$ and (
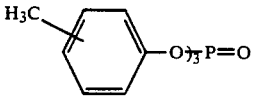
in a weight ratio of 2:1
Ultraviolet Light Absorbing Agent (h):
A mixture of
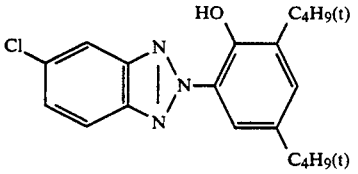
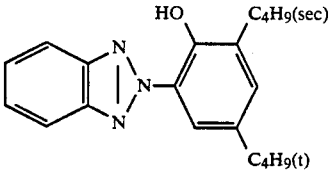
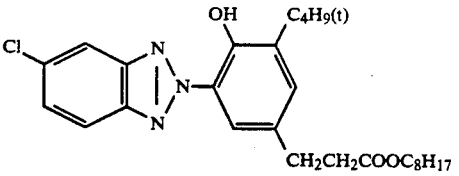
in a molar ratio of 1:5:3, in the respective order listed above.
Color Mixing Preventing Agent (i):
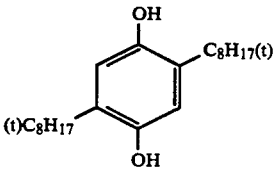
Solvent (j):
$(iso C_9H_{19}O)_3P{=}O$
Cyan Coupler (k):
Cyan Coupler (C-1)

-continued

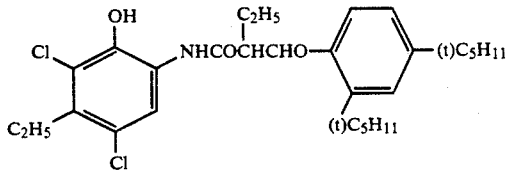

Solvent (l):
Coupler solvent having a high boiling point (S-16)

TABLE 1

| | |
|---|---|
| Seventh Layer: Protective layer | |
| Gelatin | 1.33 g/m$^2$ |
| Acryl-modified polyvinyl alcohol copolymer (degree of modification: 17%) | 0.17 g/m$^2$ |
| Sixth Layer: Ultraviolet Light Absorbing Layer | |
| Gelatin | 0.54 g/m$^2$ |
| Ultraviolet Light Absorbing Agent (h) | 0.21 g/m$^2$ |
| Solvent (j) | 0.09 g/m$^2$ |
| Fifth Layer: Red-Sensitive Layer | |
| Silver chlorobromide emulsion (silver bromide: 70 mol %, cubic grains, average grain diameter: 0.4 μm, coefficient of variation*2: 0.10) | 0.26 g/m$^2$ (as silver) |
| Gelatin | 0.98 g/m$^2$ |
| Cyan Coupler (k) | 0.41 g/m$^2$*1 |
| Solvent (l) | 0.20 g/m$^2$ |
| Fourth Layer: Ultraviolet Light Absorbing Layer | |
| Gelatin | 1.60 g/m$^2$ |
| Ultraviolet Light Absorbing Agent (h) | 0.62 g/m$^2$ |
| Color Mixing Preventing Agent (i) | 0.05 g/m$^2$ |
| Solvent (j) | 0.22 g/m$^2$ |
| Third Layer: Green-Sensitive Layer | |
| Silver chlorobromide emulsion (silver bromide: 75 mol %, cubic grains, average grain diameter: 0.5 μm, coefficient of variation*2: 0.09) | 0.16 g/m$^2$ (as silver) |
| Gelatin | 1.80 g/m$^2$ |
| Magenta Coupler (e) | 0.34 g/m$^2$ |
| Color Image Stabilizer (f) | 0.20 g/m$^2$ |
| Solvent (g) | 0.60 g/m$^2$ |
| Second Layer: Color Mixing Preventing Layer | |
| Gelatin | 0.99 g/m$^2$ |
| Color Mixing Preventing Agent (d) | 0.08 g/cm$^2$ |
| First Layer: Blue-Sensitive Layer | |
| Silver chlorobromide emulsion (silver bromide: 80 mol %, cubic grains, average grain diameter: 1.0 μm, coefficient of variation*2: 0.08) | 0.30 g/m$^2$ (as silver) |
| Gelatin | 1.86 g/m$^2$ |
| Yellow Coupler (a) | 0.82 g/m$^2$ |
| Color Image Stabilizer (b) | 0.19 g/m$^2$ |
| Solvent (c) | 0.47 g/m$^2$ |

Support

Polyethylene laminated paper (the polyethylene coating containing of a white pigment ($TiO_2$) in an amount of 15 wt % based on the weight of polyethylene and a bluish dye (ultramarine) on the first layer side).

*1: 0.80 mmol/m$^2$

*2: The ratio ($s/\bar{d}$) of a statistical standard deviation (s) to average grain diameter ($\bar{d}$).

In the same manner as described for Light-Sensitive Material C above, Sample A was prepared except that the yellow coupler and the magenta coupler were eliminated from the first layer and the third layer. Further, Sample $A_1$ to $A_{33}$ were also prepared in the same manner as the preparation of Sample A, except that the combination of the cyan coupler and the additive including the compound according to the invention as shown in Table 2 below was used. All samples thus-prepared had a layer pH of around 6.

The samples thus prepared were exposed to light through an optical wedge and then processed for color development in accordance with the following processing method, where the developing agent and other processing solution components used were so constituted that they would easily remain in the photographic materials processed to form stains thereon, especially for the purpose of clearly demonstrating the effect of the present invention.

| Processing Step | Temperature | Time |
|---|---|---|
| Color Development | 33° C. | 3 min 30 sec |
| Bleach-fixing | 33° C. | 1 min 30 sec |
| Washing with water | 20 to 25° C. (without stirring) | 1 min |
| Drying | 50 to 80° C. | 2 min |

The processing solutions used had the following compositions, respectively.

| | |
|---|---|
| Color Developing Solution: | |
| 3Na.nitrilotriacetate | 2.0 g |
| Benzyl alcohol | 15 ml |
| Diethylene glycol | 10 ml |
| Diethylenetriaminepentaacetate | 1.0 g |
| Sodium sulfite | 0.2 g |
| Potassium bromide | 0.5 g |
| Hydroxylamine sulfate | 3.0 g |
| 4-Amino-3-methyl-N-ethyl-N-[β-(methanesulfonamido)ethyl]-p-phenylenediamine sulfate | 6.5 g |
| Sodium carbonate (monohydrate) | 30 g |
| Water to make | 1000 ml (pH 10.1) |
| Bleach-fixing Solution: | |
| Above-described color developing solution | 400 ml |
| Ammonium thiosulfate (70 wt %) | 150 ml |
| Sodium sulfite | 12 g |
| Sodium (EDTA)/Iron | 36 g |
| Disodium (EDTA) | 4 g |
| Water to make | 1000 ml |
| 1N Sulfuric acid to make | pH 7.0 |
| This solution was used after being aerated for 1 hour. | |

(Note)
The composition of the bleach-fixing solution was prepared to duplicate conditions in which the color developing solution adhered to the photographic material continuously processed would be introduced in a large amount into the bleach-fixing solution together with the sample processed, and hence the bleach-fixing solution would be fatigued and deteriorated.

After processing, the samples were subjected to the following tests in order to evaluate their light fastness, heat fastness and fastness to combined high humidity and heat. More specifically, each of the samples was stored in a dark place at 100° C. for 5 days, stored in a dark place at 60° C. for 9 months, stored in a dark place at 80° C. and 70% RH for 12 days, stored in a dark place at 60° C. and 70% RH for 3 months, or irradiated to light in a fluorescent lamp fading tester (30,000 lux) for 5 months. Then, the rate of decrease in image density in the area on the photographic material having an initial density of 1.5 was determined wherein an initial density was 1.0 in a light fastness test. The results thus obtained are shown in Table 2 below.

Furthermore, the cyan reflective density in the non-image portion of each sample was measured with red light by a Fuji-type automatic recording densitometer, after the development processing. Further, the magenta reflective density in the non-image portion of each sample was also measured, after the samples were stored at 80° C. and 70% RH for 3 days, or stored at 80° C. and dry conditions (10 to 15% RH) for 5 days. The results thus obtained are also shown in Table 2 below.

TABLE 2

| Sample | Cyan Coupler | Amount Added (mmol/m$^2$) | Polymer | Amount Added (g/m$^2$) | Coupler Solvent having a High Boiling Point | Amount Added (g/m$^2$) | Additive | Amount Added (mol % to Coupler) |
|---|---|---|---|---|---|---|---|---|
| A | C-1 | 0.80 | — | — | S-16 | 0.20 | — | — |
| $A_1$ | " | " | P-21 | 1.0 | " | " | — | — |
| $A_2$ | " | " | " | " | " | " | Comparative Compound A | 30 |
| $A_3$ | " | " | " | " | " | " | Comparative Compound B | " |
| $A_4$ | " | " | " | " | " | " | Comparative Compound C | " |
| $A_5$ | " | " | " | " | " | " | Comparative Compound D | " |
| $A_6$ | " | " | " | " | " | " | I-72 | " |
| $A_7$ | " | " | " | " | " | " | II-1 | 50 |
| $A_8$ | " | " | " | " | " | " | III-1 | 30 |
| $A_9$ | " | " | P-57 | 1.0 | S-25 | " | III-45 | " |
| $A_{10}$ | C-4 | " | — | — | S-16 | " | — | — |
| $A_{11}$ | " | " | P-3 | 1.2 | " | " | — | — |
| $A_{12}$ | " | " | P-57 | 1.2 | " | " | — | — |
| $A_{13}$ | " | " | P-62 | 1.0 | " | " | — | — |
| $A_{14}$ | " | " | — | — | " | " | I-21 | 30 |
| $A_{15}$ | C-4 | 0.80 | P-57 | 1.2 | S-16 | 0.20 | Comparative Compound E | 30 |
| $A_{16}$ | " | " | P-62 | 1.0 | " | " | Comparative Compound F | " |
| $A_{17}$ | " | " | " | " | " | " | I-21 | " |
| $A_{18}$ | " | " | P-57 | 1.2 | " | " | I-38 | " |
| $A_{19}$ | " | " | " | " | " | " | I-47 | " |
| $A_{20}$ | " | " | " | " | " | " | I-49 | " |
| $A_{21}$ | " | " | " | " | S-25 | " | III-1 | " |
| $A_{22}$ | " | " | " | " | " | " | III-26 | " |
| $A_{23}$ | " | " | " | " | " | " | III-34 | " |
| $A_{24}$ | C-2 | " | P-3 | 1.0 | S-16 | " | Comparative Compound G | " |
| $A_{25}$ | " | " | " | " | " | " | Comparative Compound H | " |
| $A_{26}$ | " | " | " | " | " | " | I-5 | " |
| $A_{27}$ | " | " | " | " | " | " | I-41 | " |
| $A_{28}$ | " | " | " | " | " | " | I-65 | " |
| $A_{29}$ | C-3 | " | P-21 | 1.0 | S-16 | " | Comparative Compound A | " |
| $A_{30}$ | C-3 | 0.80 | P-21 | 1.0 | S-16 | 0.20 | Comparative Compound B | 30 |
| $A_{31}$ | " | " | " | " | " | " | I-36 | " |
| $A_{32}$ | " | " | " | " | " | " | III-58 | " |
| $A_{33}$ | " | " | " | " | " | " | I-41/III-1 | 30/30 |

| Sample | Fastness Test: Dark Fading 100° C. 5 Days (%) | Dark Fading 80° C., 70% RH 12 Days (%) | Light Fading Xenon 6 Days (%) | Stain due to Processing Solution: Increase in Cyan Density 80° C. 5 Days | 80° C., 70% RH 3 Days | Remark |
|---|---|---|---|---|---|---|
| A | 29 | 16 | 34 | 0.08 | 0.23 | Comparison |
| $A_1$ | 11 | 7 | 20 | 0.14 | 0.39 | " |
| $A_2$ | 31 | 14 | 29 | 0.14 | 0.37 | " |
| $A_3$ | 13 | 9 | 22 | 0.13 | 0.38 | " |
| $A_4$ | 15 | 11 | 22 | 0.14 | 0.37 | " |
| $A_5$ | 24 | 13 | 26 | 0.12 | 0.36 | " |
| $A_6$ | 11 | 7 | 20 | 0.03 | 0.07 | Invention |
| $A_7$ | 10 | 6 | 19 | 0.04 | 0.06 | " |
| $A_8$ | 10 | 7 | 19 | 0.03 | 0.06 | " |
| $A_9$ | 11 | 6 | 18 | 0.03 | 0.07 | " |
| $A_{10}$ | 36 | 32 | 27 | 0.09 | 0.25 | Comparison |
| $A_{11}$ | 17 | 12 | 14 | 0.16 | 0.38 | " |
| $A_{12}$ | 11 | 10 | 11 | 0.15 | 0.39 | " |
| $A_{13}$ | 10 | 10 | 12 | 0.16 | 0.37 | " |
| $A_{14}$ | 34 | 31 | 26 | 0.02 | 0.06 | " |
| $A_{15}$ | 20 | 21 | 13 | 0.14 | 0.37 | " |

TABLE 2-continued

| | | | | | | |
|---|---|---|---|---|---|---|
| $A_{16}$ | 15 | 16 | 17 | 0.16 | 0.37 | " |
| $A_{17}$ | 10 | 10 | 11 | 0.03 | 0.05 | Invention |
| $A_{18}$ | 10 | 10 | 10 | 0.04 | 0.06 | " |
| $A_{19}$ | 10 | 9 | 11 | 0.04 | 0.05 | " |
| $A_{20}$ | 9 | 10 | 11 | 0.03 | 0.05 | " |
| $A_{21}$ | 10 | 10 | 10 | 0.04 | 0.06 | " |
| $A_{22}$ | 9 | 9 | 11 | 0.03 | 0.07 | " |
| $A_{23}$ | 10 | 9 | 10 | 0.04 | 0.06 | " |
| $A_{24}$ | 13 | 12 | 34 | 0.15 | 0.36 | Comparison |
| $A_{25}$ | 14 | 13 | 35 | 0.14 | 0.36 | " |
| $A_{26}$ | 9 | 8 | 12 | 0.03 | 0.06 | Invention |
| $A_{27}$ | 10 | 9 | 13 | 0.04 | 0.07 | " |
| $A_{28}$ | 8 | 8 | 10 | 0.03 | 0.05 | " |
| $A_{29}$ | 14 | 12 | 16 | 0.13 | 0.32 | Comparison |
| $A_{30}$ | 10 | 8 | 9 | 0.13 | 0.33 | " |
| $A_{31}$ | 6 | 7 | 7 | 0.03 | 0.06 | Invention |
| $A_{32}$ | 7 | 6 | 7 | 0.04 | 0.05 | " |
| $A_{33}$ | 5 | 6 | 6 | 0.01 | 0.02 | " |

(C-2)

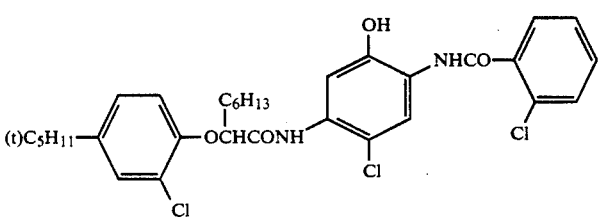

(C-3)

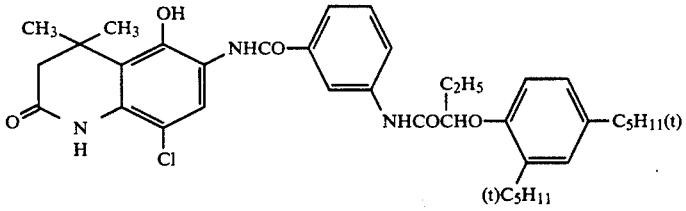

(C-4)

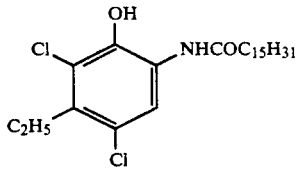

Comparative Compound (A):
Compound described in U.S. Pat. No. 4,483,918

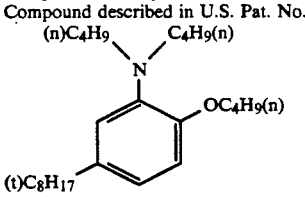

Comparative Compound (B):
Compound described in U.S. Pat. No. 4,463,085

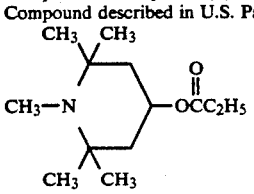

Comparative Compound (C):
Compound described in JP-A-59-218445

-continued

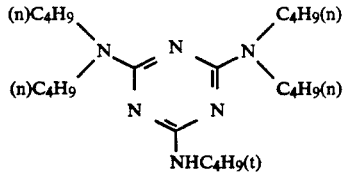

Comparative Compound (D):
Compound described in JP-A-59-229557
$C_{12}H_{25}N(CH_2CH_2OH)_2$ Comparative Compound (E):
Compound described in U.S. Pat. No. 3,930,866

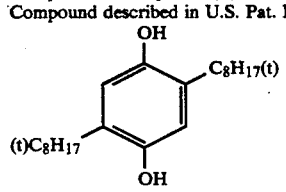

Comparative Compound (F):
Compound described in JP-A-60-222853

-continued

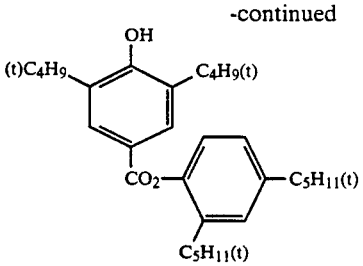

Comparative Compound (G):
Compound described in JP-A-60-222853

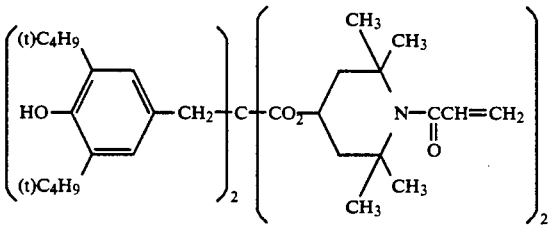

Comparative Compound (H):
Compound described in JP-A-60-222853

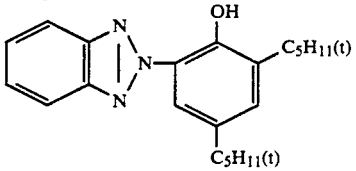

It is apparent from the results shown in Table 2 that when the organic synthetic polymer is employed, the formation of cyan stain after processing increases, although heat fastness and light fastness of cyan image are remarkably improved. It is insufficient to control such cyan stain by means of a combination with known anti-staining agents or color fading preventing agents, and certain compounds thereof even reduce improvement in fastness due to the organic synthetic polymer. On the contrary, when the organic synthetic polymer is used together with the compound capable of forming a chemical bond with a developing agent or an oxidation product thereof according to the present invention, the formation of stain after processing was sufficiently prevented while maintaining the improvement in fastness.

EXAMPLE 2

Sample B was prepared in the same manner as described for Light-Sensitive Material C in Example 1 except that the magenta coupler, the cyan coupler and Color Image Stabilizer (b) were removed from the third layer, the fifth layer and the first layer, respectively. Furthermore, Samples $B_1$ to $B_{19}$ were also prepared in the same manner as the preparation of Sample B, except that the combination of the yellow coupler and the additive including the compound according to the invention as shown in Table 3 below was used. All samples thus-prepared had a layer pH of around 6.

Then, the samples thus prepared were exposed to light through an optical wedge and then processed in accordance with the following process in method (A) or (B) to form color images in the respective samples.

Processing Method (A)

The samples exposed were subjected to running development processing with Fuji Color Roll Processor FMPP 1000 (partly modified) (manufactured by Fuji Photo Film Co., Ltd.) under the conditions described below.

| Step | Time (seconds) | Temperature (°C.) | Tank Capacity (liter) | Amount of Replenisher (ml/m²) |
|---|---|---|---|---|
| Color Development | 45 | 35 | 88 | 150 |
| Bleach-fixing | 45 | 35 | 35 | 50 |
| Rinsing (1) | 20 | 35 | 17 | — |
| Rinsing (2) | 20 | 35 | 17 | — |
| Rinsing (3) | 20 | 35 | 17 | 250 |

The rinsing steps were carried out by means of a three-tank countercurrent system, where a replenisher was supplied into the rinsing tank (3), the solution overflown from the rinsing tank (3) was introduced into the bottom of the rinsing tank (2), the solution overflown from the rinsing tank (2) was introduced into the bottom of the rinsing tank (1), and the solution overflown from the rinsing tank (1) was drained out therefrom. The amount of the processing solution as carried over from the previous bath into the next bath together with the photographic paper being processed in this system was 25 ml per m² of the paper.

The processing solutions used in the tanks and the replenishers had the following compositions respectively.

| | Tank Solution | Replenisher |
|---|---|---|
| Color Developing Solution: | | |
| Water | 800 ml | 800 ml |
| Diethylenetraminepentaacetic acid | 3.0 g | 3.0 g |
| Benzyl alcohol | 15 ml | 17 ml |
| Diethylene glycol | 10 ml | 10 ml |
| Sodium sulfite | 2.0 g | 2.5 g |
| Potassium bromide | 0.5 g | — |
| Sodium carbonate | 30 g | 35 g |
| N-Ethyl-N-(β-methanesulfonamidoethyl)-3-methyl-4-aminoaniline sulfate | 5.0 g | 7.0 g |
| Hydroxylamine sulfate | 4.0 g | 4.5 g |
| Brightening agent | 1.0 g | 1.5 g |
| Water to make | 1000 ml | 1000 ml |
| pH | 10.10 | 10.50 |
| Bleaching-fixing Solution: | | |
| Water | 400 ml | 400 ml |
| Ammonium thiosulfate (70 wt % aq. solu.) | 150 ml | 300 ml |
| Sodium sulfite | 12 g | 25 g |
| Ammonium iron (III) ethylenediaminetetraacetate | 55 g | 110 g |
| 2Na Ethylenediaminetetraacetate | 5 g | 10 g |
| Water to make | 1000 ml | 1000 ml |
| pH (25° C.) | 6.70 | 6.50 |
| Rinsing Solution: | | |
| Ethylenediamine-N,N,N',N'-tetramethylene-phosphonic acid | 0.3 g | |
| Benzotriazole | 1.0 g | |
| Water to make | 1000 ml | |
| Sodium hydroxide to make pH | 7.5 | |

Processing Method (B):

| Step | Time | Temperature (°C.) | Tank Capacity (liter) | Amount of Replenisher (ml/m²) |
|---|---|---|---|---|
| Color Development | 45 sec | 35 | 88 | 150 |
| Bleach-fixation | 2 min 00 sec | 35 | 35 | 350 |
| Rinsing (1) | 1 min 00 sec | 35 | 17 | — |
| Rinsing (2) | 1 min 00 sec | 35 | 17 | — |

-continued

| | | | | |
|---|---|---|---|---|
| Rinsing (3) | 1 min 60 sec | 35 | 17 | 1300 |

The process solutions and the replenishers used were same as those used in Processing Method (A).

Then, the yellow reflective density in the non-image position of each of the samples as processed by the above described processing method was measured one hour after the processing. In addition, after the samples were stored at 80° C. (10 to 15% RH) for 7 days or after the samples were stored at 80° C. (70% RH) for 8 days, the yellow reflective density in the non-image portion, of each sample was also measured. The results thus obtained are shown in the Table 3 below.

TABLE 3

| Sample | Yellow Coupler | Amount Added (mmol/m$^2$) | Polymer | Amount Added (g/m$^2$) | Coupler Solvent having a High Boiling Point | Amount Added (g/m$^2$) | Additive | Amount Added (mol % to Coupler) | Processing Method | Increase in Yellow Density 80° C. 7 Days | Increase in Yellow Density 80° C., 70% RH 8 Days | Remark |
|---|---|---|---|---|---|---|---|---|---|---|---|---|
| B | Y-1 | 1.0 | — | — | S-25 | 0.47 | — | — | A | 0.04 | 0.11 | Comparison |
| B | " | " | — | — | " | " | — | — | B | 0.01 | 0.01 | " |
| $B_1$ | " | " | P-3 | 1.0 | " | " | — | — | A | 0.07 | 0.19 | " |
| $B_2$ | " | " | P-21 | " | " | " | — | — | A | 0.06 | 0.17 | " |
| $B_3$ | " | " | P-57 | " | " | " | — | — | A | 0.08 | 0.18 | " |
| $B_4$ | " | " | P-62 | " | " | " | — | — | A | 0.07 | 0.17 | " |
| $B_5$ | " | " | P-3 | " | " | " | Comparative Compound A | 30 | A | 0.07 | 0.20 | " |
| $B_6$ | " | " | " | " | " | " | Comparative Compound B | " | A | 0.07 | 0.19 | " |
| $B_7$ | " | " | " | " | " | " | Comparative Compound C | " | A | 0.07 | 0.19 | " |
| $B_8$ | " | " | " | " | " | " | Comparative Compound D | " | A | 0.06 | 0.17 | " |
| $B_9$ | " | " | " | " | " | " | I-38 | " | A | 0.01 | 0.03 | Invention |
| $B_{10}$ | " | " | " | " | " | " | I-47 | " | A | 0.01 | 0.03 | " |
| $B_{11}$ | " | " | " | " | " | " | I-72 | " | A | 0.01 | 0.02 | " |
| $B_{12}$ | " | " | " | " | " | " | III-1 | " | A | 0.01 | 0.02 | " |
| $B_{13}$ | " | " | " | " | " | " | III-58 | " | A | 0.01 | 0.03 | " |
| $B_{14}$ | Y-2 | " | — | — | S-64 | " | — | — | A | 0.07 | 0.15 | Comparison |
| $B_{14}$ | " | " | — | — | " | " | — | — | B | 0.01 | 0.08 | " |
| $B_{15}$ | " | " | P-21 | 1.0 | " | " | — | — | A | 0.13 | 0.24 | " |
| $B_{16}$ | " | " | " | " | " | " | I-43 | 30 | A | 0.01 | 0.04 | Invention |
| $B_{17}$ | " | " | " | " | " | " | II-1 | 50 | A | 0.01 | 0.04 | " |
| $B_{18}$ | " | " | " | " | " | " | III-33 | 30 | A | 0.01 | 0.03 | " |
| $B_{19}$ | " | " | " | " | " | " | I-43/III-10 | 30/30 | A | 0.01 | 0.01 | " |

(Y-2)

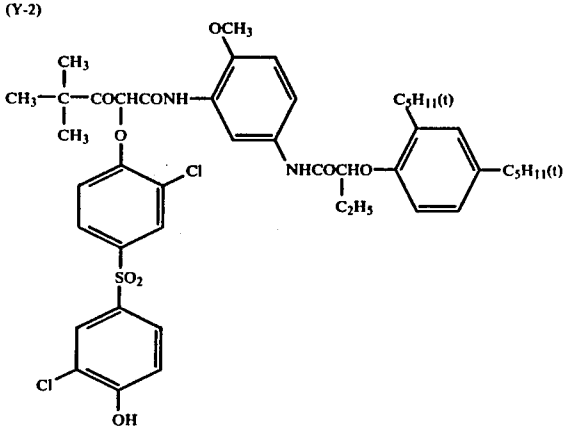

It is apparent from the results shown in Table 3 above that in Processing Method B when the rinsing and bleach-fixing time was long and the amount of the replenisher in the respective processing steps was sufficient, there was no problem of yellow stain in the samples processed, while in Processing Method A where the processing time was short and the amount of replenisher was small, the samples processed had noticeable yellow stain. Further, the occurrence of yellow stain was remarkably increased by the addition of the organic synthetic polymer according to the present invention. On the contrary, the yellow stain was sufficiently prevented by the compound according to the present invention.

EXAMPLE 3

Samples $C_1$ to $C_{14}$ were prepared in the same manner as the preparation of Sample C in Example 1 except that the combination of the magenta coupler and the additive including the compound according to the present invention used in the third layer was changed as shown in Table 4 below.

Furthermore, Samples $D_1$ to $D_{35}$ were prepared in the same manner as the preparation of Sample C except that the organic synthetic polymer was incorporated into a layer other than the third layer as shown in Table 4 below.

All samples thus prepared had a layer pH of around 6.

These samples were subjected to continuous gradation exposure through an optical wedge for sensitometry and then processed in accordance with the manner described below.

| Processing Steps | Temperature (°C.) | Time |
|---|---|---|
| Color Development | 35 | 45 sec |
| Bleach-Fixing | 35 | 1 min 00 sec |
| Washing with Water | 25 to 30 | 2 min 30 sec |

The composition of each processing solution used for the above color development processing steps was as follows.

| | |
|---|---|
| Color Developing Solution: | |
| Water | 800 ml |
| Ethylenediaminetetraacetic Acid | 1.0 g |
| Sodium sulfite | 0.2 g |
| N,N-Diethylhydroxylamine | 4.2 g |
| Potassium bromide | 0.01 g |
| Sodium chloride | 1.5 g |
| Triethanolamine | 8.0 g |
| Potassium carbonate | 30 g |
| N-ethyl-N-(β-methanesulfonamidoethyl)-3-methyl-4-aminoaniline sulfate | 4.5 g |
| 4,4'-Diaminostilbene type brightening agent (Whitex 4 manufactured by Sumitomo Chemical Co., Ltd.) | 2.0 g |
| Water to make | 1,000 ml |
| Adjusted pH to 10.25 with KOH | |
| Bleach-Fixing Solution: | |
| Ammonium thiosulfate (54% by weight aqueous solution) | 150 ml |
| $Na_2SO_3$ | 15 g |
| $NH_4[Fe(III)(EDTA)]$ | 55 g |
| EDTA.2Na | 4 g |
| Glacial acetic acid | 8.61 g |
| Water to make | 1,000 ml |
| | pH 5.4 |
| Rinsing Solution: | |
| $EDTA.2Na.2H_2O$ | 0.4 g |
| Water to make | 1,000 ml |
| | pH 7.0 |

Then, the magenta reflective density (stain) in the non-image portion of each of the samples as processed by the above-described development processing was measured one hour after the processing. Further, the magenta reflective density (stain) in the non-image portion of each sample was also measured, after the samples were stored at 80° C. and 70% RH for 5 days or were left at room temperature for 80 days. The results thus obtained are shown in Table 4 below, wherein the increase in the stain from that measured in one hour after the processing is set forth.

TABLE 4

| | Third Layer | | | | | Increase in Magenta Density | | |
|---|---|---|---|---|---|---|---|---|
| Sample | Coupler | Additive | Amount Added (mol % to Coupler) | Polymer (Layer) ($g/m^2$) | Amount Added | 80° C., 70% RH 5 Days | Room Temperature 80 Days | Remark |
| C | M-5 | — | — | — | — | 0.12 | 0.11 | Comparison |
| $C_1$ | " | — | — | P-3 (3rd Layer) | 1.0 | 0.19 | 0.17 | " |
| $C_2$ | " | — | — | P-21 (3rd Layer) | " | 0.21 | 0.19 | " |
| $C_3$ | " | — | — | P-57 (3rd Layer) | " | 0.20 | 0.19 | " |
| $C_4$ | " | — | — | P-62 (3rd Layer) | " | 0.19 | 0.18 | " |
| $C_5$ | " | I-41 | 30 | — | — | 0.07 | 0.05 | |
| $C_6$ | " | III-26 | " | — | — | 0.08 | 0.05 | " |
| $C_7$ | " | I-6 | " | P-3 (3rd Layer) | 1.0 | 0.02 | 0.01 | Invention |
| $C_8$ | " | I-20 | " | P-3 (3rd Layer) | " | 0.02 | 0.01 | " |
| $C_9$ | " | I-22 | " | P-3 (3rd Layer) | " | 0.03 | 0.02 | " |
| $C_{10}$ | " | I-36 | " | P-3 (3rd Layer) | " | 0.02 | 0.02 | " |
| $C_{11}$ | " | I-49 | " | P-3 (3rd Layer) | " | 0.02 | 0.01 | " |
| $C_{12}$ | " | I-72 | " | P-3 (3rd Layer) | " | 0.03 | 0.01 | " |
| $C_{13}$ | " | III-1 | " | P-3 (3rd Layer) | " | 0.02 | 0.01 | " |

TABLE 4-continued

| Sample | Third Layer Coupler | Third Layer Additive | Third Layer Amount Added (mol % to Coupler) | Polymer (Layer) (g/m²) | Amount Added | Increase in Magenta Density 80° C., 70% RH 5 Days | Increase in Magenta Density Room Temperature 80 Days | Remark |
|---|---|---|---|---|---|---|---|---|
| $C_{14}$ | " | III-34 | " | P-3 (3rd Layer) | " | 0.02 | 0.01 | " |
| $D_1$ | M-5 | — | — | P-3 (1st Layer) | 1.0 | 0.21 | 0.18 | Comparison |
| $D_2$ | " | — | — | P-3 (4th Layer) | " | 0.20 | 0.18 | " |
| $D_3$ | " | — | — | P-21 (5th Layer) | " | 0.20 | 0.19 | " |
| $D_4$ | " | — | — | P-57 (2nd Layer) | " | 0.19 | 0.17 | " |
| $D_5$ | " | I-47 | 30 | P-21 (5th Layer) | " | 0.02 | 0.01 | Invention |
| $D_6$ | " | I-49 | " | P-21 (5th Layer) | " | 0.03 | 0.02 | " |
| $D_7$ | " | III-1 | " | P-21 (5th Layer) | " | 0.02 | 0.02 | " |
| $D_8$ | " | I-49/III-1 | 30/30 | P-21 (5th Layer) | " | 0.01 | 0.01 | " |
| $D_9$ | " | " | " | P-3 (5th Layer) | " | 0.03 | 0.02 | " |
| $D_{10}$ | M-12 | — | — | — | — | 0.11 | 0.10 | Comparison |
| $D_{11}$ | " | — | — | P-57 (5th Layer) | 1.0 | 0.21 | 0.16 | " |
| $D_{12}$ | M-12 | II-1 | 50 | P-57 (5th Layer) | 1.0 | 0.03 | 0.02 | Invention |
| $D_{13}$ | " | I-37 | 30 | P-57 (5th Layer) | " | 0.02 | 0.02 | " |
| $D_{14}$ | " | III-58 | " | P-21 (1st Layer) | " | 0.02 | 0.01 | " |
| $D_{15}$ | M-1 | — | — | — | — | 0.13 | 0.11 | Comparison |
| $D_{16}$ | " | — | — | P-57 (1st Layer) | 1.0 | 0.22 | 0.18 | " |
| $D_{17}$ | " | Comparative Compound A | 30 | P-57 (1st Layer) | " | 0.20 | 0.15 | " |
| $D_{18}$ | " | Comparative Compound B | " | P-57 (1st Layer) | " | 0.19 | 0.16 | " |
| $D_{19}$ | " | Comparative Compound C | " | P-57 (1st Layer) | " | 0.21 | 0.17 | " |
| $D_{20}$ | " | Comparative Compound D | " | P-57 (1st Layer) | " | 0.18 | 0.15 | " |
| $D_{21}$ | " | I-24 | " | P-57 (1st Layer) | " | 0.03 | 0.02 | Invention |
| $D_{22}$ | " | I-29 | " | P-57 (1st Layer) | " | 0.03 | 0.02 | " |
| $D_{23}$ | " | III-41 | " | P-21 (5th Layer) | " | 0.02 | 0.02 | " |
| $D_{24}$ | " | III-45 | " | P-21 (5th Layer) | " | 0.02 | 0.03 | " |
| $D_{25}$ | M-16 | — | — | — | — | 0.09 | 0.08 | Comparison |
| $D_{26}$ | " | — | — | P-62 (5th Layer) | 1.0 | 0.15 | 0.14 | " |
| $D_{27}$ | " | I-36 | 30 | P-62 (5th Layer) | " | 0.03 | 0.01 | Invention |
| $D_{28}$ | " | I-38 | " | P-62 (5th Layer) | " | 0.02 | 0.02 | " |
| $D_{29}$ | " | I-56 | " | P-62 (5th Layer) | " | 0.02 | 0.01 | " |
| $D_{30}$ | " | III-3 | " | P-62 (5th Layer) | " | 0.03 | 0.01 | " |
| $D_{31}$ | M-17 | — | — | — | — | 0.08 | 0.07 | Comparison |
| $D_{32}$ | " | — | — | P-21 (1st Layer) | 1.0 | 0.11 | 0.10 | " |
| $D_{33}$ | " | I-35 | 30 | P-21 (1st Layer) | " | 0.03 | 0.02 | Invention |
| $D_{34}$ | " | I-44 | " | P-21 (1st Layer) | " | 0.02 | 0.02 | " |
| $D_{35}$ | " | III-40 | " | P-62 (1st Layer) | " | 0.02 | 0.01 | " |

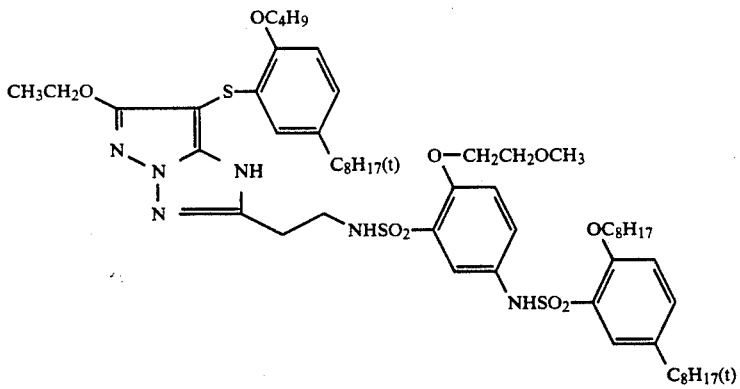

(M-16)

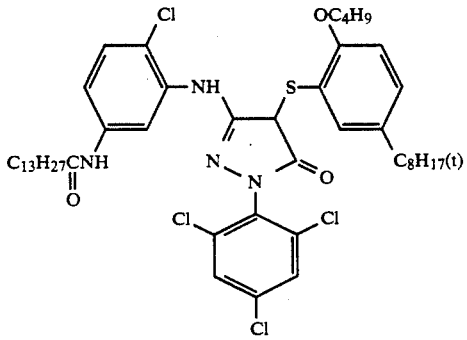

(M-17)

It is apparent from the results shown in Table 4 above that where the organic synthetic polymer according to the present invention was added to the layer containing a magenta coupler or other layers, the occurrence of magenta stain after processing was accelerated. The magenta stain could not be sufficiently prevented by the addition of known anti-staining agents. On the contrary, the occurence of magenta stain was sufficiently prevented by the preservability improving compound capable of forming a chemical bond with a developing agent or an oxidation product thereof.

Substantially the same results as shown in Table 4 above were obtained where the silver chlorobromide emulsions used in the first, third and fifth layers were changed to silver halide emulsions having halide compositions varied from pure silver chloride to pure silver bromide.

EXAMPLE 4

The samples prepared in Example 3 were exposed to light through an optical wedge in the same manner as described in Example 3 and then processed in accordance with one of the following Processing Methods (I) to (VI). The effect on preventing magenta stain was evaluated in the same manner as described in Example 3. As a result, the increase in magenta stain was recognized in each comparative sample but with the samples incorporating the compounds according to the present invention substantially no magenta stain was observed.

| Processing Method (I): | | |
|---|---|---|
| Processing Steps | Temperature (°C.) | Time |
| Color Development | 38 | 1 min and 40 sec |
| Bleach-Fixing | 30–34 | 1 min and 00 sec |
| Rinsing (1) | 30–34 | 20 sec |

-continued

| Processing Method (I): | | |
|---|---|---|
| Processing Steps | Temperature (°C.) | Time |
| Rinsing (2) | 30–34 | 20 sec |
| Rinsing (3) | 30–34 | 20 sec |
| Drying | 70–80 | 50 sec |

The rinsing steps were conducted according to a three-tank countercurrent system from Rinsing (3) to Rinsing (1).

The processing solutions used had the following compositions, respectively.

| | |
|---|---|
| Color Developing Solution: | |
| Water | 800 ml |
| Diethylenetriaminepentaacetic acid | 1.0 g |
| 1-Hydroxyethylidene-1,1-diphosphonic acid (60 wt %) | 2.0 g |
| Nitrilotriacetic acid | 2.0 g |
| 1,3-Diamino-2-propanol | 4.0 g |
| 1,4 Diazabicyclo[2,2,2]octane | 6.0 g |
| Potassium bromide | 0.5 g |
| Potassium carbonate | 30 g |
| N-ethyl-N-(β-methanesulfonamidoethyl)-3-methyl-4-aminoaniline sulfate | 5.5 g |
| N,N-diethylhydroxylamine sulfate | 4.0 g |
| Brightening agent (UVITEX-CK manufactured by Ciba-Geigy A.G.) | 1.5 g |
| Water to make | 1,000 ml |
| pH (at 25° C.) | 10.25 |
| Bleach-Fixing Solution: | |
| Water | 400 ml |
| Ammonium thiosulfate (70 wt %) | 200 ml |
| Sodium sulfite | 20 g |
| Ammonium Iron (III) ethylenediaminetetraacetate | 60 g |
| Disodium ethylenediaminetetraacetate | 10 g |
| Water to make | 1,000 ml |
| pH (at 25° C.) | 7.00 |

-continued

Rinsing Solution:

Ion-exchanged water (Ca, Mg ≦ 3 ppm each)

Processing Method (II):

| Processing Step | Temperature (° C.) | Time (sec.) | Amount of Replenisher* (ml) | Tank Capacity (liter) |
|---|---|---|---|---|
| Color development | 35 | 45 | 161 | 17 |
| Bleach-fixing | 30–36 | 45 | 215 | 17 |
| Stabilizing (1) | 30–37 | 20 | — | 10 |
| Stabilizing (2) | 30–37 | 20 | — | 10 |
| Stabilizing (3) | 30–37 | 20 | — | 10 |
| Stabilizing (4) | 30–37 | 30 | 248 | 10 |
| Drying | 70–85 | 60 | | |

*Per square meter of the photographic light-sensitive material.

The stabilizing steps were conducted according to a four-tank countercurrent system from Stabilizing (4) to Stabilizing (1).

The processing solutions used had the following compositions, respectively.

| | Tank Solution | Replenisher |
|---|---|---|
| Color Developing Solution: | | |
| Water | 800 ml | 800 ml |
| Ethylenediaminetetraacetic acid | 2.0 g | 2.0 g |
| 5,6-Dihydroxybenzene-1,2,4-trisulfonic acid | 0.3 g | 0.3 g |
| Triethanolamine | 8.0 g | 8.0 g |
| Potassium bromide | 0.6 g | — |
| Potassium carbonate | 25 g | 25 g |
| N-ethyl-N-(β-methanesulfonamidoethyl)-3-methyl-4-aminoaniline sulfate | 5.0 g | 7.0 g |
| Diethylhydroxylamine | 4.2 g | 6.0 g |
| Brightening agent (4,4'-diaminostilbene compound) | 2.0 g | 2.5 g |
| Water to make | 1,000 ml | 1,000 ml |
| pH (at 25° C.) | 10.05 | 10.45 |
| Bleaching-fixing Solution (Same for both Tank Solution and Replenisher): | | |
| Water | 400 ml | |
| Ammonium thiosulfate (70 wt%) | 100 ml | |
| Sodium sulfite | 17 g | |
| Ammonium iron (III) Ethylenediaminetetraacetate | 55 g | |
| Disodium ethylenediaminetetraacetate | 5 g | |
| Glacial acetic acid | 9 g | |
| Water to make | 1,000 ml | |
| pH (at 25° C.) | 5.40 | |
| Stabilizing Solution (Same for both Tank Solution and Replenisher): | | |
| Formaldehyde (37% aq. sol.) | 0.1 g | |
| Formaldehyde-sulfite adduct | 0.7 g | |
| 5-Chloro-2-methyl-4-isothiazolin-3-one | 0.02 g | |
| 2-Methyl-4-isothiazolin-3-one | 0.01 g | |
| Copper sulfate | 0.005 g | |
| Water to make | 1000 ml | |
| pH (at 25° C.) | 4.0 | |

Process Method (III)

The samples exposed were subjected to running development processing using a Fuji Color Roll Processor FMPP 1000 (partly modified) (manufactured by Fuji Photo Film Co., Ltd.) under the conditions described below.

| Processing Step | Time (seconds) | Temperature (°C.) | Tank Capacity (liter) | Amount of Replenisher (ml/m²) |
|---|---|---|---|---|
| Color Development | 45 | 35 | 88 | 150 |
| Bleach-fixing | 45 | 35 | 35 | 50 |
| Rinsing (1) | 20 | 35 | 17 | — |
| Rinsing (2) | 20 | 35 | 17 | — |
| Rinsing (3) | 20 | 35 | 17 | 250 |

The rinsing steps were carried out by means of a three-tank countercurrent system, where a replenisher was supplied into the rinsing tank (3), the overflow solution from rinsing tank (3) was introduced into the bottom of rinsing tank (2), the overflow solution from rinsing tank (2) was introduced into the bottom of rinsing tank (1), and the overflow solution from rinsing tank (1) was drained out therefrom. The amount of the processing solution carried over from the previous bath into the next bath together with the photographic paper being processed in this system was 25 ml per m² of the paper.

The processing solutions used in the tanks and the replenishers had the following compositions respectively.

| | Tank Solution | Replenisher |
|---|---|---|
| Color Developing Solution: | | |
| Water | 800 ml | 800 ml |
| Diethylenetraminepentaacetic acid | 3.0 g | 3.0 g |
| Benzyl alcohol | 15 ml | 17 ml |
| Diethylene glycol | 10 ml | 10 ml |
| Sodium sulfite | 2.0 g | 2.5 g |
| Potassium bromide | 0.5 g | — |
| Sodium carbonate | 30 g | 35 g |
| N-Ethyl-N-(β-methanesulfonamidoethyl)-3-methyl-4-aminoaniline sulfate | 5.0 g | 7.0 g |
| Hydroxylamine sulfate | 4.0 g | 4.5 g |
| Brightening agent | 1.0 g | 1.5 g |
| Water to make | 1000 ml | 1000 ml |
| pH | 10.10 | 10.50 |
| Bleaching-fixing Solution: | | |
| Water | 400 ml | 400 ml |
| Ammonium thiosulfate (70 wt % aq. solu.) | 150 ml | 300 ml |
| Sodium sulfite | 12 g | 25 g |
| Ammonium iron (III) ethylenediaminetetraacetate | 55 g | 110 g |
| 2Na Ethylenediaminetetraacetate | 5 g | 10 g |
| Water to make | 1000 ml | 1000 ml |
| pH (25° C.) | 6.70 | 6.50 |
| Rinsing Solution: | | |
| Ethylenediamine-N,N,N',N'-tetramethylene-phosphonic acid | 0.3 g | |
| Benzotriazole | 1.0 g | |
| Water to make | 1000 ml | |
| Sodium hydroxide to make | pH 7.5 | |

Processing Method (IV):

| Step | Time | Temperature (°C.) | Tank Capacity (liter) | Amount of Replenisher (ml/m²) |
|---|---|---|---|---|
| Color Development | 45 sec | 35 | 88 | 150 |
| Bleach-fixing | 2 min 00 sec | 35 | 35 | 350 |
| Rinsing (1) | 1 min 00 sec | 35 | 17 | — |
| Rinsing (2) | 1 min 00 sec | 35 | 17 | — |

-continued

| | | | | |
|---|---|---|---|---|
| Rinsing (3) | 1 min 00 sec | 35 | 17 | 1300 |

The process solutions and the replenishers used were same as those used in Processing Method (III).

Processing Method (V):

| Processing Steps | Temperature (°C.) | Time |
|---|---|---|
| Color Development | 33 | 3 min 30 sec |
| Bleach-fixing | 33 | 1 min 30 sec |
| Washing with Water | 28 to 35 | 3 min 00 sec |

The processing solutions used had the following compositions, respectively.

| | |
|---|---|
| Color Developing Solution: | |
| Diethylenetriaminepentaacetic acid | 1.0 g |
| Benzyl alcohol | 15 ml |
| Diethylene glycol | 10 ml |
| $Na_2SO_3$ | 2.0 g |
| KBr | 0.5 g |
| Hydroxylamine sulfate | 3.0 g |
| 4-Amino-3-methyl-N-ethyl-N-[β-(methanesulfonamido)ethyl]-p-phenylenediamine sulfate | 5.0 g |
| $Na_2SO_3$ (*monohydrate*) | 30 g |
| Brightening agent (4,4'-diaminostilbene type) | 1.0 g |
| Water to make | 1,000 ml |
| | pH 10.1 |
| Bleach-Fixing Solution: | |
| Ammonium thiosulfate (70% by weight aqueous solution) | 150 ml |
| $Na_2SO_3$ | 15 g |
| $NH_4$[Fe(III)(EDTA)] | 55 g |
| EDTA.2Na | 4 g |
| Water to make | 1,000 ml |
| | pH 6.9 |

Processing Method (VI)

The same processing method as Processing Method (V) was employed except using a color developing solution having the following composition.

| | |
|---|---|
| Color Developing Solution: | |
| Diethylenetriaminepentaacetic acid | 1.0 g |
| Diethylene glycol | 10 ml |
| $Na_2SO_3$ | 2.0 g |
| KBr | 0.5 g |
| Hydroxylamine sulfate | 3.0 g |
| 4-Amino-3-methyl-N-ethyl-N-[β-(methanesulfonamido)ethyl]-p-phenylenediamine sulfate | 5.0 g |
| $Na_2CO_3$ (monohydrate) | 30 g |
| Brightening agent (4,4'-diaminostilbene) | 1.0 g |
| Water to make | 1,000 ml |
| | pH 10.1 |

In accordance with the combination use of the compound and the organic synthetic polymer according to the present invention, the fastness to light, heat and humidity of color images is extremely improved, and the occurrence of color stain with the lapse of time after color development processing is efficiently controlled. Therefore, the color photographs obtained can be preserved with excellent image quality for a long period of time.

While the invention has been described in detail and with reference to specific embodiments thereof, it will be apparent to one skilled in the art that various changes and modifications can be made therein without departing from the spirit and scope thereof.

We claim:

1. A silver halide color photographic material comprising a support having thereon at least one silver halide emulsion layer containing an emulsified dispersion of at least one color image forming coupler, at least one organic solvent having a high boiling point and at least organic synthetic homopolymer or copolymer of at least one monomer containing a $$-\overset{O}{\overset{\|}{C}}-$$

group, said silver halide color photographic material further containing at least one compound of formula (I) or (III):

wherein said at least one compound represented by formula (I) is capable of forming a chemical bond with an aromatic amine developing agent after color development to form a chemically inactive and substantially colorless compound:

$$R_1-(A)_n-X \quad (I)$$

wherein $R_1$ represents an aliphatic group, an aromatic group or a heterocyclic group; X represents a group capable of being released by a reaction with an aromatic amine developing agent; A represents a group capable of reacting with an aromatic amine developing agent to form a chemical bond; n represents 0 or 1; and $R_1$ and X may be linked to form a ring; provided that the compound represented by the general formula (I) has a second order reaction rate constant $K_2$ at 80° C. in a reaction with p-anisidine of from 1.0 l/mol.sec to $1\times10^{-5}$ l/mol.sec, and wherein said at least one compound represented by formula (III) is capable of forming a chemical bond with the oxidation product of the aromatic amine developing agent after color development processing to give a chemically inactive and substantially colorless compound:

$$R-Z \quad (III)$$

wherein R represents an aliphatic group, an aromatic group or a heterocyclic group; and Z represents a nucleophilic group or a group capable of being decomposed in the photographic material to release a nucleophilic group, wherein the nucleophilic group is a nucleophilic functional group having a Pearson's nucleophilic $^nCH_3I$ value of at least 5 or a group derived therefrom, and wherein the nucleophilic group is a nucleophilic group having an oxygen atom, a sulfur atom, or a nitrogen atom as the atom which directly chemically connects to the oxidation product of the aromatic amine developing agent, said compound of formula (I) or (III) being in a hydrophilic colloid layer on said support in the same side in which said silver halide emulsion layer is positioned.

2. The silver halide color photographic material as claimed in claim 1, wherein the organic synthetic homopolymer or copolymer has a glass transition point of at least 50° C.

3. The silver halide color photographic material as claimed in claim 1, wherein the organic synthetic homopolymer or copolymer has a molecular weight of at most 150,000 and a viscosity of at most 5,000 cps when 30 g of the polymer is dissolved in 100 m/l of an auxiliary solvent.

4. The silver halide color photographic material as claimed in claim 3, wherein the organic synthetic polymer is a vinyl polymer of at least one monomer selected from an acrylic acid ester, a methacrylic acid ester, a vinyl ester, an acrylamide, and a methacrylamide.

5. The silver halide color photographic material as claimed in claim 4, wherein the organic synthetic homopolymer or copolymer is a vinyl polymer of at least one monomer selected from a methacrylate, an acrylamide and a methacrylamide.

6. The silver halide color photographic material as claimed in claim 3, wherein the organic synthetic polymer is a polyester having a repeating unit of

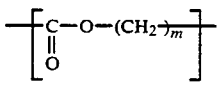

wherein m is an integer from 4 to 7 and the —$CH_2$— chain is a straight chain or a branched chain.

7. The silver halide color photographic material as claimed in claim 1, wherein the compound capable of forming a bond with an aromatic amine developing agent is represented by formulae (I-a), (I-b), (I-c) or (I-d), having a second order reaction rate constant $K_2$ at 80° C. in a reaction with p-anisidine of from $1\times10^{-1}$ l/mol.sec to $1\times10^{-5}$ l/mol.sec:

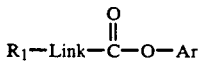

(I-a)

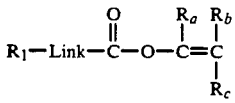

(I-b)

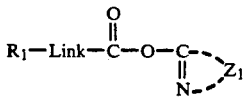

(I-c)

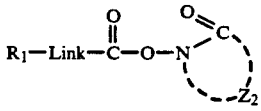

(I-d)

wherein $R_1$ has the same meaning as $R_1$ in formula (I); Link represents a single bond or —O—; Ar represents an aromatic group incapable of releasing a photographic reducing group by reaction with an aromatic amine developing agent; $R_a$, $R_b$ and $R_c$, which may be the same or different, each represents hydrogen, an aliphatic group, an aromatic group, a heterocyclic group, an alkoxy group, an aryloxy group, a heterocyclic oxy group, a carboxyl group, an alkylthio group, an arylthio group, a heterocyclic thio group, an amino group, an alkylamino group, an acylamino group, a sulfonamido group, an acyl group, a sulfonyl group, an alkoxycarbonyl group, a sulfo group, a hydroxyl group, an acyloxy group, a ureido group, a urethane group, a carbamoyl group or a sulfamoyl group, and $R_a$ and $R_b$ or $R_b$ and $R_c$ may be linked to form a substituted or unsubstituted 5-membered to 7-membered heterocyclic ring, a heterocyclic spiro ring, a heterocyclic bicyclo ring, or a heterocyclic ring condensed with an aromatic ring; and $Z_1$ and $Z_2$, which may be the same or different, each represents a non-metallic atomic group necessary for forming a substituted or unsubstituted 5-membered to 7-membered heterocyclic ring, a heterocyclic spiro ring, a heterocyclic bicyclo ring, or a heterocyclic ring condensed with an aromatic ring.

8. The silver halide color photographic material as claimed in claim 1, wherein the compound capable of forming a bond with an oxidation product is represented by formula (III-a):

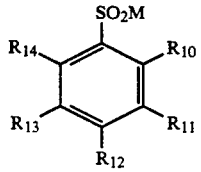

(III-a)

wherein M represents an atom or an atomic group capable of forming an inorganic salt or an organic salt,

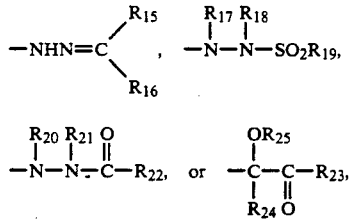

wherein $R_{15}$ and $R_{16}$, which may be the same or different, each represents hydrogen, an aliphatic group, an aromatic group, or a heterocyclic group, and $R_{15}$ and $R_{16}$ may be linked to form a 5-membered to 7-membered ring; $R_{17}$, $R_{18}$, $R_{20}$, and $R_{21}$, which may be the same or different, each represents hydrogen, an aliphatic group, an aromatic group, a heterocyclic group, an acyl group, an alkoxycarbonyl group, a sulfonyl group, a ureido group, or a urethane group, provided that at least one of $R_{17}$ and $R_{18}$, and at least One of $R_{20}$ and $R_{21}$ represents hydrogen; $R_{22}$ represents hydrogen , an aliphatic group, an aromatic group, or a heterocyclic group; $R_{19}$ represents hydrogen, an aliphatic group, an aromatic group, a heterocyclic group, an alkylamino group, an arylamino group, an alkoxy group, an aryloxy group, an acyl group, an alkoxycarbonyl group, or an aryloxycarbonyl group; at least two of $R_{17}$, $R_{18}$ and $R_{19}$ may be linked to form a 5-membered to 7-membered ring, and at least two of $R_{20}$, $R_{21}$ and $R_{22}$ may be linked to form a 5-membered to 7-membered ring; $R_{23}$ represents hydrogen, an aliphatic group, an aromatic group or a heterocyclic group; $R_{24}$ represents hydrogen, an aliphatic group, an aromatic group, a halogen atom, an acyloxy group or a sulfonyl group; $R_{25}$ represents hydrogen or a hydrolyzable group; and $R_{10}$, $R_{11}$, $R_{12}$, $R_{13}$, and $R_{14}$, which may be the same or different, each represents hydrogen; an aliphatic group; an aromatic group; a heterocyclic group; a halogen atom; —$SR_{26}$, —$OR_{26}$ or

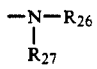

wherein $R_{26}$ and $R_{27}$, which may be the same or different, each represents hydrogen, an aliphatic group, an alkoxy group, or an aromatic group; an acyl group; an alkoxycarbonyl group; an aryloxycarbonyl group; a sulfonyl group; a sulfonamido group; sulfamoyl group; a ureido group; a urethane group; a carbamoyl group; a sulfo group; a carboxyl group; a nitro group; a cyano group; an alkoxyallyl group; an aryloxyallyl group; a sulfonyloxy group; a formyl group; or $-P(R_{26})_2$,

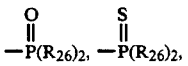

$-P(OR_{26})_2$, wherein $R_{26}$ has the same meaning as defined above.

9. The silver halide color photographic material as claimed in claim 1, wherein said layer comprises the combination of said compound represented by formula (I) and said compound represented by formula (III).

10. The silver halide color photographic material as claimed in claim 1, wherein the ratio of said organic synthetic polymer to said coupler being from 1:20 to 20:1 by weight; said compound capable of forming a chemical bond with an aromatic amine developing agent or an oxidation product thereof being present in an amount of from $1\times10^{-2}$ mol to 10 mol per mol of said coupler.

11. The silver halide color photographic material as claimed in claim 10, wherein said layer further comprises a silver halide, said coupler being present in an amount of from $2\times10^{-3}$ mol to $5\times10^{-1}$ mol per mol of silver in said silver halide.

12. The silver halide color photographic material as claimed in claim 10, wherein the coupler is represented by formulae (IV), (V), (VI), (VII) or (VIII):

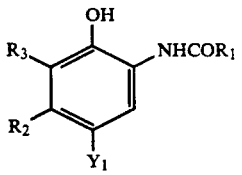

(IV)

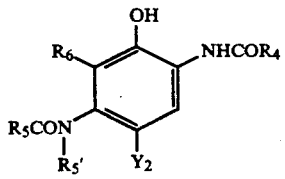

(V)

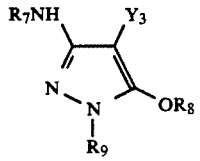

(VI)

-continued

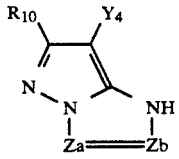

(VII)

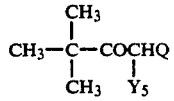

(VIII)

wherein $R_1$, $R_4$, and $R_5$, which may be the same or different, each represents an aliphatic group, an aromatic group, a heterocyclic group, an aromatic amino group or a heterocyclic amino group; $R_2$ represents an aliphatic group; $R_3$ and $R_6$, which may be the same or different, each represents hydrogen, a halogen atom, an aliphatic group, an aliphatic oxy group, or an acylamino group; $R_5'$ represents hydrogen, or a group represented by $R_5$ defined above; $R_7$ and $R_9$, which may be the same or different, each represents a substituted or unsubstituted phenyl group; $R_8$ represents hydrogen, an aliphatic acyl group, an aromatic acyl group, an aliphatic sulfonyl group, or an aromatic sulfonyl group; $R_{10}$ represents hydrogen or a substitutent; Q represents a substituted or unsubstituted N-phenylcarbamoyl group; $Z_a$ and $Z_b$, which may be the same or different, each represents a methine group, a substituted methine group, or =N—; $Y_1$, $Y_2$, $Y_3$, $Y_4$ and $Y_5$, which may be the same or different, each represents hydrogen, or a group capable of being cleaved by a coupling reaction with the oxidation product of a color developing agent; $R_2$ and $R_3$ or $R_5$ and $R_6$ may be linked to form a 5-membered, 6-membered, or 7-membered ring; and the coupler may form a dimer or a higher polymer through $R_1$, $R_2$, $R_3$ or $Y_1$; $R_4$, $R_5$, $R_6$ or $Y_2$; $R_7$, $R_8$, $R_9$ or $Y_3$; $R_{10}$, $Z_a$, $Z_b$ or $Y_4$; or Q or $Y_5$.

13. The silver halide color photographic material as claimed in claim 12, wherein said coupler is a cyan coupler represented by formula (IV) wherein $R_2$ represents an alkyl group containing 2 to 4 carbon atoms.

14. The silver halide color photographic material as claimed in claim 1, wherein said organic synthetic polymer is contained in oil droplets together with a cyan coupler, as said emulsified dispersion in a silver halide emulsion layer.

15. The silver halide color photographic material as claimed in claim 1, wherein said compound capable of forming a chemical bond with an aromatic amine developing agent or an oxidation product thereof is present in a silver halide emulsion layer containing a magenta coupler.

16. The silver halide color photographic material as claimed in claim 1, wherein the color photographic material contains a compound selected from (i) aromatic compounds represented by the general formula (IX) described below, (ii) amine compounds represented by the general formula (X) described below, and (iii) metal complexes containing copper, cobalt, nickel, palladium or platinum as the central metal and having at least one organic ligand having a bidentate or higher conformation:

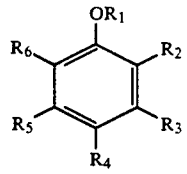

(IX)

wherein $R_1$ represents hydrogen, an alkyl group, an alkenyl group, an aryl group, a heterocyclic group or

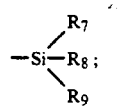

$R_7$, $R_8$ and $R_9$, which may be the same or different, each represents an alkyl group, an alkenyl group, an aryl group, an alkoxy group, an alkenoxy group or an aryloxy group; $R_2$, $R_3$, $R_4$, $R_5$ and $R_6$, which may be the same or different, each represents hydrogen, an alkyl group, an alkenyl group, an aryl group, an acylamino group, an alkylamino group, an alkylthio group, an arylthio group, an alkoxycarbonyl group, an aryloxycarbonyl group, a halogen atom or —O—$R_1'$; $R_1'$ has the same meaning as defined for $R_1$; $R_1$ and $R_2$ may be linked to form a 5-membered ring, 6-membered ring or spiro ring; and $R_2$ and $R_3$ or $R_3$ and $R_4$ may be linked to form a 5-membered ring, 6-membered ring or spiro ring,

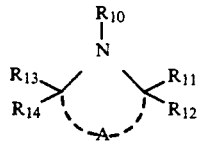

(X)

wherein $R_{10}$ represents hydrogen, an alkyl group, an alkenyl group, an alkinyl group, an acyl group, a sulfonyl group, a sulfinyl group, an oxy-radical group or a hydroxyl group; $R_{11}$, $R_{12}$, $R_{13}$ and $R_{14}$, which may be the same or different, each represents hydrogen or an alkyl group; and A represents a non-metallic atomic group necessary for forming a 5-membered, 6-membered or 7-membered ring.

17. The silver halide color photographic material as claimed in claim 1, wherein said organic solvent having a high boiling point is at least a compound selected from compounds represented by formulae (S-I) to (S-VI) as follows:

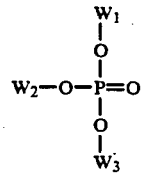

(S-I)

$W_1$—COO—$W_2$ (S-II)

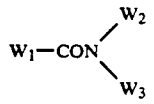

(S-III)

-continued

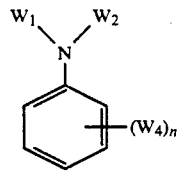

(S-IV)

$W_1$—O—$W_2$ (S-V)

HO—$W_5$ (S-VI)

wherein $W_1$, $W_2$, and $W_3$, which may be the same or different, each represents a substituted or unsubstituted alkyl group, a substituted or unsubstituted cycloalkyl group, a substituted or unsubstituted alkenyl group, a substituted or unsubstituted aryl group, or a substituted or unsubstituted heterocyclic group; $W_4$ represent $W_1$, —O—$W_1$, —S—$W_1$; n is an integer from 1 to 5 and when n is 2 or more, plural $W_4$ groups may be the same or different; $W_1$ and $W_2$ in the general formula (S-V) may be linked to form a condensed ring; and $W_5$ represents a substituted or unsubstituted alkyl group or a substituted or unsubstituted aryl group and the total number of carbon atoms included in $W_5$ is not less than 12.

18. The silver halide color photographic material as claimed in claim 1, wherein A of the general formula (I) represents

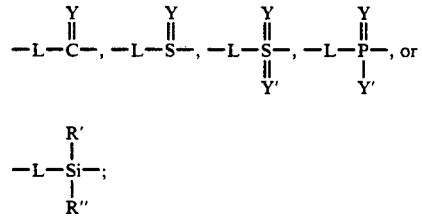

wherein L represents a single bond, an alkylene group,

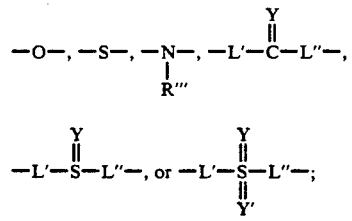

wherein Y and Y' each represents an oxygen atom, a sulfur atom, =N—$R_4$ or

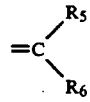

wherein, $R_4$, $R_5$ and $R_6$, which may be the same or different, each represents hydrogen, an aliphatic group, an aromatic group, a heterocyclic group, an acyl group, or a sulfonyl group, and $R_5$ and $R_6$ may be linked to form a cyclic structure;

wherein R′ and R″, which may be the same or different, each represents —L‴—$R_0$, $R_0$ has the same meaning as $R_1$, R‴ represents a hydrogen atom, an aliphatic group, an aromatic group, a heterocyclic group, an acyl group, or a sulfonyl group, and L′, L″ and L‴ each represents —O—, —S—, or $$-\underset{\underset{R'''}{|}}{N}-,$$

19. The silver halide color photographic material as claimed in claim 1, wherein A of the general formula (I) represents $$-O-\overset{\overset{O}{\|}}{C}-,\ -S-\overset{\overset{O}{\|}}{C}-,\ \text{or -alkylene-}\overset{\overset{O}{\|}}{C}-.$$

20. The silver halide color photographic material as claimed in claim 1, wherein X of the general formula (I) represents a halogen atom or a group capable of being released upon reaction with an aromatic amine developing agent, which connects to A through an oxygen atom, a sulfur atom, or a nitrogen atom.

21. The silver halide color photographic material as claimed in claim 1, wherein the compound capable of forming a chemical bond with the aromatic amine developing agent or the oxidation product thereof still remaining after color development to form a chemically inactive and substantially colorless compound represented by general formula (I) or (III), is co-emulsified with the coupler.

22. The silver halide color photographic material as claimed in claim 1, wherein the compound capable of forming a chemical bond with the aromatic amine developing agent or the oxidation product thereof still remaining after color development to form a chemically inactive and substantially colorless compound represented by general formula (I) or (III), is incorporated in an amount of from $1\times10^{-2}$ to 10 mole per mole of the coupler.

23. The silver halide color photographic material as claimed in claim 1, wherein the compound capable of forming a chemical bond with the aromatic amine developing agent or the oxidation product thereof still remaining after color development to form a chemically inactive and substantially colorless compound represented by general formula (I) or (III), is incorporated in an amount of from $3\times10^{-2}$ to 5 mole per mole of the coupler.

* * * * *